US011485035B2

(12) United States Patent
Soria Perujo et al.

(10) Patent No.: US 11,485,035 B2
(45) Date of Patent: Nov. 1, 2022

(54) SHEET PROCESSING MACHINE AND METHOD FOR DRIVING AT LEAST ONE TOOL OF A SHEET PROCESSING MACHINE

(71) Applicant: KOENIG & BAUER AG, Würzburg (DE)

(72) Inventors: Jose Luis Soria Perujo, Cubelles (ES); Sergi Ollé, El Prat de Llobregat (ES)

(73) Assignee: KOENIG & BAUER AG, Würzburg (DE)

( * ) Notice: Subject to any disclaimer, the term of this patent is extended or adjusted under 35 U.S.C. 154(b) by 0 days.

(21) Appl. No.: 17/601,943

(22) PCT Filed: Oct. 29, 2020

(86) PCT No.: PCT/EP2020/080389
§ 371 (c)(1),
(2) Date: Oct. 7, 2021

(87) PCT Pub. No.: WO2021/094096
PCT Pub. Date: May 20, 2021

(65) Prior Publication Data

US 2022/0088817 A1 Mar. 24, 2022

(30) Foreign Application Priority Data

Nov. 15, 2019 (DE) ..... 10 2019 130 862.3

(51) Int. Cl.
*B26D 7/18* (2006.01)
*B26F 1/40* (2006.01)

(52) U.S. Cl.
CPC ..... *B26D 7/1818* (2013.01); *B26F 1/40* (2013.01)

(58) Field of Classification Search
CPC ..... B26D 7/18; B26D 7/1818
See application file for complete search history.

(56) References Cited

U.S. PATENT DOCUMENTS 4,921,154 A * 5/1990 Abe ..... B26F 1/40 225/97
2013/0045847 A1* 2/2013 Capoia ..... B26D 11/00 493/59
2015/0321868 A1* 11/2015 Rausch ..... B26D 1/095 242/527

FOREIGN PATENT DOCUMENTS

CA 2785310 A1 * 2/2013 ..... B31F 1/0025
CH 711 123 A1 11/2016
(Continued)

OTHER PUBLICATIONS

International Search Report of PCT/EP2020/080389 dated Feb. 10, 2021.

(Continued)

*Primary Examiner* — Jennifer S Matthews
(74) *Attorney, Agent, or Firm* — Mattingly & Malur, PC

(57) ABSTRACT

The invention relates to a sheet processing machine (01), comprising at least one infeed unit (200) and at least one shaping unit (300) and at least one stripping unit (400) and at least one multiple-up separating unit (500), wherein the sheet processing machine (01) comprises at least one drive (1001), wherein the at least one drive (1001) is configured to drive at least one stripping tool (402; 403) of at least one stripping mechanism (401) of the at least one stripping unit (400) and at least one multiple-up separating tool (502) of at least one multiple-up separating mechanism (501) of the at least one multiple-up separating unit (500) via at least one gear mechanism (1007), wherein at least one downstream gear mechanism (1019) is arranged downstream from the at least one gear mechanism (1007), wherein the at least one downstream gear mechanism (1019) is coupled to the at least one stripping tool (402; 403) of the at least one stripping unit (400) and/or to the at least one multiple-up separating tool (502) of the at least one multiple-up sepa-
(Continued)

rating unit (500), wherein the at least one downstream gear mechanism (1019) is configured to convert at least one rotative movement into at least one reciprocating movement, wherein the at least one downstream gear mechanism (1019) is configured as a disk cam mechanism (1019). The invention likewise relates to a further sheet processing machine (01) and to a method for driving at least one tool (402; 403; 502) of a sheet processing machine (01).

20 Claims, 25 Drawing Sheets

(56) References Cited

FOREIGN PATENT DOCUMENTS

| | | | | |
|---|---|---|---|---|
| DE | 1012497 B | | 7/1957 | |
| DE | 1045778 B | | 12/1958 | |
| DE | 1561132 B1 | | 8/1970 | |
| DE | 7309617 U | | 4/1978 | |
| DE | 8910976 U1 | | 1/1991 | |
| DE | 102008011051 A1 | | 8/2009 | |
| DE | 102010024778 A1 | | 12/2011 | |
| DE | 10 2015 209 700 A1 | | 12/2016 | |
| EP | 2263839 A1 | * | 12/2010 | ..... B26D 7/1863 |
| EP | 3492229 A1 | | 6/2019 | |
| EP | 3294555 B1 | | 9/2019 | |
| WO | 2016/180616 A1 | | 11/2016 | |

OTHER PUBLICATIONS

Chinese Office Action received in corresponding Chinese Application No. 202080026410.7 dated Jul. 18, 2022.

* cited by examiner

SHEET PROCESSING MACHINE AND METHOD FOR DRIVING AT LEAST ONE TOOL OF A SHEET PROCESSING MACHINE

CROSS-REFERENCE TO RELATED APPLICATIONS

This application is the US national phase, under 35 USC § 371, of PCT/EP 2020/080389, filed Oct. 29, 2020; published as WO 2021/094096 A1 on May 20, 2021, and claiming priority to DE 10 2019 130 862.3, filed Nov. 15, 2019, the disclosures of which are expressly incorporated herein in their entireties by reference.

FIELD OF THE INVENTION

The present invention relates to sheet processing machines and to a method for driving at least one tool of a sheet processing machine. The sheet processing machine comprises at least one infeed unit, at least one shaping unit, at least one stripping unit, and at least one multiple-up separating unit. The at least one stripping unit has at least one stripping mechanism, the at least one stripping mechanism comprising at least one tool configured as an upper stripping tool and at least one tool configured as a lower stripping tool. The sheet processing machine has at least one drive, the at least one drive being configured to drive the at least one stripping tool of the at least one stripping mechanism of the at least one stripping unit and at least one multiple-up separating tool of the at least one multiple up separating mechanism of the at least one multiple-up separating unit via at least one gear mechanism. At least one downstream gear mechanism is arranged downstream from the at least one gear mechanism. The at least one downstream gear mechanism is coupled to the at least one stripping tool of the at least one stripping unit and to the at least one multiple-up separating tool of the at least one multiple-up separating unit. The at least one downstream gear mechanism is configured to convert at least one rotative movement into at least one reciprocating movement. The at least one downstream gear mechanism is coupled to the at least one stripping tool of the at least one stripping unit. At least one transmitting element is located arranged beneath the at least one downstream gear mechanism and the at least one stripping tool. A method is provided for driving the at least one tool of the sheet processing machine.

BACKGROUND OF THE INVENTION

Web- or sheet-like materials are used in the production of packaging. For example, sheets are imprinted, embossed, creased, perforated, die-cut, cut, stitched, glued and, for example, folded into packaging in multiple processing steps. To optimally utilize the surface area of a sheet, in general multiple identical or different copies, for example of a poster, a folding box or a packaging, are printed on a common sheet and then die-cut. These copies are referred to as multiple-up copies.

A sheet processing machine can comprise different processing steps, such as imprinting, cutting, embossing, creasing, die cutting, perforating, gluing and/or stitching. Such sheet processing machines frequently also comprise inspection devices. Sheets are typically processed and cut to size in processing machines using tool-dependent die cutting and cutting devices.

Such a processing machine is configured as a die cutting, cutting, perforating, embossing and/or creasing machine, for example. When such a processing machine is referred to hereafter as a die cutter and/or a die-cutting machine, in particular also a cutting, perforating, embossing and/or creasing machine is meant. In addition to rotary die cutters, tool-dependent systems also encompass flat die cutters, in particular flat-bed die cutters. In these, multiple sheets are processed consecutively by a cyclically recurring movement.

The sheets are preferably moved substantially horizontally through the processing machine by way of a transport system, preferably a chain gripper system. In addition to a die-cutting unit, such a machine usually also comprises other units, such as a sheet infeed unit, a sheet delivery unit, a stripping unit, a sheet insert unit, a multiple-up separating unit and an offcut piece delivery unit. The sheet infeed unit is preferably configured to transfer sheets to the transport system. Additionally, sheets are, for example, aligned in the sheet infeed unit.

EP 3 294 555 B1 relates to a printing couple of a printing press that prints according to the screen printing method. A squeegee is arranged inside a forme cylinder. A driving means of a driving device can induce a throw-on and throw-off movement of the squeegees mechanically independently of a rotational drive. Another driving means induces a change in the squeegee angle. In the process, the further driving means causes a lever arm to pivot via a gear mechanism, the lever arm carrying the squeegee carrier, whereby the squeegee is pivoted.

EP 3 492 229 A1 shows a device for processing a digitally printed paper web, comprising a perforating tool for perforating the paper web and a cutting tool for cutting off print sheets, as well as a counter tool. The cutting tool and the perforating tool comprise a joint tool carrier, which can be moved into two working positions for using the cutting tool or the perforating tool. The tool carrier is connected via a crank drive to the drive axis of a third drive motor. The crank drive converts the rotational movement of the drive motor into a swivel movement of the tool carrier between the two working positions.

DE 73 09 617 U1 teaches a sheet working machine comprising a spur gear mechanism for driving platens of a die-cutting press and a conveying gear, which adapts the rotational speed of link chains.

DE 1 012 497 A teaches a central lubrication system for supplying multiple lubricating points with lubricant. Two ring lines comprising metering valves that are connected in parallel are connected to a lubricant source and acted upon by way of a switching valve actuated by the lubricant pressure. A pressure control valve is connected between the last metering valve and the switching valve and regulates the pressure for switching the switching valve.

A drive for gripper chains of a sheet processing machine is known from DE 1 561 132 B, which comprises a disk cam mechanism.

DE 10 2010 024 778 A1 discloses a sheet cutting machine comprising a deposition and multiple-up separating station. To separate the multiple-ups, an upper tool able to perform stroke movements and a lower tool able to perform stroke movements cooperating therewith are provided. The upper tool and the lower tool are temporarily mechanically connected by means of a coupling device.

DE 1 045 778 B relates to an automatic die cutter for sheet-like material, comprising an infeed point, a working point, two points for removing scrap, and a deposition point. Rods, which lift a stencil of a lower frame of the first point to clear waste and a counter punch of the lower frame of the second point to clear waste by means of connected pivotable levers, are moved by way of eccentrics.

SUMMARY OF THE INVENTION

It is the object of the present invention to devise sheet processing machines and a method for driving at least one tool of a sheet processing machine.

The object is achieved according to the present invention by the provision of the at least one downstream gear mechanism as a disk cam mechanism. The at least one upper stripping tool is coupled to the at least one transmitting element via at least one movement converter.

The advantages to be achieved with the invention consist, in particular, in that the processing machine comprises at least one drive, which is connected to at least one stripping drive shaft via at least one gear mechanism. The at least one stripping drive shaft is configured to drive at least one stripping tool of at least one stripping mechanism of at least one stripping unit of the processing machine and/or at least one multiple-up separating tool of at least one multiple-up separating mechanism of at least one multiple-up separating unit of the processing machine. At least one downstream gear mechanism is advantageously arranged downstream from the at least one gear mechanism. The at least one downstream gear mechanism is advantageously in contact with the at least one stripping drive shaft. The at least one downstream gear mechanism is advantageously coupled to the at least one stripping tool of the at least one stripping unit and/or to the at least one multiple-up separating tool of the at least one multiple-up separating unit. The at least one downstream gear mechanism is advantageously configured to convert at least one rotative movement into at least one reciprocating movement. Advantageously, at least one tool of the processing machine is driven. The at least one downstream gear mechanism, which is arranged downstream from the at least one gear mechanism, advantageously converts at least one rotative movement into at least one reciprocating movement.

The at least one downstream gear mechanism is advantageously configured as a disk cam mechanism. This preferably enables a space-saving and/or simple transmission of torque and/or force. This preferably allows the at least one tool, preferably at least one stripping tool and/or at least one multiple-up separating tool, to be driven at high processing speeds of, for example, at least 5000 (five thousand) sheets per hour, preferably at least 7000 (seven thousand) sheets per hour, more preferably at least 8000 (eight thousand) sheets per hour. The accuracy of processing sheets is preferably increased as a result of the configuration as a disk cam mechanism, preferably since exact scanning of the at least one cam disk becomes possible, and the torque to be transmitted and/or the force to be transmitted are thus preferably set according to the present phase. The wear of the at least one downstream gear mechanism, for example due to abrasion, is preferably minimized as a result of the configuration as a disk cam mechanism. The configuration as a disk cam mechanism is preferably cost-effective.

The at least one stripping tool and the at least one multiple-up separating tool are advantageously coupled via at least one joint transmitting element to the at least one stripping drive shaft. The at least one transmitting element is advantageously configured to carry out at least one reciprocating movement. Advantageously, the at least one stripping tool and the at least one multiple-up separating tool are coupled via at least one joint transmitting element, which is preferably configured as an upper transmitting element, to the at least one drive. In this way, synchronization of the at least one stripping tool with the at least one multiple-up separating tool is advantageously ensured. Additional synchronization of the tools with one another is preferably dispensed with. Movements, in particular the respective processing of sheets, of the individual tools are preferably synchronized with one another as a result of the coupling. The movement of the tools is preferably synchronized in addition to the transport movement of the chain transport system.

The true-to-register processing of the at least one sheet is preferably increased, in particular by the stripping unit and the multiple-up separating unit.

At least one drive system of the processing machine advantageously comprises the at least one drive, the at least one gear mechanism and the at least one downstream gear mechanism. The at least one drive system advantageously has a space-saving configuration as a result of the at least one gear mechanism and the at least one downstream gear mechanism being arranged at the at least one shaping unit. Advantageously, this also enables a compact configuration of the drive train.

The at least one reciprocating movement can advantageously be transmitted to the at least one tool and/or is transmitted to the at least one tool, wherein the at least one tool is configured to move reciprocatingly and/or linearly. The drive system is advantageously configured to only generate mechanical vibrations along a transport direction. The connection of the at least one drive to the at least one tool of the processing machine is advantageously configured to be vibration-damping. The connection of the at least one drive to the at least one tool of the processing machine is advantageously configured to damp mechanical vibrations, at least along a transverse direction. This ensures a smooth and true-to-register processing of sheets.

Advantageously, at least the connection of the at least one downstream gear mechanism to the at least one stripping tool and/or to the at least one multiple-up separating tool is subject to compressive stress. Advantageously, at least one scanning lever permanently rests against at least one cam disk of the downstream gear mechanism. Advantageously, at least one movement of at least one transmitting element is superimposed by a generated force of at least one tensioning element, whereby closing of the at least one stripping tool and/or of the at least one multiple-up separating tool is advantageously facilitated.

The processing machine is advantageously configured as a die-cutting machine, in particular a flat-bed die-cutting machine. The processing machine advantageously comprises at least one central lubricant system. The at least one lubricant system is advantageously configured to conduct at least one lubricant from at least one source of lubricant and/or from at least one reservoir of lubricant to at least two units. Advantageously, lubricant is conducted and/or distributed to a respective lubricating point, in particular within a respective unit, according to the consumption and/or the need at this particular lubricating point by the at least one lubricant system. The at least one central lubricant system increases the economic efficiency of the die-cutting machine. In particular, lubricant can be saved. As a result of the arrangement of the at least one gear mechanism and the at least one downstream gear mechanism, lubrication that is independent of the lubricant system is advantageously only necessary in the region of these gear mechanisms, i.e., at the shaping unit. Advantageously, further gear mechanisms and/or moving components of the at least one drive system and/or of the die-cutting machine which are located outside the at least one housing at least have lubrication by way of lubricants by the at least one lubricant system. The compactness of the die-cutting machine is advantageously increased since, for example, additional housings for lubricating oil baths of individual components of the die-cutting machine are dispensed with. Advantageously, the individual units of the die-cutting machine are thus better accessible, for example for maintenance work and/or repair work.

Advantageously, the processing machine comprises at least one feeder comprising at least one transport means including at least one drive and at least one feeder comprising at least one detection sensor. Advantageously, the sheet processing machine additionally comprises at least one sensor device comprising at least two sensors, which are arranged at an alignment position of sheets.

A flexible and/or rapid response to errors, for example of the sheet guidance along the transport path and/or the sheet position on the transport path, is advantageously ensured at least by advantageously controlling by closed-loop and/or open-loop control the at least one transport means, in particular as a function of at least one signal of the at least one detection sensor.

In particular, position errors of sheets in the feeder can arise, for example when at least one sheet of a feeder pile is displaced in relation to the further sheets and/or when the feeder pile is arranged in a position that differs from the preferred position for the processing machine. Advantageously, at least a rough alignment and/or at least a fine alignment of sheets in the infeed, correcting potential position errors of sheets 02, is provided for. If, in an advantageous embodiment, the processing machine comprises the at least one detection sensor and the at least one sensor device, the respective sheet can advantageously be roughly aligned at least according to the transport direction as a function of the detection by the at least one detection sensor and, after this rough alignment has been carried out, can be finely aligned as a function of the detection by the at least two sensors of the sensor device. Advantageously, a rough alignment of the relevant sheet with respect to its skewed position or position orthogonal to the transport direction is carried out upon its arrival at the alignment position. In this way, the complexity of the fine alignment is advantageously decreased by the additional rough alignment in front of the alignment position.

As a result of an advantageous alignment of sheets by the at least one transport means, at least according to the transport direction, an arrival time of the relevant sheet at an alignment position which corresponds to a target value of the arrival time is advantageously ensured. Advantageously, a complete alignment of the respective sheet with respect to its location and/or position can be carried out on the transport path in the time available for this purpose. In particular, a complete alignment of the respective sheet with respect to its location and/or position can be carried out on the transport path in the time available for this purpose, without interrupting or halting the processing machine.

Advantageously, feeding a respective, preferably at least one, sheet in a positionally accurate manner from an infeed unit to at least one unit processing the sheet is ensured by at least one infeed system. Advantageously, a sheet, preferably the at least one sheet, is aligned upstream of a transfer position, and is transferred in the transfer position by the at least one infeed system in an aligned manner to at least one downstream transport system.

Positioning the, preferably at least one, sheet in an alignment position, in particular on at least two front lay marks, advantageously reduces and/or minimizes a position error of the sheet. The, preferably at least one, sheet is thus rough aligned, in particular with respect to its position relative to at least one transport means, preferably at least one gripper, of the at least one infeed system. In this way, the respective, preferably the at least one, sheet is advantageously held by the at least one transport means in a print-free region of the sheet, in particular subsequent to having been positioned, whereby the impact on a potentially present print image and/or the surface of the sheet is minimized while the sheet is being held and/or transported by the at least one transport means.

The sheet is advantageously transported from the alignment position to a transfer position by at least one movement of the at least one transport means along a transport path of sheets, in particular by at least one cam mechanism of the infeed system, more preferably by at least one dual cam mechanism of the infeed system. The at least one cam mechanism is advantageously connected to at least one drive shaft, which is driven by an in particular central drive of the sheet processing machine.

Advantageously, the at least one drive shaft and at least one holding element of a transport system downstream from the at least one transport means are preferably driven by way of the in particular central drive of the sheet processing machine and/or are mechanically connected to one another, whereby the at least one transport means and the at least one holding element, downstream therefrom, of the transport system are in particular synchronized and/or can be synchronized in terms of time. As a result of the at least one transport means and the at least one holding element, downstream therefrom, of the transport system being in particular synchronized in terms of time, a collision of the relevant components during a movement of the at least one transport means and/or of the at least one holding element of the transport system, in particular due to, for example, electrical malfunctions, with one another is prevented.

The, preferably at least one, sheet is advantageously finely aligned while it is transported from the alignment position to the transfer position The fine alignment is advantageously carried out at least with respect to a position error of the sheet, preferably at least with respect to a position error of the sheet in a transport direction of sheets and/or with respect to a skewed position of the sheet and/or with respect to a lateral position error, in particular in the event of a displacement of the sheet orthogonal to the transport direction of sheets.

The infeed system advantageously comprises at least two cam mechanisms, which are arranged parallel to one another in the transport direction, on at least one, preferably joint, drive shaft. At least one servo drive is preferably assigned to each cam mechanism of the infeed system. Advantageously, at least one servo drive is activated and/or controlled by closed-loop control at least for compensating for a skewed position of the sheet. Advantageously, at least two servo drives are additionally activated and/or controlled by closed-loop control at least for compensating for a position error in the transport direction.

Further advantages are apparent from the following description.

BRIEF DESCRIPTION OF THE DRAWINGS

Exemplary embodiments of the invention are illustrated in the set of drawings and will be described in greater detail below.

The drawings show.

DESCRIPTION OF PREFERRED EMBODIMENTS

Figure 1:
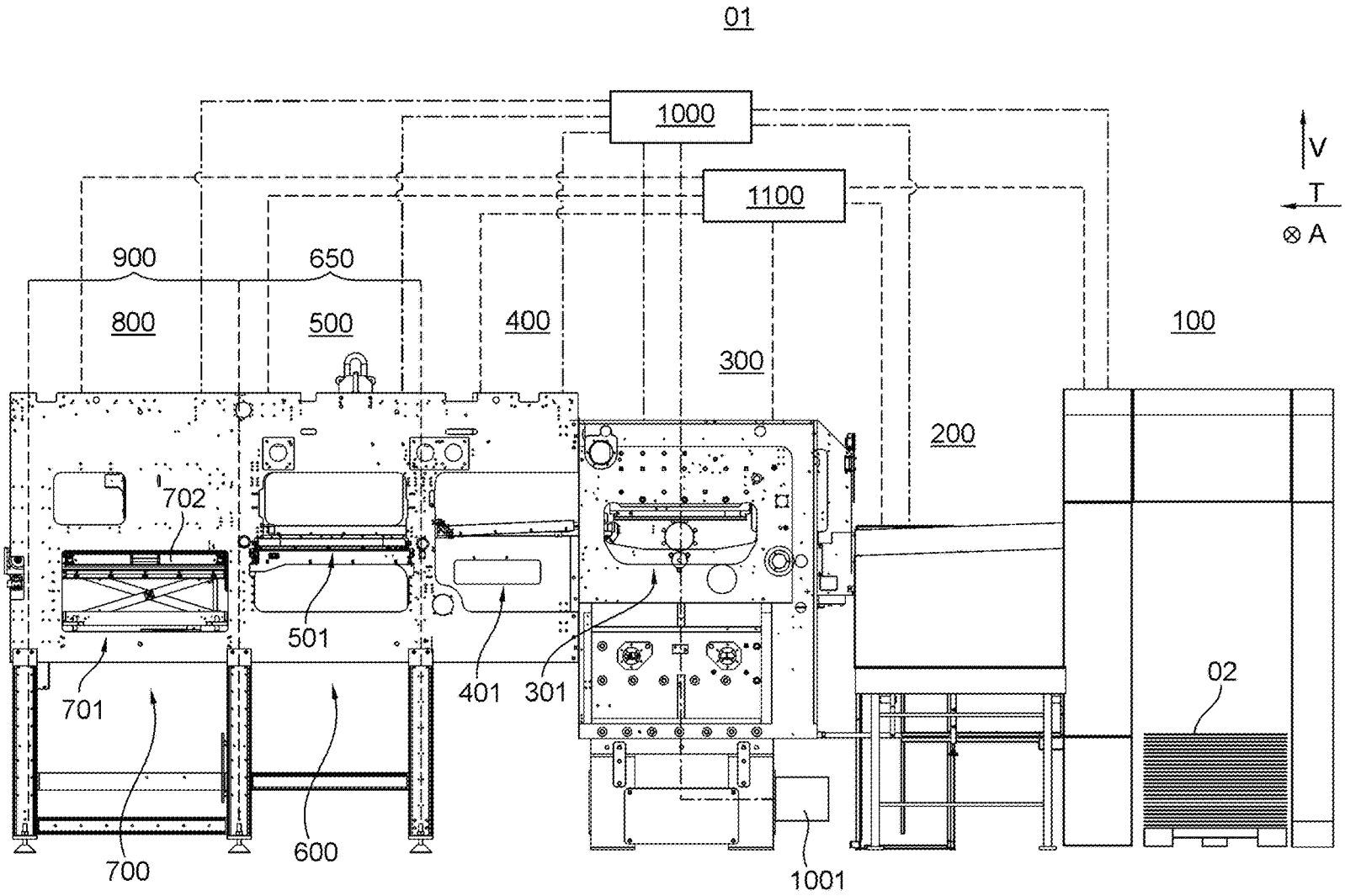
FIG. 1 a schematic illustration of a sheet processing machine.
Figure 2:
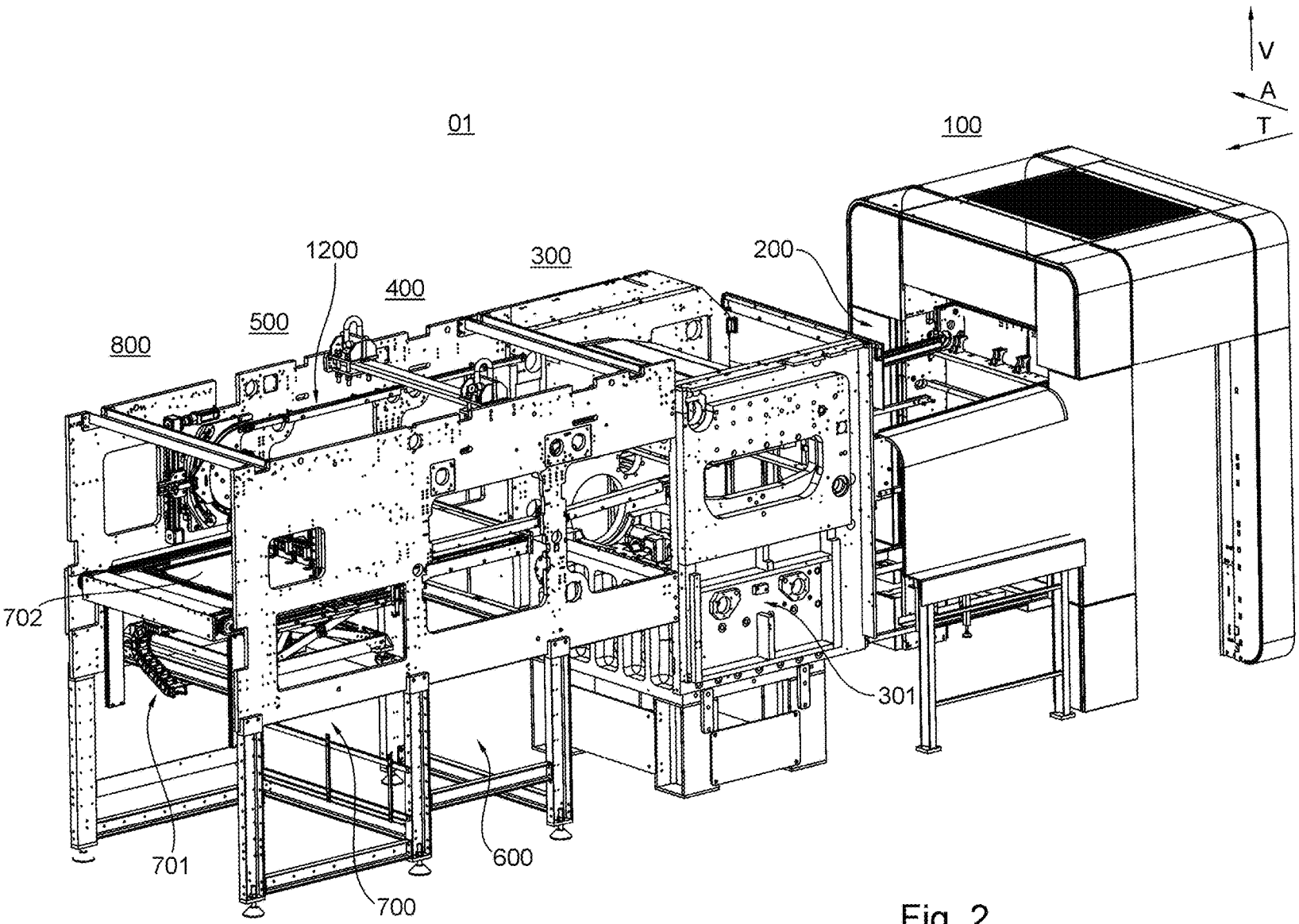
FIG. 2 a schematic perspective illustration of a sheet processing machine.
Figure 3:
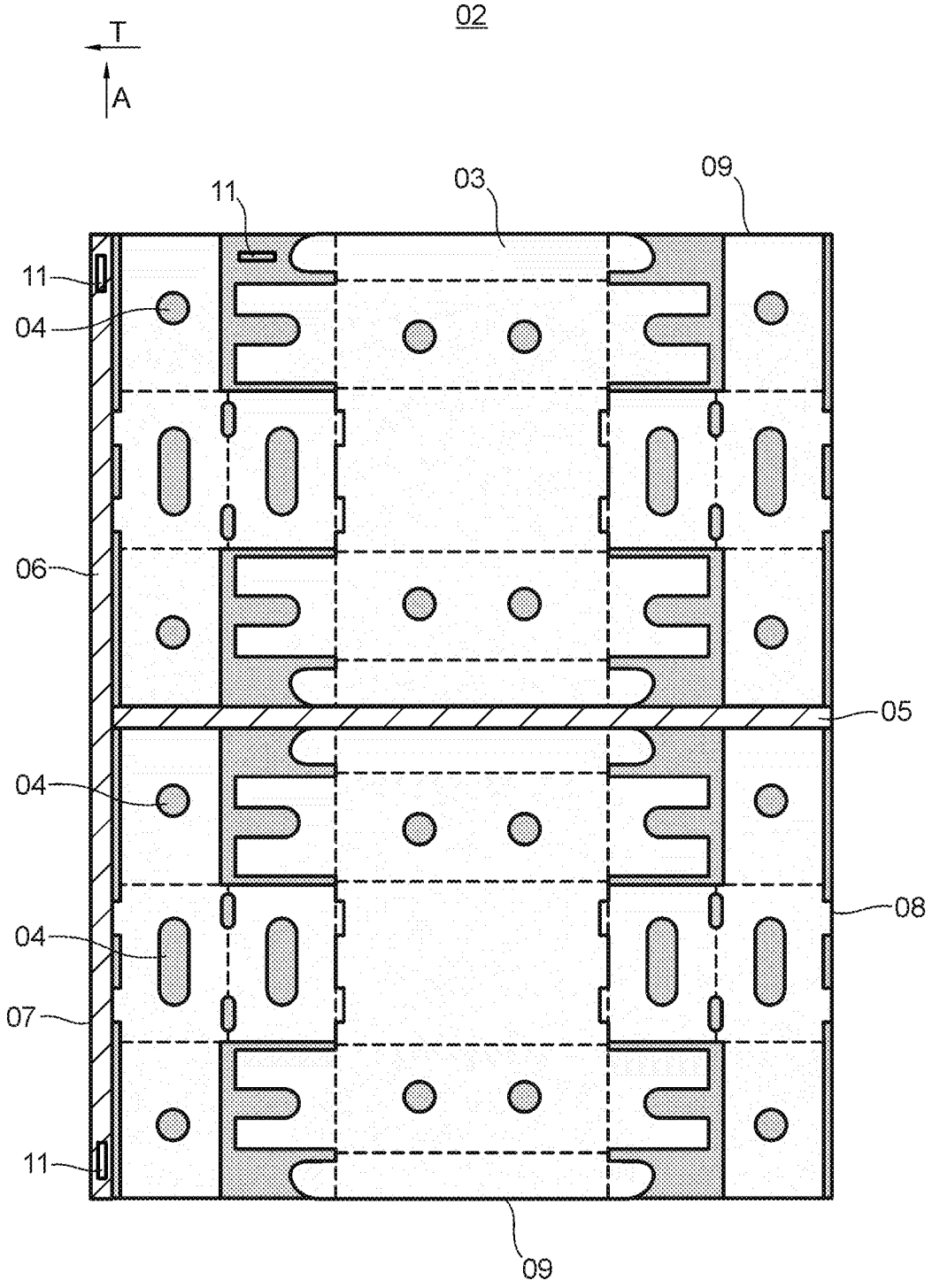
FIG. 3 a schematic illustration of a sheet including several multiple-up copies.
Figure 4:
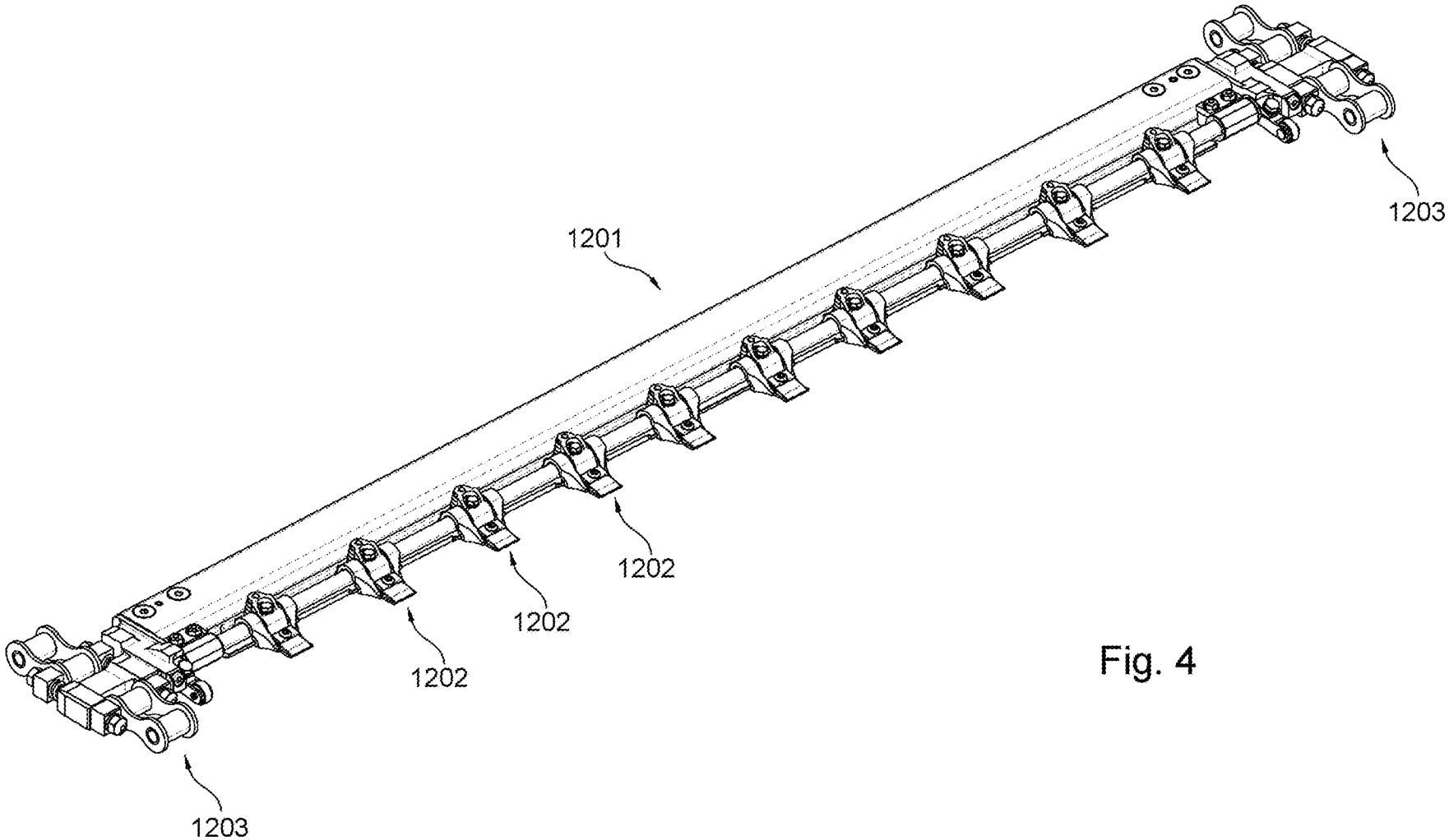
FIG. 4 a perspective illustration of an exemplary gripper carriage of a chain transport system.
Figure 5:
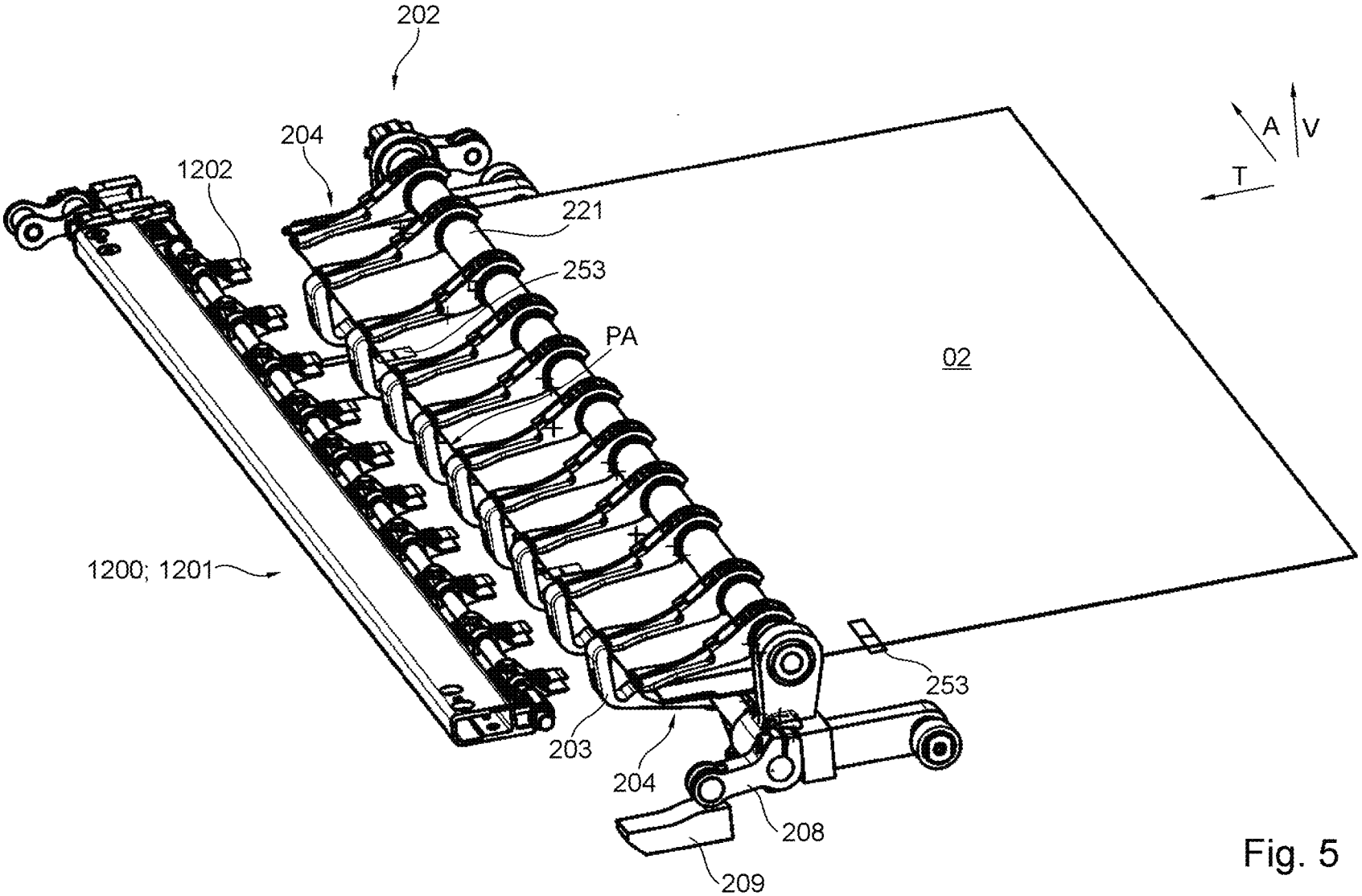
FIG. 5 a perspective illustration of a possible embodiment of a portion of the infeed system and of a portion of the downstream transport system in the transport direction, including a sheet arranged in the alignment position.
Figure 6:
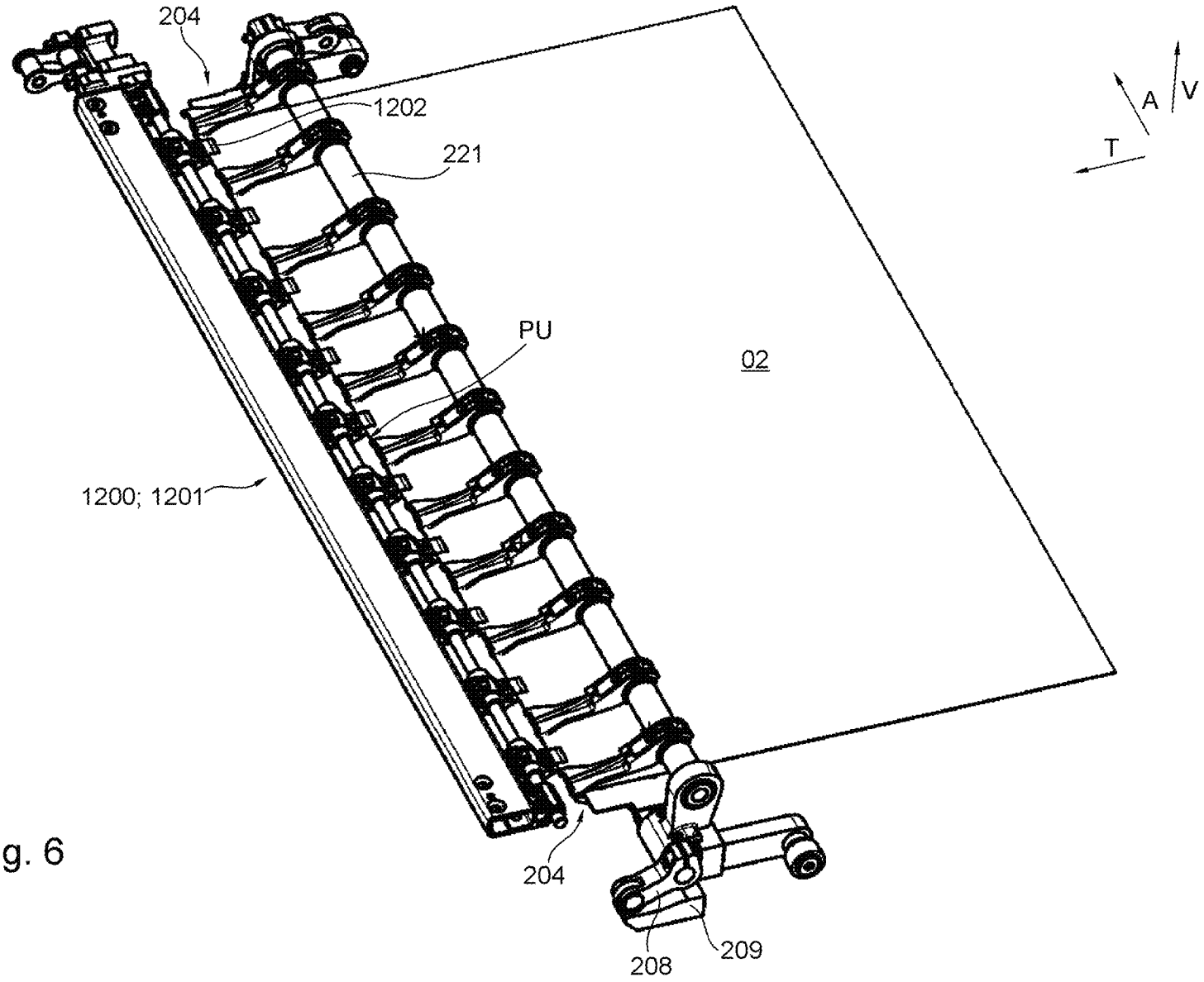
FIG. 6 a perspective illustration of a possible embodiment of a portion of the infeed system and of a portion of the downstream transport system in the transport direction, including a sheet arranged in the transfer position.
Figure 7:
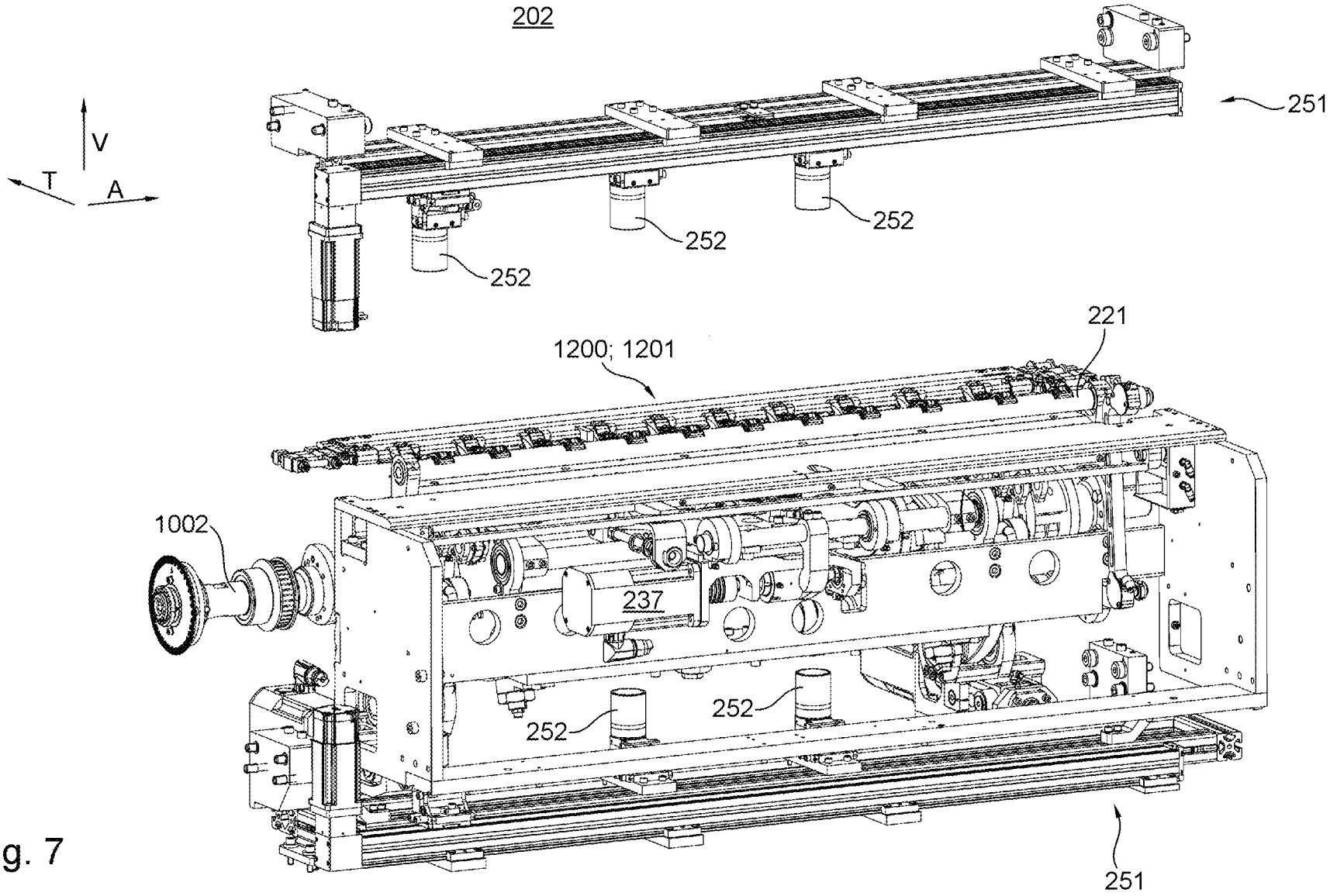
FIG. 7 a perspective illustration of a possible embodiment of the infeed system comprising two sensor devices.
Figure 8:
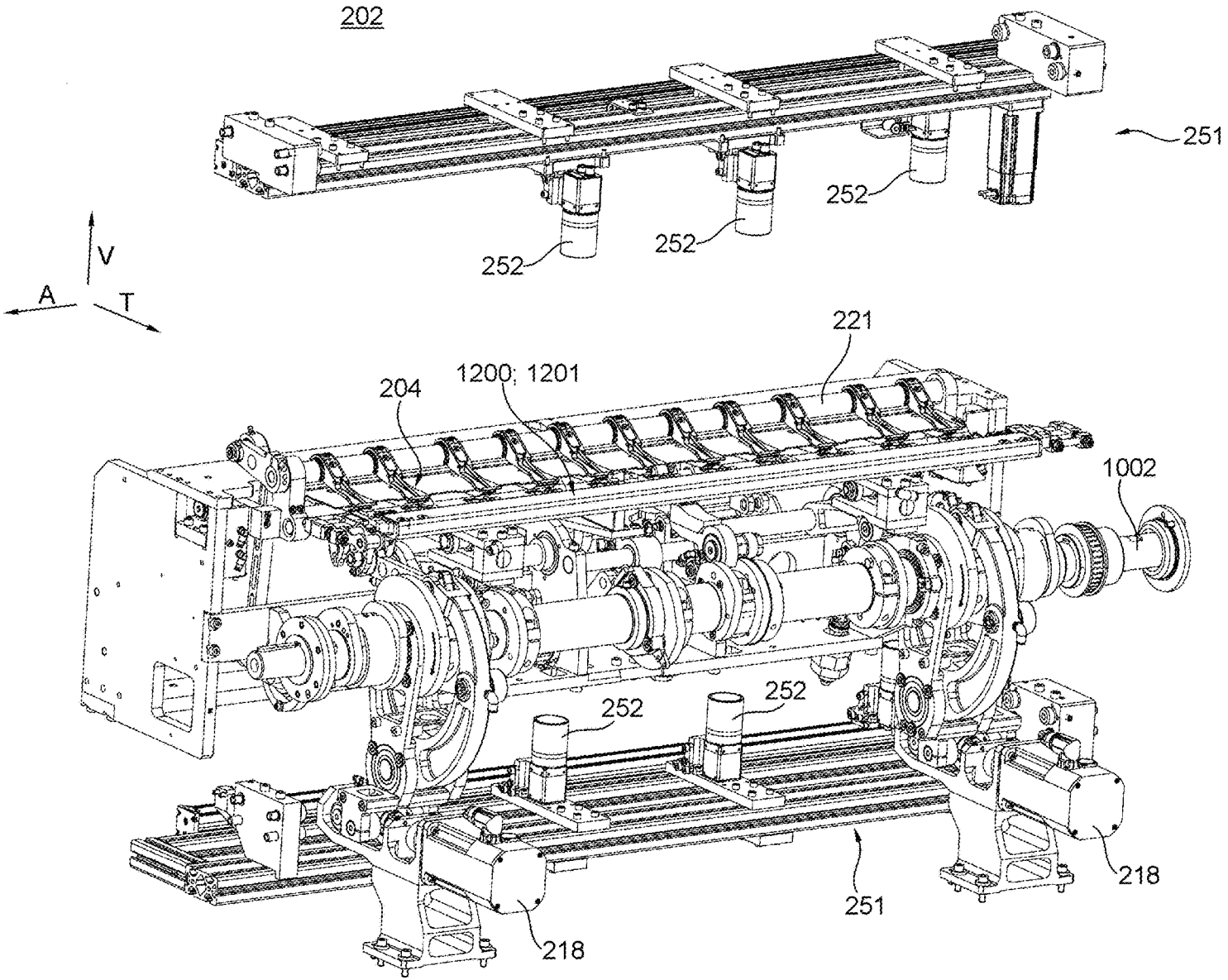
FIG. 8 another perspective illustration of the embodiment from FIG. 7.
Figure 9:
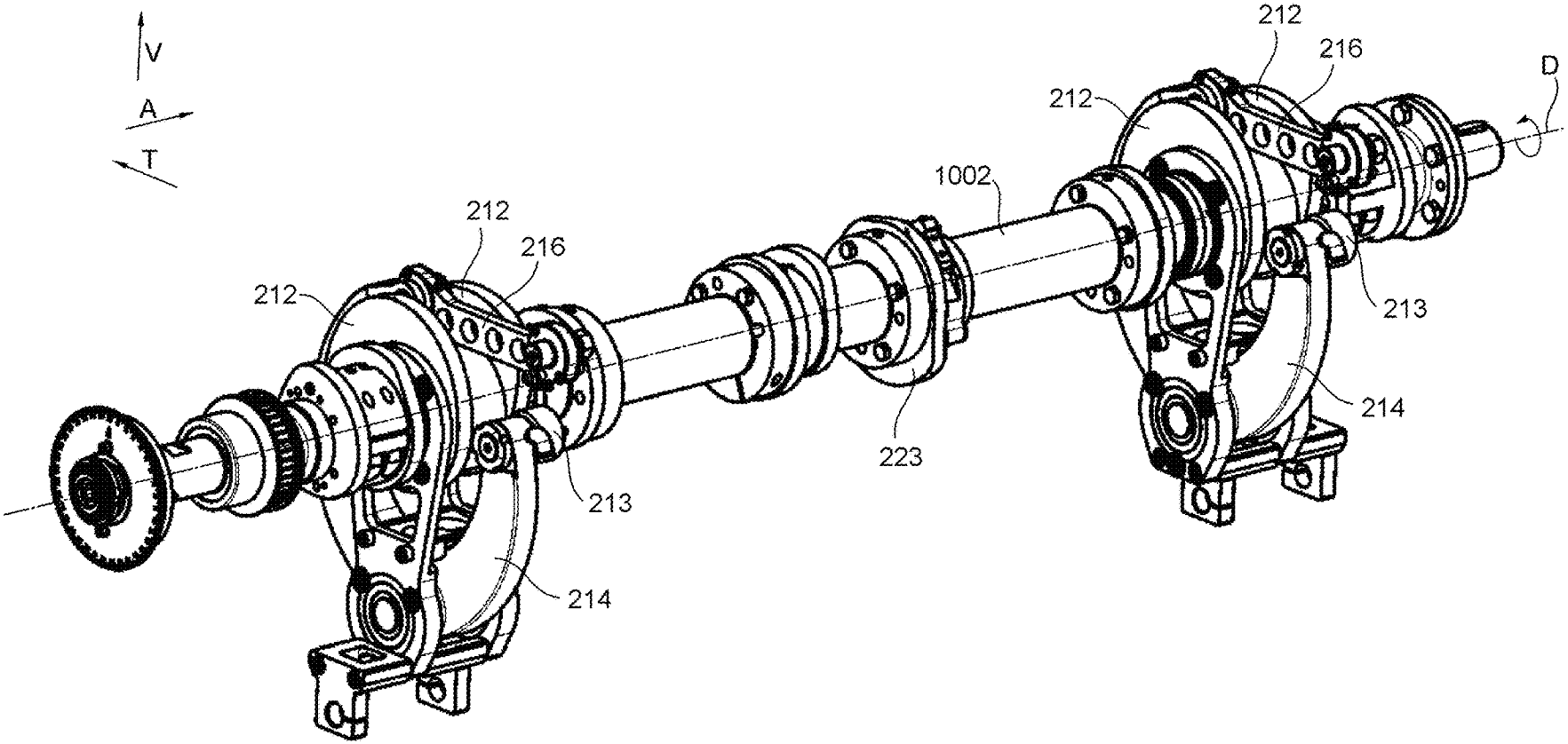
FIG. 9 a perspective illustration of a possible embodiment of a drive shaft comprising multiple cam disks.
Figure 10:
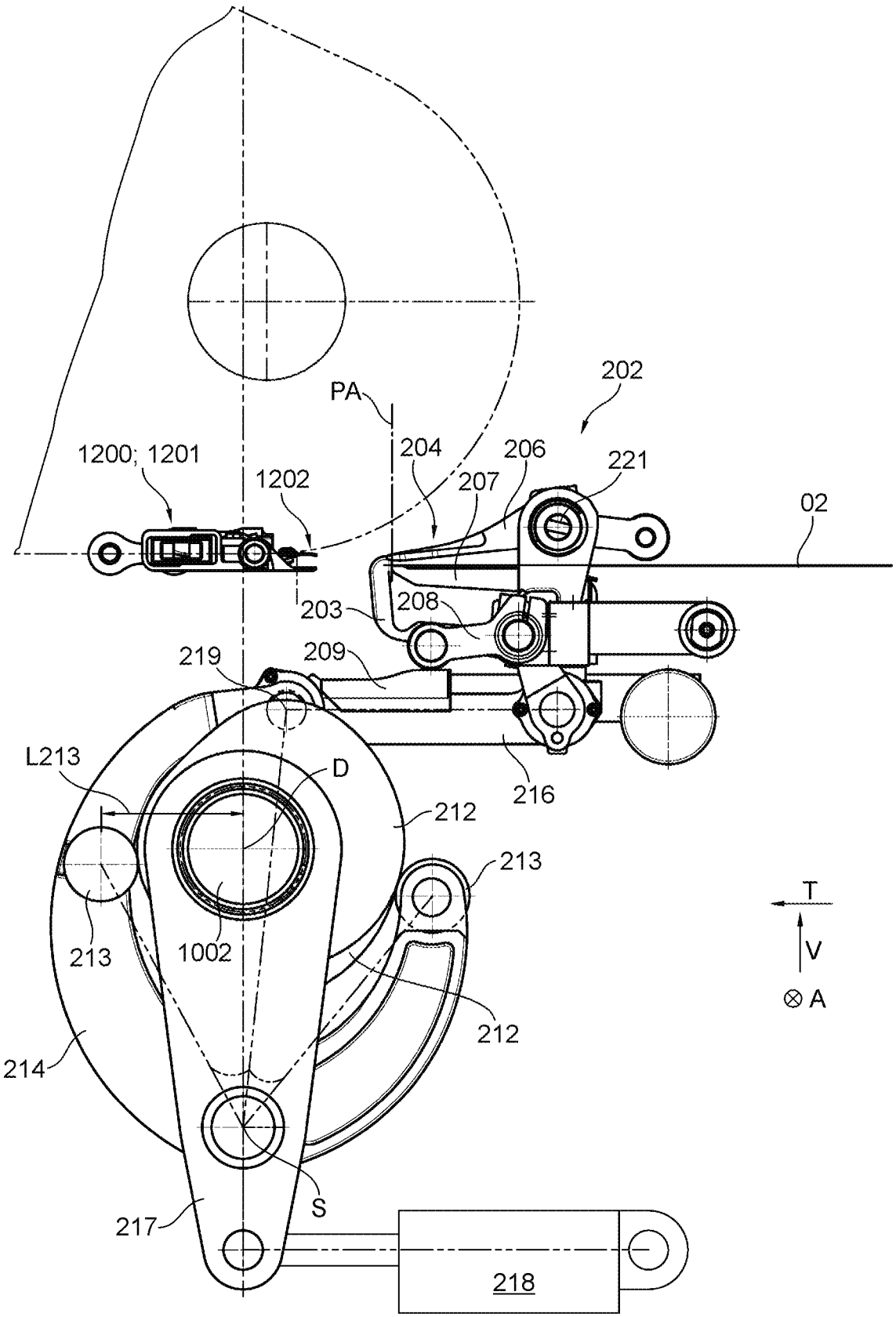
FIG. 10 a schematic infeed system comprising a cam mechanism assigned to the transport movement, and a transport means arranged in the alignment position.
Figure 11:
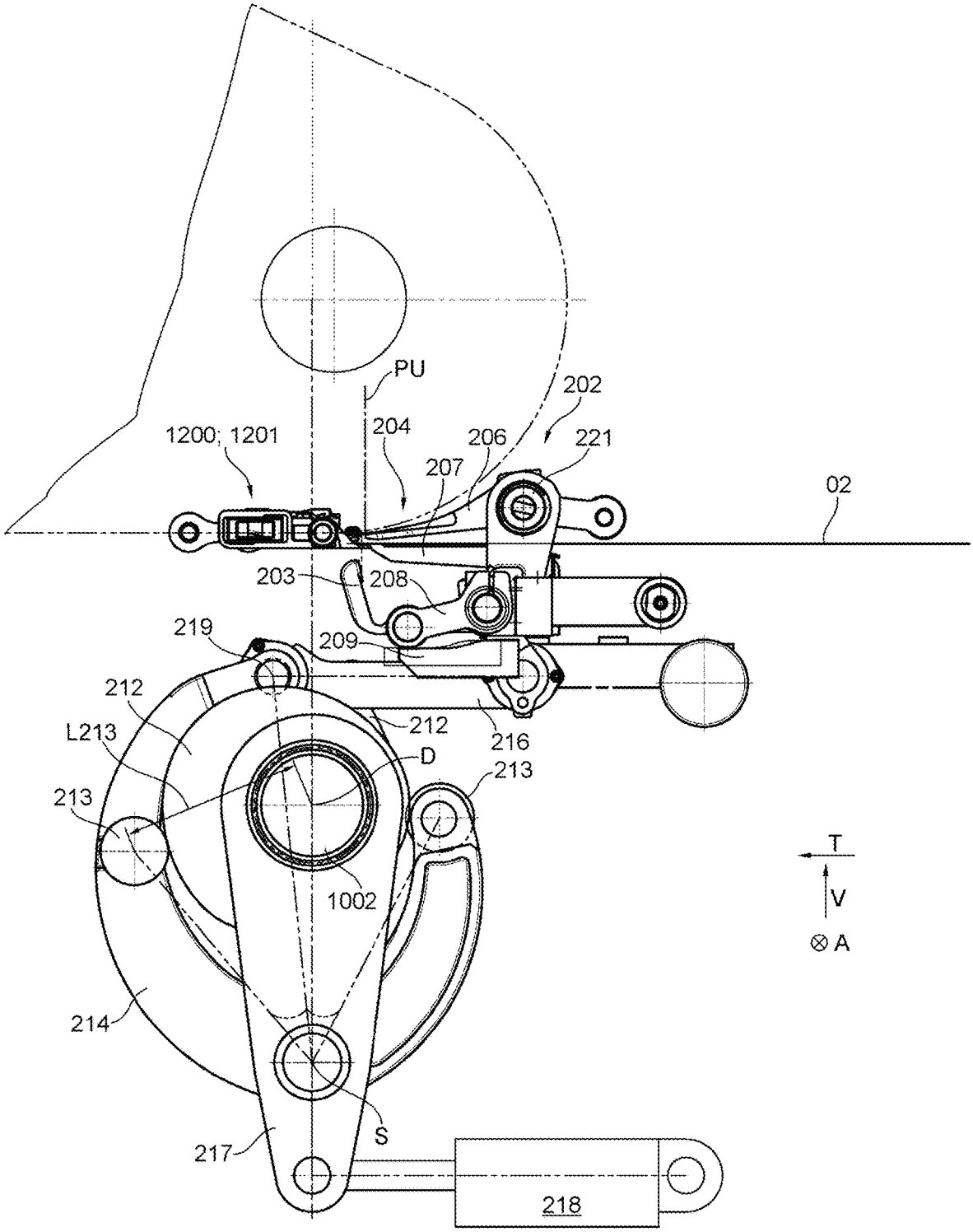
FIG. 11 a schematic infeed system comprising a cam mechanism assigned to the transport movement, and a transport means arranged in the transfer position.
Figure 12:
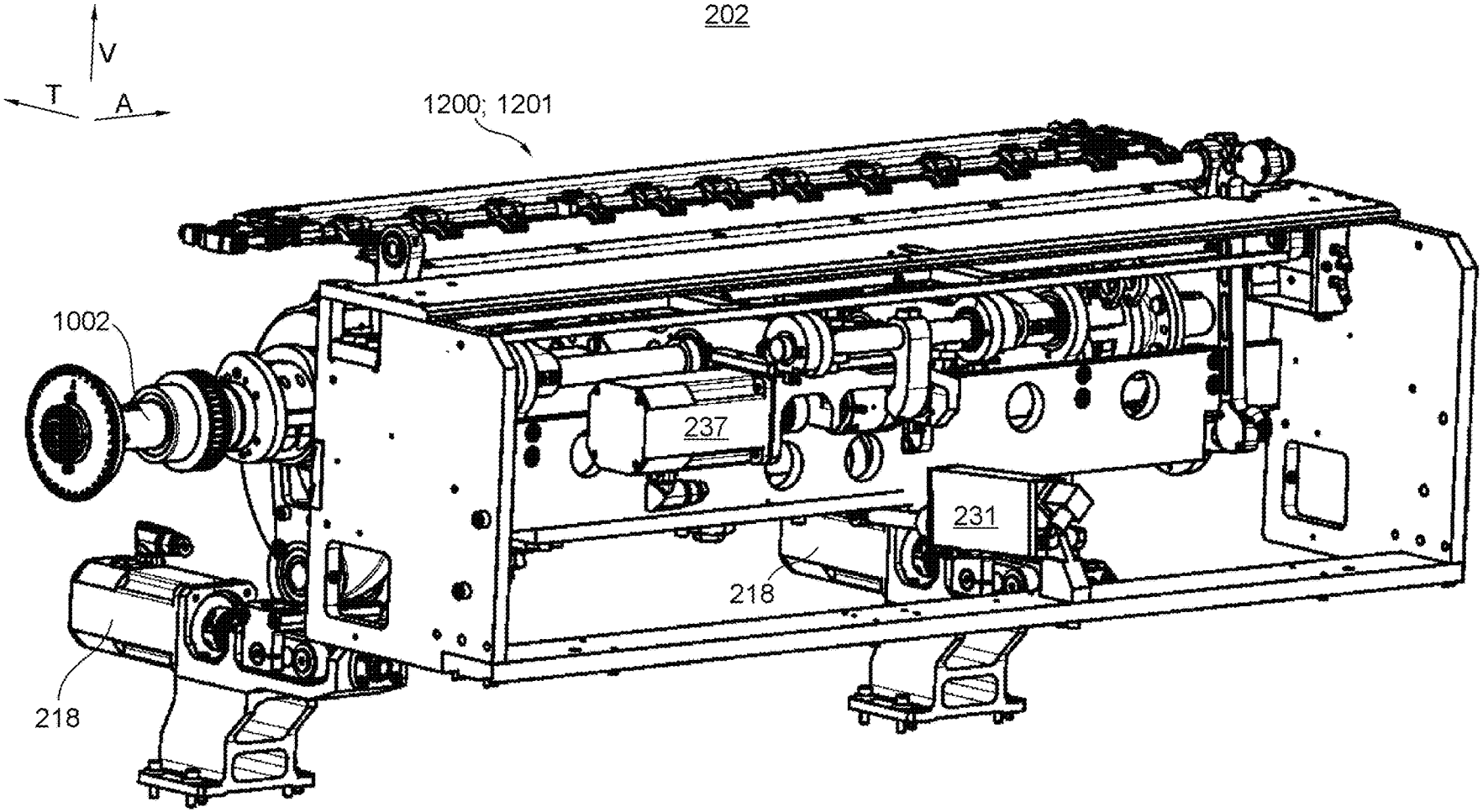
FIG. 12 a perspective illustration of a possible embodiment of an infeed system comprising multiple servo drives.
Figure 13:
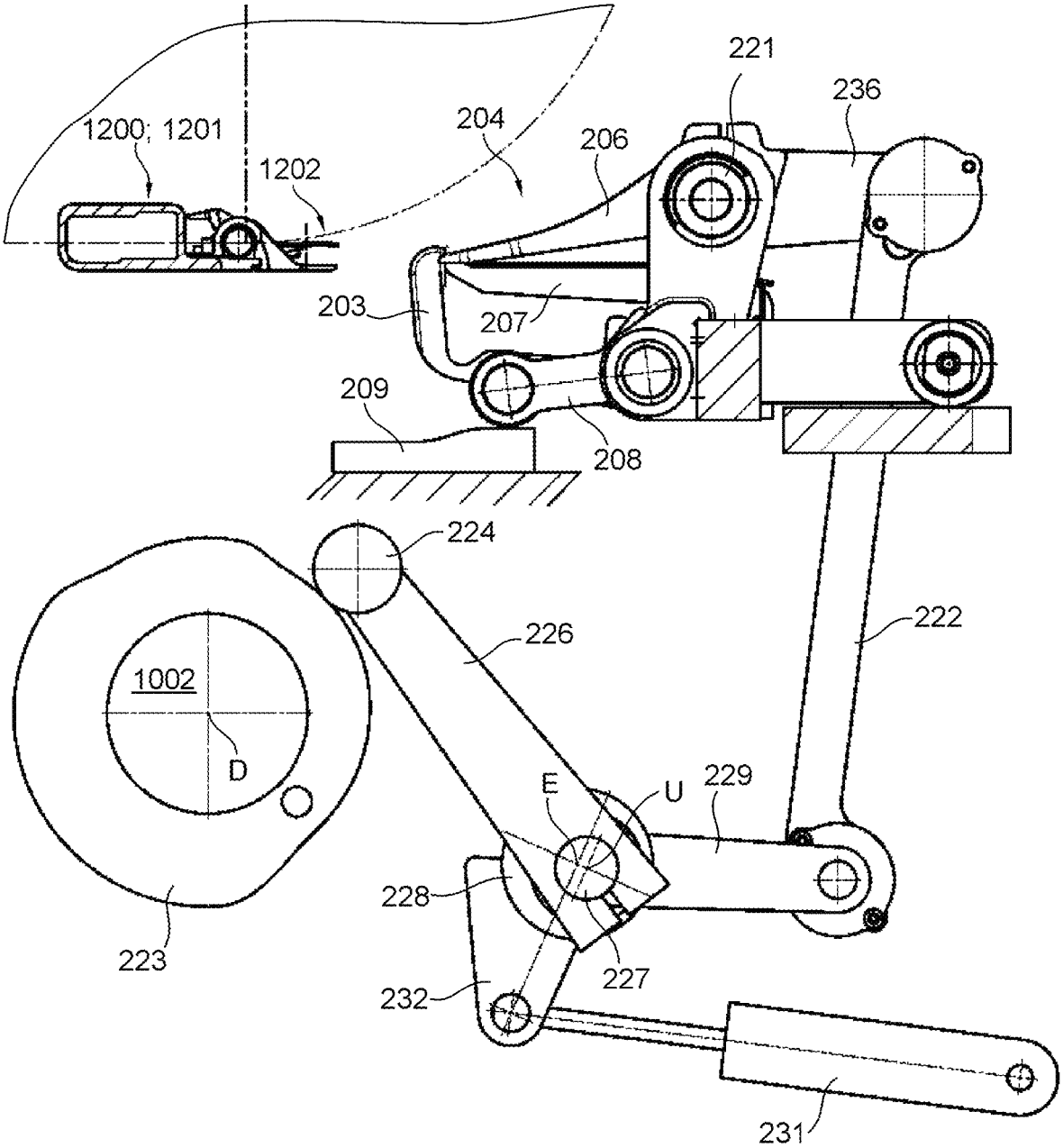
FIG. 13 a schematic illustration of an infeed system comprising a cam mechanism having a minimal distance of the holding surfaces of the at least one holder with respect to one another.
Figure 14:
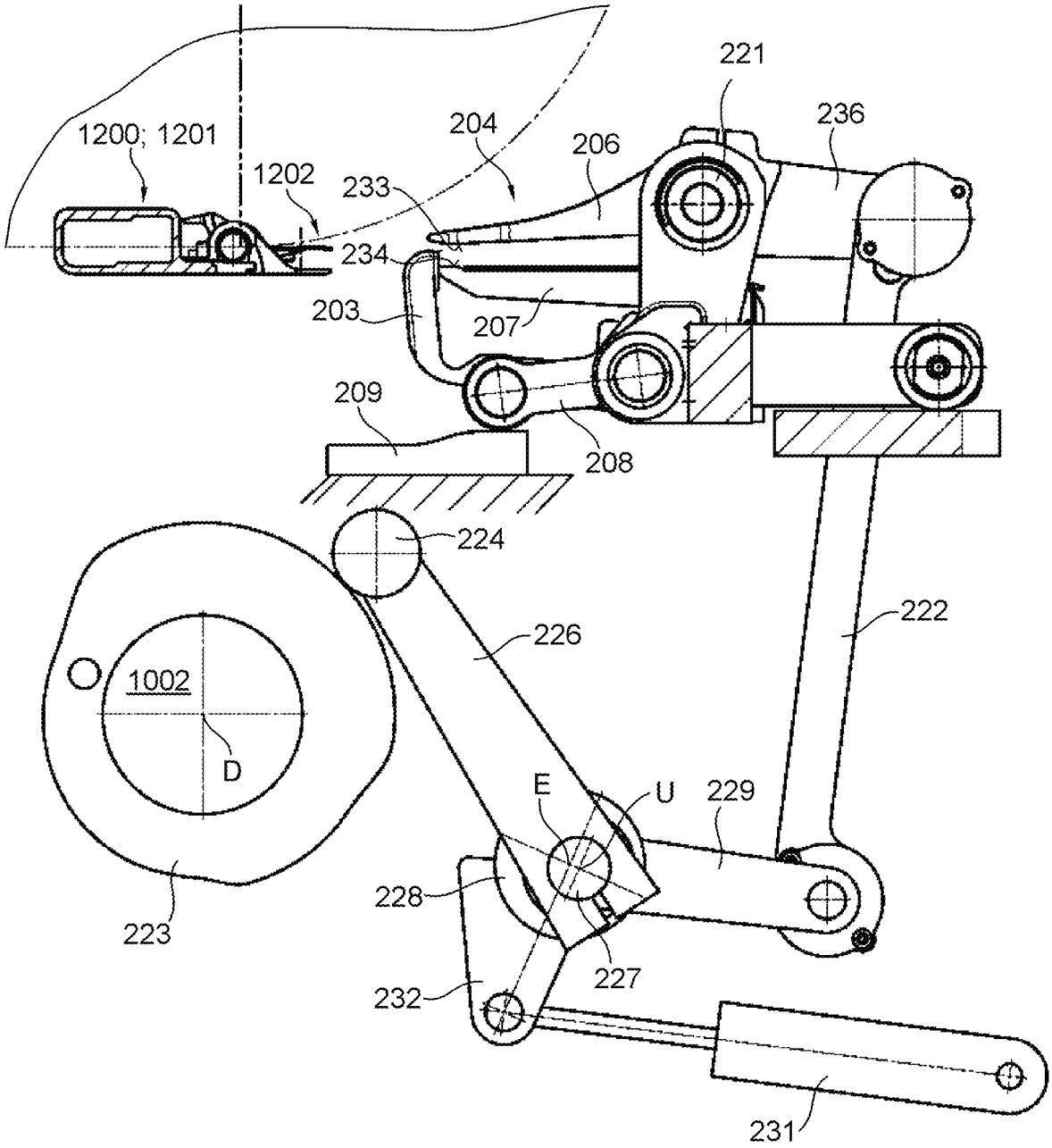
FIG. 14 a schematic illustration of an infeed system comprising a cam mechanism having a maximal distance of the holding surfaces of the at least one holder with respect to one another.
Figure 15:
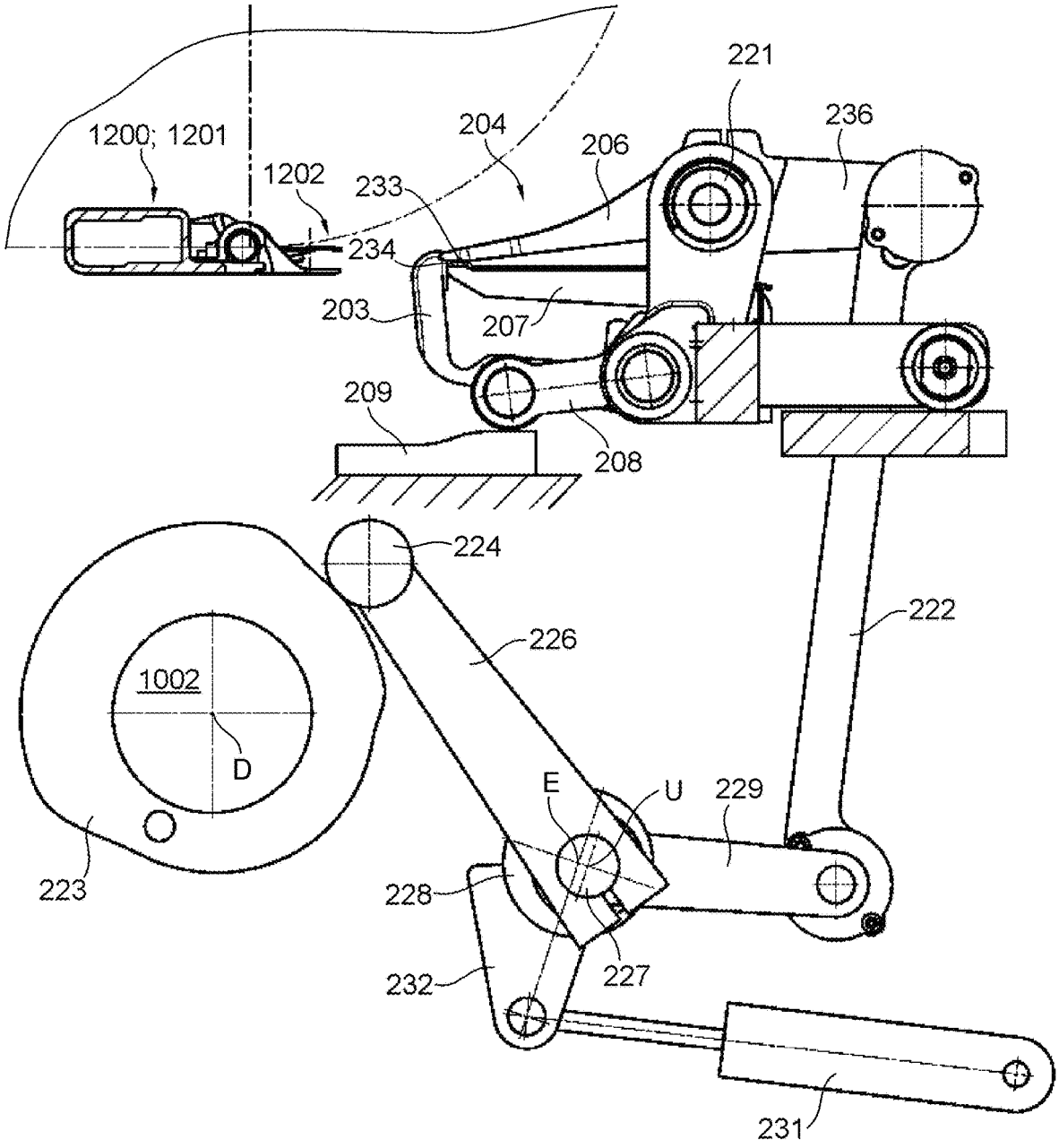
FIG. 15 a schematic illustration of an infeed system comprising a cam mechanism having an average distance of the holding surfaces of the at least one holder with respect to one another for a first thickness of sheets in the vertical direction.
Figure 16:
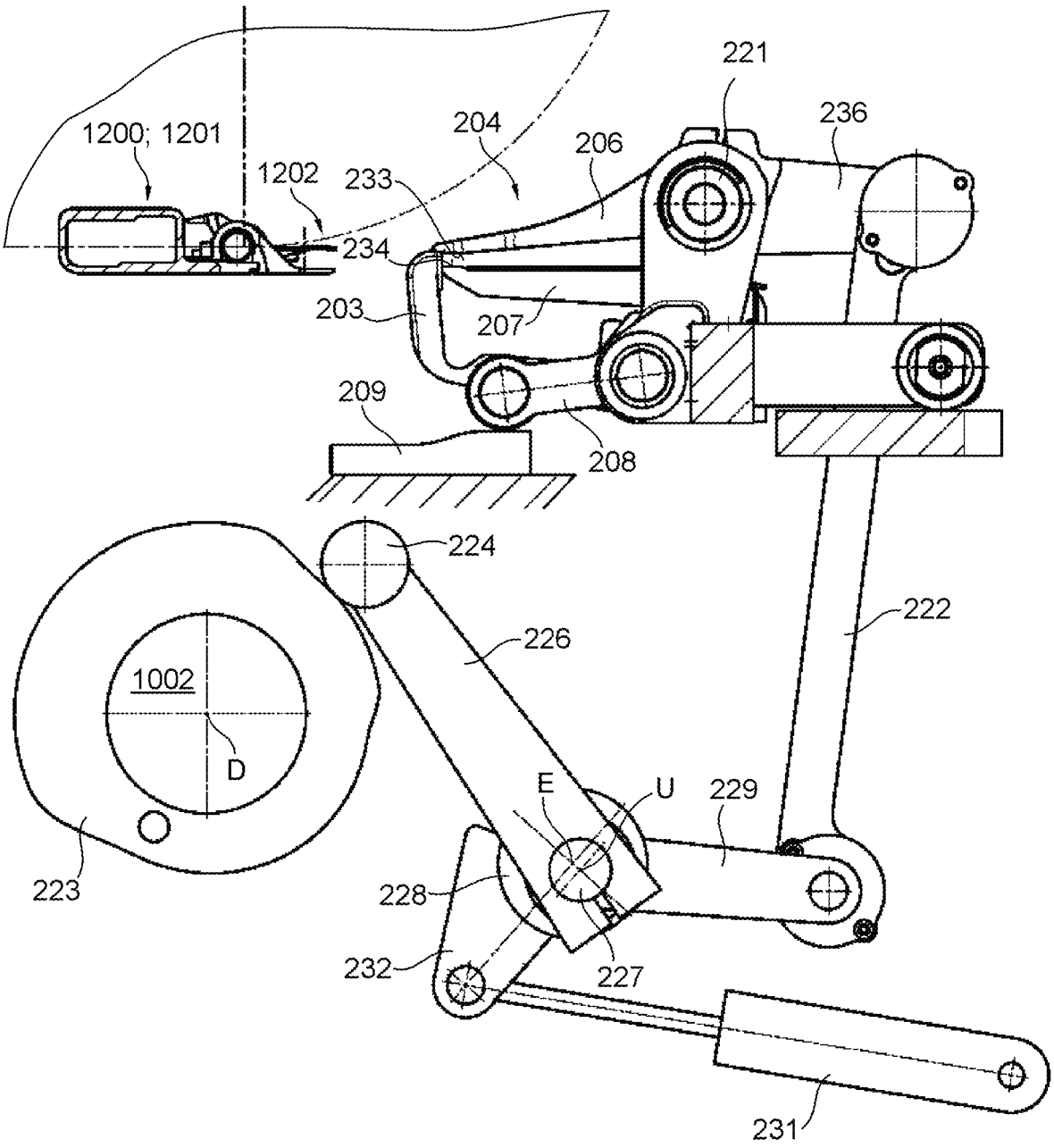
FIG. 16 a schematic illustration of an infeed system comprising a cam mechanism having an average distance of the holding surfaces of the at least one holder with respect to one another for a second thickness of sheets in the vertical direction.
Figure 17:
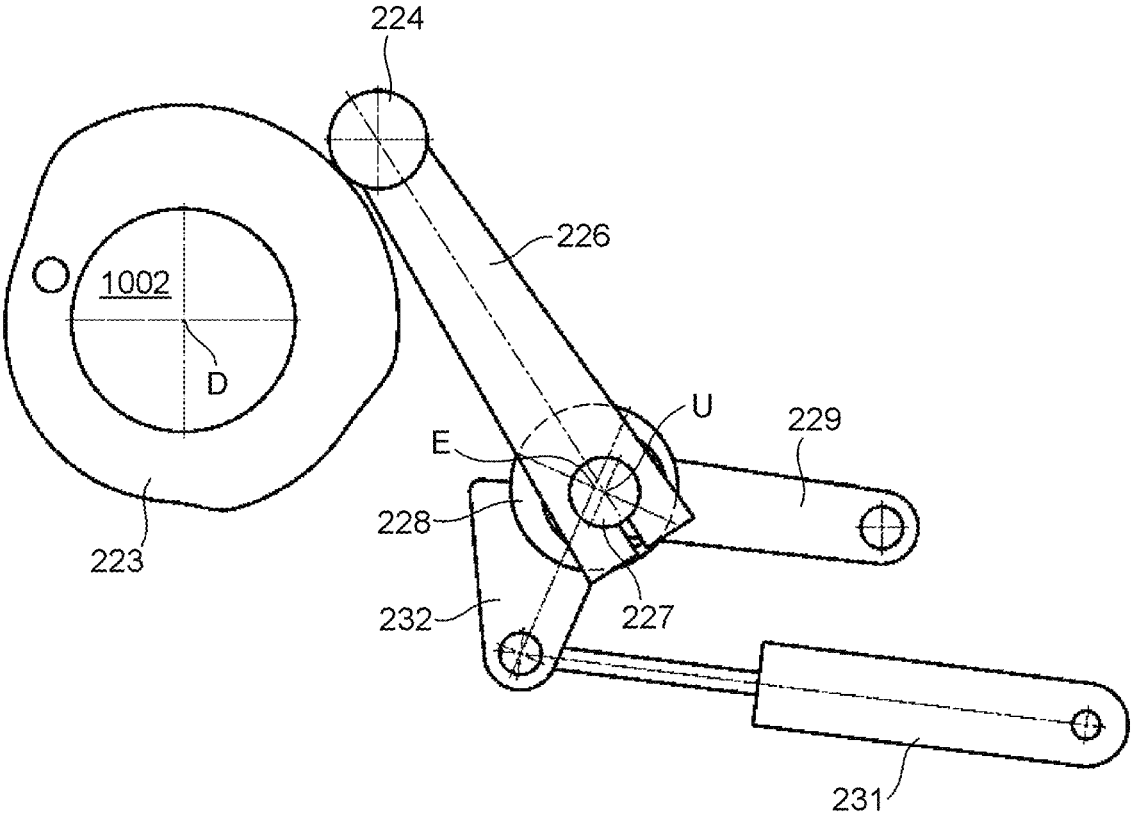
FIG. 17 a schematic illustration of an adjusting shaft comprising a transmission shaft eccentrically arranged therein.
Figure 18:
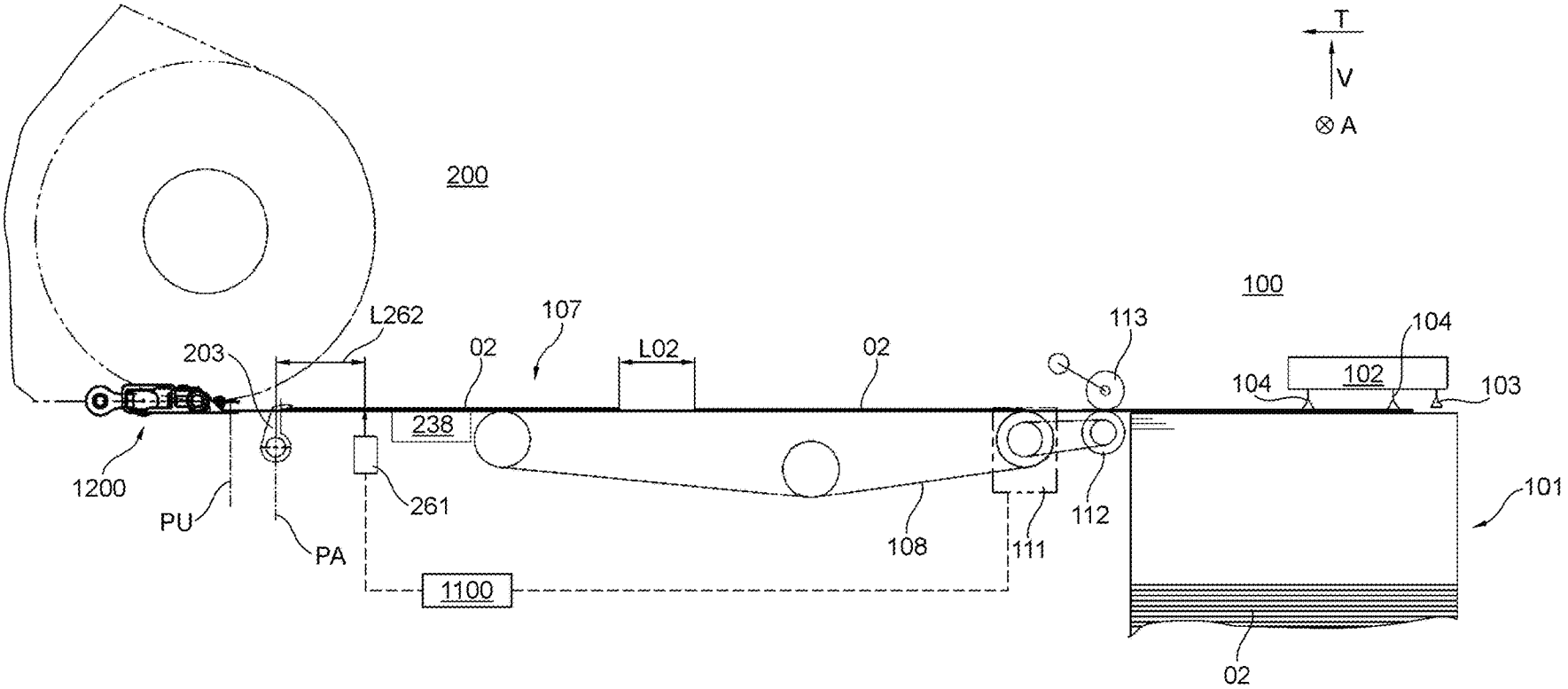
FIG. 18 a schematic illustration of a feeder unit and of an infeed unit.
Figure 19:
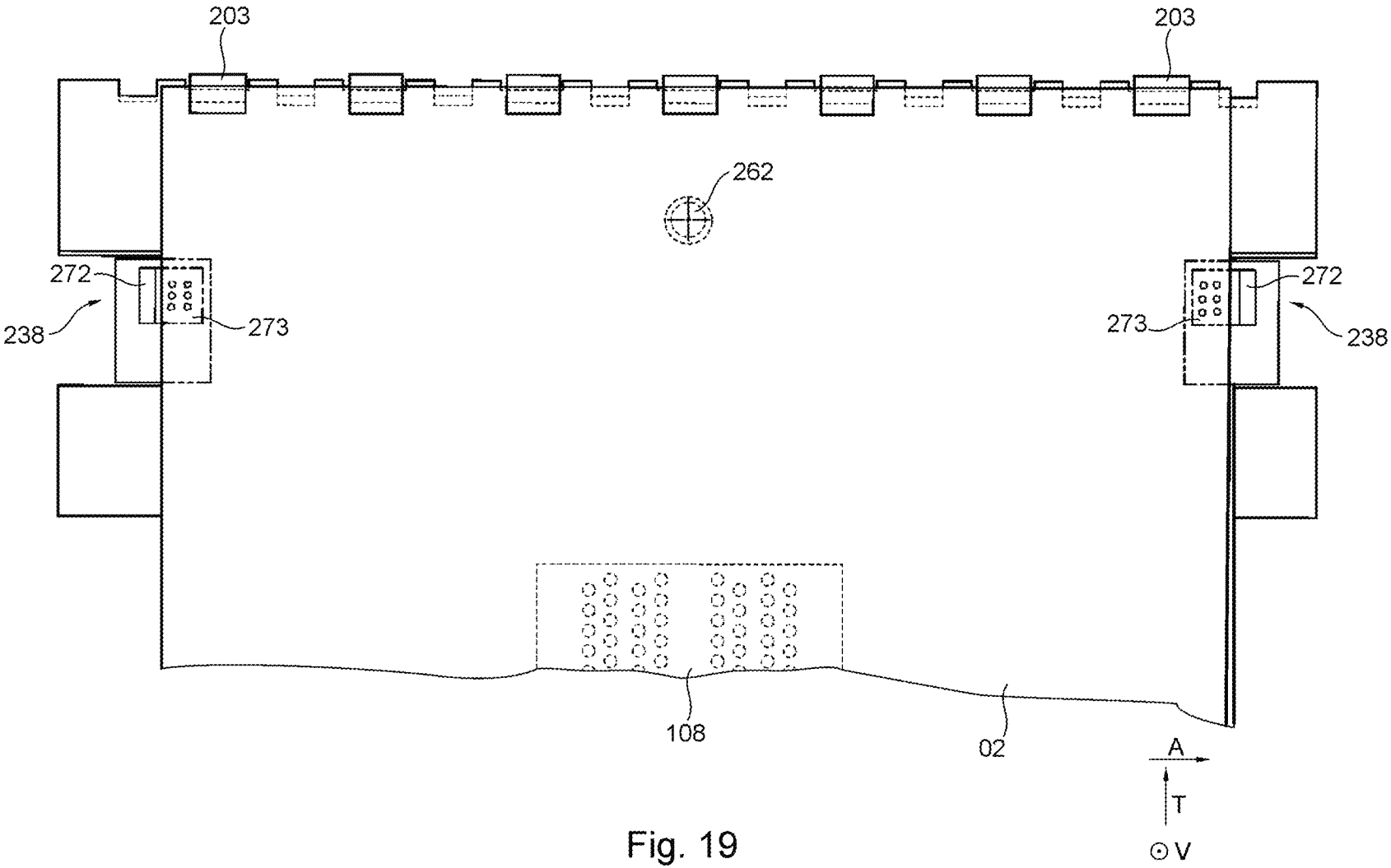
FIG. 19 a schematic illustration of a portion of an infeed unit in a top view.
Figure 20:
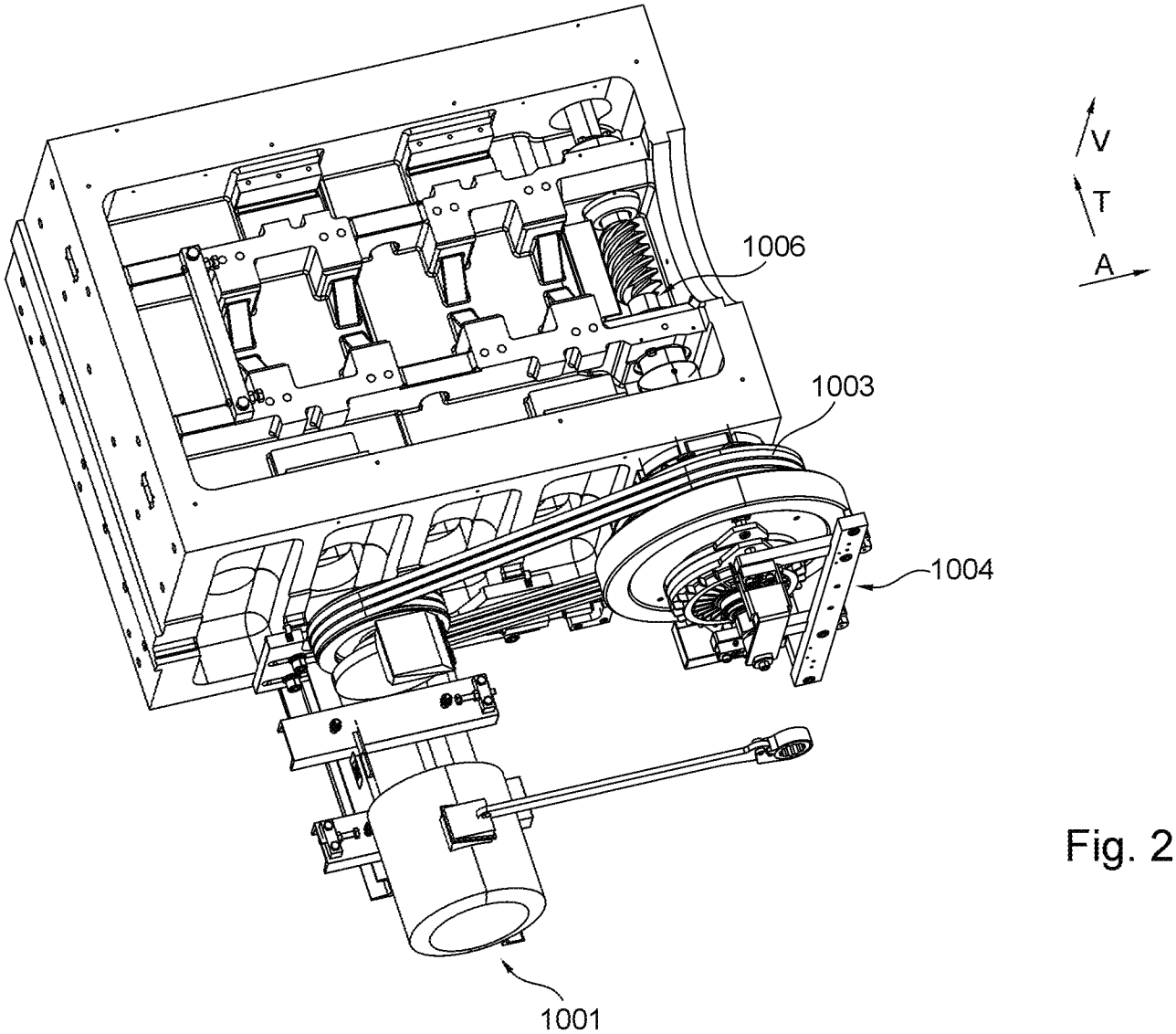
FIG. 20 a perspective illustration of a drive of the processing machine.
Figure 21:
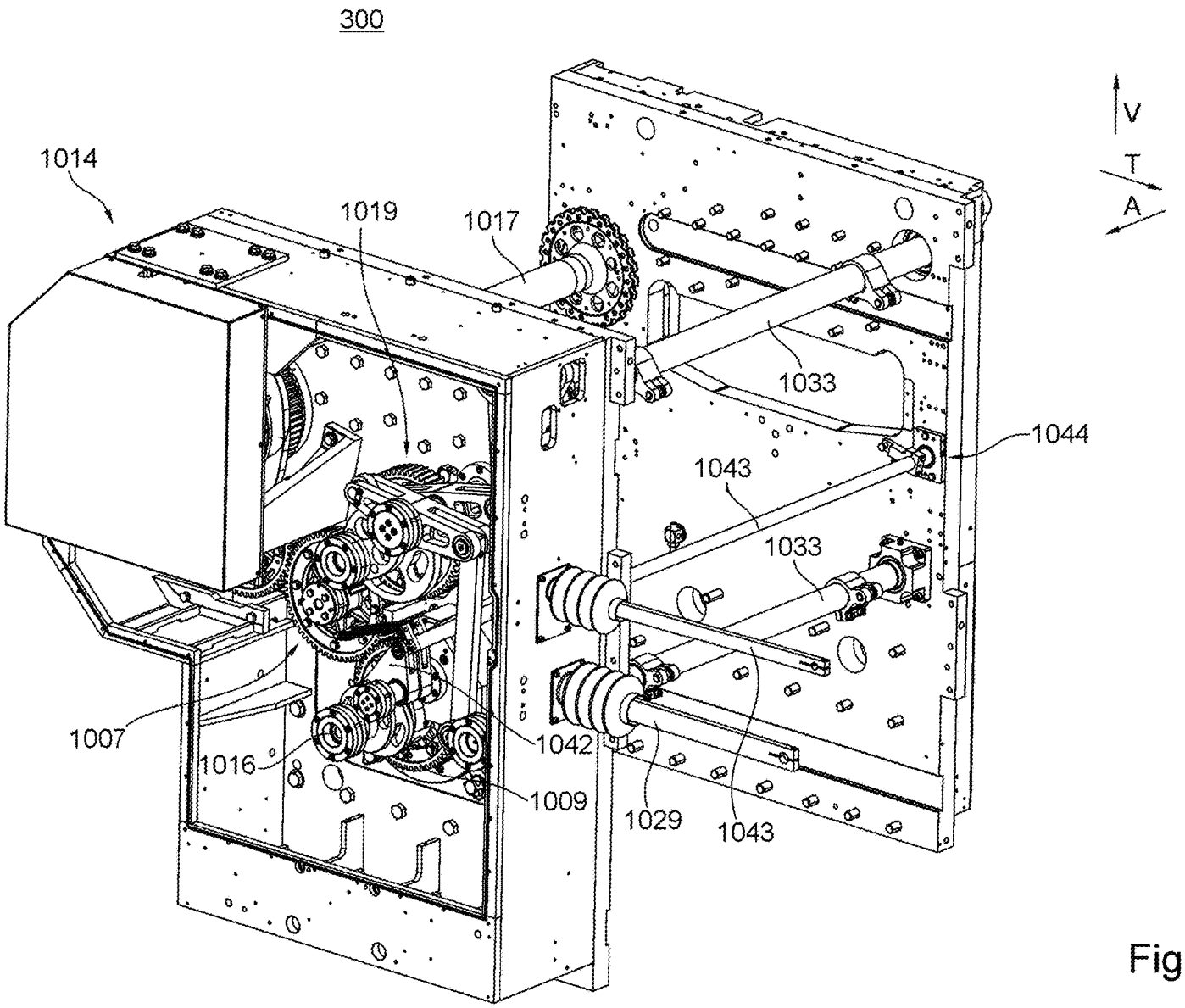
FIG. 21 a perspective illustration of a drive gear mechanism arranged at a shaping unit.
Figure 22:
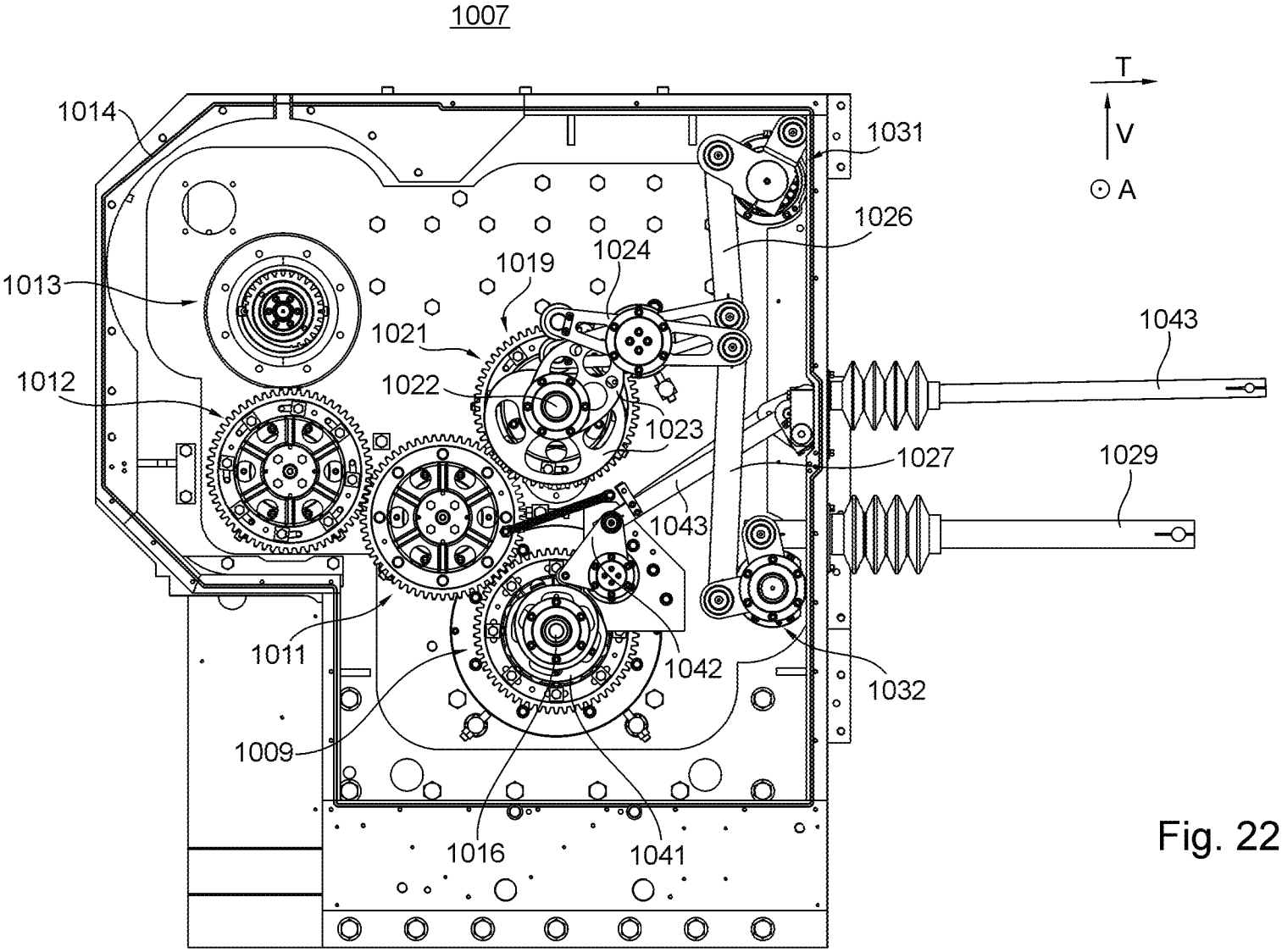
FIG. 22 an illustration of a drive gear mechanism.
Figure 23:
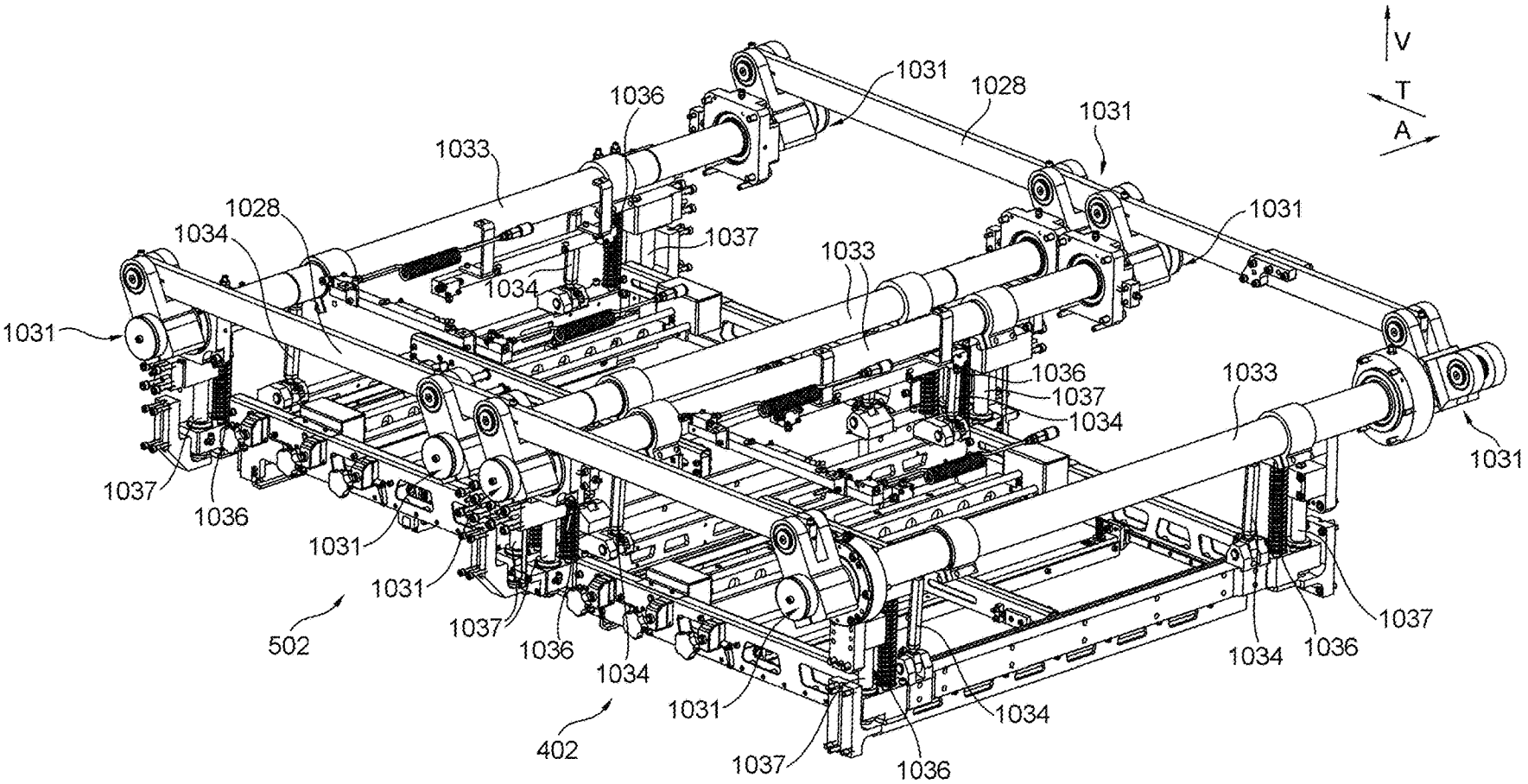
FIG. 23 a perspective illustration of a connection of an upper stripping tool and an upper multiple-up separating tool to a driving gear.
Figure 24:
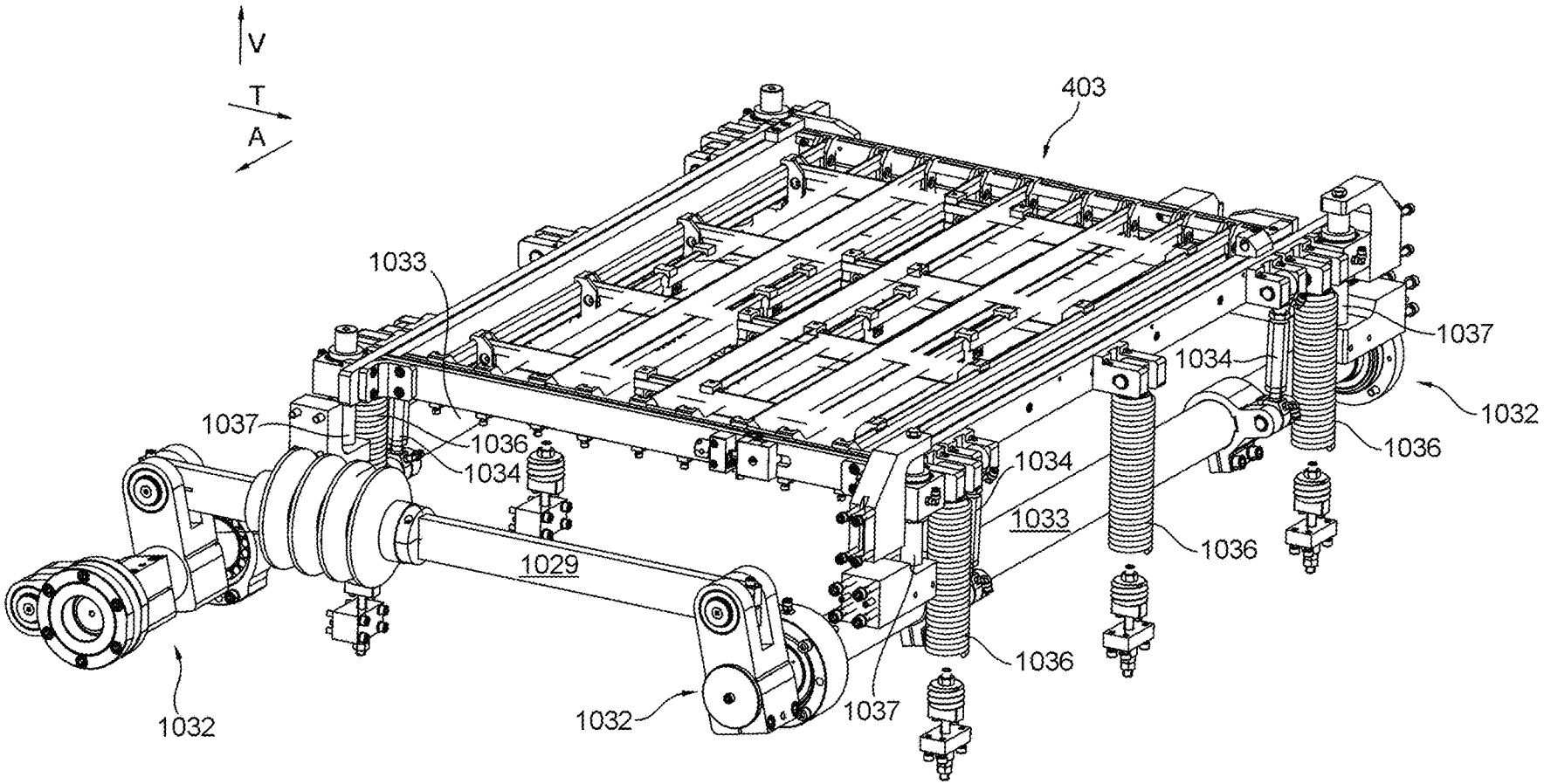
FIG. 24 a perspective illustration of a connection of a lower stripping tool to a driving gear.

A processing machine 01 is preferably configured as a sheet processing machine 01, in particular as a die-cutting machine 01, more preferably as a flat-bed die-cutting machine 01, for processing sheet-like substrate 02 or sheets 02. Above and below, processing machine 01 and/or sheet processing machine 01 also refers to die-cutting machine 01. The processing machine 01 comprises at least one unit 100; 200; 300; 400; 500; 600; 650; 700; 800; 900, preferably a multiplicity of units 100; 200; 300; 400; 500; 600; 650; 700; 800; 900. The processing machine 01, in particular the sheet processing machine 01, preferably comprises at least one unit 300, configured as a shaping unit 300, for processing sheets 02.

Unless an explicit distinction is made, the term sheet-like substrate 02, specifically the term sheet 02, shall generally be understood to encompass any planar substrate 02 that is present in section, i.e., also substrate 02 present in panel- or boards-shaped form, i.e., also panels or boards. The sheet-like substrate 02 or the sheet 02 thus defined is made, for example, of cardboard and/or corrugated cardboard, i.e., cardboard sheets and/or corrugated cardboard sheets, or sheets, panels or possibly boards made of plastic, cardboard, glass, wood, or metal. The sheet-like substrate 02 is more preferably paper and/or paperboard, in particular paper and/or paperboard sheets. Above and below, the term sheet 02 refers, in particular, both to sheets 02 that were not yet processed by means of at least one unit 300; 400; 500; 650, and to sheets 02 that were already processed by means of at least one unit 300; 400; 500; 650 and, in the process, were potentially modified in terms of their shape and/or their mass.

According to DIN 6730 (February 2011), paper is a flat material, consisting mainly of fibers derived from vegetable sources, which is formed by the dewatering of a fiber suspension on a sieve. In the process, a card web is created, which is subsequently dried. The basis weight of paper is preferably a maximum of 225 g/m$^2$ (two hundred and twenty-five grams per square meter).

According to DIN 6730 (February 2011), cardboard is a flat material, consisting mainly of fibers derived from vegetable sources, which is formed by the dewatering of a fiber suspension on a sieve or between two sieves. The fiber structure is compressed and dried. Cardboard is preferably manufactured from cellulose by gluing or pressing the cellulose together. Cardboard is preferably configured as solid board or corrugated cardboard. The basis weight of cardboard is preferably more than 225 g/m$^2$ (two hundred and twenty-five grams per square meter). Corrugated cardboard is cardboard made of one or more layers of corrugated paper that is glued to one layer or between multiple layers of another, preferably smooth, paper or cardboard.

Above and below, the term paperboard preferably refers to a sheet material that is preferably primed on one side and made of paper, having a basis weight of at least 150 g/m$^2$ (one hundred fifty grams per square meter) and no more than 600 g/m$^2$ (six hundred grams per square meter). Paperboard preferably has high strength relative to paper.

A sheet 02 to be worked preferably has a grammage of at least 70 g/m$^2$ (seventy grams per square meter) and/or of no more than 700 g/m$^2$ (seven hundred grams per square meter), preferably no more than 500 g/m$^2$ (five hundred grams per square meter), more preferably no more than 200 g/m$^2$ (two hundred grams per square meter). A sheet 02 to be worked preferably has a thickness of no more than 1 cm (one centimeter), preferably no more than 0.7 cm (zero point seven centimeters), more preferably no more than 0.5 cm (zero point five centimeters), more preferably no more than 0.3 cm (zero point three centimeters).

Above and below, the term multiple-up preferably refers to the number of identical and/or different objects that are produced from the same piece of material and/or are arranged on joint substrate material, for example a joint sheet 02. A multiple-up 03 is preferably the region of a sheet 02 that is either configured as a product of the sheet processing machine 01, in particular as an intermediate product for producing an end product, and/or, for example, is further worked and/or is configured to be further workable to a desired or required end product. The desired or required end product here, which is preferably generated by further working the respective multiple-up 03, is preferably a packaging, in particular a folding box.

Above and below, an offcut piece 04; 05; 06 is the region of a sheet 02 that does not correspond to any multiple-up 03. Collected offcut pieces 04; 05; 06 are preferably referred to as scrap. An offcut piece 04; 05; 06 is preferably configured and/or removable as trim-off and/or broken-off pieces. During the operation of the sheet processing machine 01, the at least one offcut piece 04; 05; 06 is preferably generated in at least one shaping unit 300, preferably by at least one processing step of the respective sheet 02, for example in at least one die-cutting process. During the operation of the sheet processing machine 01, the at least one offcut piece 04; 05; 06 is preferably at least partially removed from the respective sheet 02, and is thus, in particular, separated from the respective multiple-up 03 of the sheet 02. Preferably, at least one unit 400 configured as a stripping unit 400 is configured to remove at least one first offcut piece 04, in particular at least one scrap piece 04, and/or is configured to remove at least one scrap piece 04. Preferably, at least one unit 500 configured as a multiple-up separating unit 500 is configured to remove at least one second offcut piece 06, in particular at least one gripper edge 06, and/or is configured to remove at least one gripper edge 06. For example, a sheet 02 comprises an offcut piece 05 configured as a crosspiece 05. In particular, the multiple-ups 03 are spaced apart from one another by the at least one crosspiece 05.

The spatial area provided for transporting a sheet 02, which the sheet 02, if present, at least temporarily occupies, is the transport path. The transport path is established, at least in a section, by at least one component of a system 1200 configured as a transport system 1200.

A transport direction T is a direction T which is intended for a shaping operating mode of at least one shaping unit 300 of the processing machine 01 and in which the sheet 02, if present, is transported at each point of the transport path. The transport direction T intended, in particular, for transporting sheets 02 is a direction T that is preferably oriented at least substantially horizontally, and more preferably completely horizontally. In addition, or as an alternative, the transport direction T preferably points from a first unit 100 of the processing machine 01 to a last unit 800; 900 of the processing machine 01. In particular, the transport direction T points from a unit 100, in particular a feeder unit 100, on the one hand to a unit 600, in particular to a delivery unit 600, on the other hand. In addition or as an alternative, the transport direction T preferably points in a direction in which the sheets 02 are transported, apart from vertical movements or vertical components of movements, in particular from a first contact with a unit 200; 300; 400; 500; 600; 650; 700; 800; 900 of the processing machine 01 arranged downstream from the feeder unit 100 or a first contact with the processing machine 01 to a last contact with the processing machine 01. The transport direction T is preferably the direction T in which a horizontal component points in a direction that is oriented from the feeder unit 100 to the delivery unit 600.

The transport direction T preferably points from a feeder side to a delivery side.

The feeder side preferably corresponds to the end face of the sheet processing machine 01, preferably the side on which the at least one feeder unit 100 is arranged. The side of the sheet processing machine 01 located opposite the feeder side preferably corresponds to the delivery side. In particular, the last unit 800; 900 of the sheet processing machine 01, preferably the at least one joint unit 900 and/or the at least one offcut piece delivery unit 800 are arranged on the delivery side. The feeder side and the delivery side are preferably arranged parallel to a direction A, in particular a transverse direction A, and a working width.

The transverse direction A is preferably a horizontally extending direction A. The transverse direction A is oriented orthogonally to the intended transport direction T of the sheets 02 and/or orthogonally to the intended transport path of the sheets 02 through the at least one unit 100; 200; 300; 400; 500; 600; 650; 700; 800; 900 of the processing machine 01. The transverse direction A is preferably oriented from an operator side of the processing machine 01 to a drive side of the processing machine 01.

A vertical direction V is preferably the direction V that is arranged orthogonally to a plane spanned by the transport direction T and the transverse direction A. The vertical direction V is preferably oriented perpendicularly from the bottom and/or from a bottom of the processing machine 01 and/or from a lowermost component of the processing machine 01 toward the top and/or to an uppermost component of the processing machine 01 and/or to an uppermost cover of the processing machine 01.

The operator side of the processing machine 01 is preferably the side of the processing machine 01, parallel to the transport direction T, from which an operator, at least partially and at least temporarily, has access to the individual units 100; 200; 300; 400; 500; 600; 650; 700; 800; 900 of the processing machine 01, for example during maintenance work and/or when replacing at least one shaping tool.

The drive side of the processing machine 01 is preferably the side of the processing machine 01, parallel to the transport direction T, which is located opposite the operator side. The drive side preferably comprises at least portions, preferably at least a majority, of a system 1000, in particular of a drive system 1000.

Above and below, the working width is the maximum width that a sheet 02 can have to be able to be transported through the at least one unit 100; 200; 300; 400; 500; 600; 650; 700; 800; 900, in particular the respective units 100; 200; 300; 400; 500; 600; 650; 700; 800; 900, of the processing machine 01, and/or to still be able to be worked by way of the at least one shaping unit 300 of the processing machine 01; this thus corresponds to the maximum width of the respective sheet 02 that can be worked by way of the at least one shaping unit 300 of the processing machine 01. The working width of the processing machine 01, in particular sheet processing machine 01, is preferably at least 30 cm (thirty centimeters), more preferably at least 50 cm (fifty centimeters), still more preferably at least 80 cm (eighty centimeters), still more preferably at least 120 cm (one hundred twenty centimeters), and still more preferably at least 150 cm (one hundred fifty centimeters).

The sheet 02 to be processed preferably has a sheet width, preferably parallel to the transverse direction A, of at least 200 mm (two hundred millimeters), preferably at least 300 mm (three hundred millimeters), more preferably at least 400 mm (four hundred millimeters). The sheet width is preferably no more than 1,500 mm (one thousand five hundred millimeters), more preferably no more than 1,300 mm (one thousand three hundred millimeters), still more preferably no more than 1,060 mm (one thousand sixty millimeters). A sheet length, preferably parallel to the transport direction A, is, for example, at least 150 mm (one hundred fifty millimeters), preferably at least 250 mm (two hundred fifty millimeters), more preferably at least 350 mm (three hundred fifty millimeters). Furthermore, a sheet length is, for example, no more than 1,200 mm (one thousand two hundred millimeters), preferably no more than 1,000 mm (one thousand millimeters), more preferably no more than 800 mm (eight hundred millimeters).

A sheet 02 has multiple edges 07; 08; 09. In particular, an edge 07 configured as a leading edge 07 is located at the front of the sheet 02 in the transport direction, and is arranged parallel to the transverse direction A. In particular, the leading edge 07 is the edge 07 of the respective sheet 02 which can preferably be seized by at least one component of the sheet processing machine 01, in particular by at least one holding element 1202 of the transport system 1200, for transporting the respective sheet 02, and/or at which at least one component of the sheet processing machine 01 seizes the respective sheet 02, in particular by way of the at least one holding element 1202 of the transport system 1200. An edge 08 configured as a trailing edge 08 is preferably arranged opposite the leading edge 07. More preferably, the leading edge 07 and the trailing edge 08 are arranged parallel to one another. In particular, a trailing edge 08 is located at the rear of the sheet 02 in the transport direction T, and is arranged parallel to the transverse direction A. The sheet 02 furthermore has two edges 09 configured as side edges 09. The two side edges 09 are preferably arranged parallel to the transport direction T and orthogonally to the transverse direction A. Each of the side edges 09 is preferably arranged orthogonally to the leading edge 07 and/or to the trailing edge 08 of the sheet 02.

The sheet 02 preferably includes at least one print image. Above and below, the print image describes a representation on the sheet 02 which corresponds to the sum of all image elements, with the image elements having been transferred and/or being transferable to the sheet 02 during at least one working stage and/or at least one printing operation, preferably prior to being processed by the processing machine 01. The surface of the sheet 02 preferably includes at least one unprinted region, in particular an unprinted edge region. In particular, the at least one holding element 1202 preferably holds the sheet 02 at least at the unprinted edge region of the trailing edge 07, which is configured as an offcut piece 06 and/or a gripper edge 06.

The sheet 02 preferably includes at least one printing mark 11, preferably at least two printing marks 11. Above and below, a printing mark 11 is a mark, for example, for monitoring a color register and/or a perfecting register and/or preferably for aligning the sheet 02 in the transport direction T and/or the transverse direction A.

A unit 100; 200; 300; 400; 500; 600; 650; 700; 800; 900 shall, in each case, preferably be understood to mean a group of devices that functionally cooperate, in particular to be able to carry out a preferably self-contained processing operation of at least one substrate 02. A unit 100; 200; 300; 400; 500; 600; 650; 700; 800; 900 in each case preferably encompasses a machine section of the processing machine 01, which is preferably arranged so as to be at least partially separable from further machine sections.

A system 1000; 1100; 1200 of the processing machine 01 is preferably at least one device that is at least temporarily, in particular permanently, in contact and/or can interact with and/or can be functionally connected to at least one unit 100; 200; 300; 400; 500; 600; 650; 700; 800; 900, preferably at least two different units 100; 200; 300; 400; 500; 600; 650; 700; 800; 900 of the processing machine 01.

The processing machine 01 preferably comprises at least one unit 100 configured as a feeder unit 100. The feeder unit 100 is preferably configured as a feeder 100, more preferably as a sheet feeder 100, more preferably as a sheet feeder unit 100. The feeder unit 100 is preferably configured as the first unit 100 of the processing machine 01 in the transport direction T. The feeder unit 100 is preferably configured to feed sheets 02 to the processing machine 01 on the transport path and/or configured to feed sheets 02 to at least one unit 200; 300; 400; 500; 600; 650; 700; 800; 900 arranged downstream from the feeder unit 100 in the transport direction T.

At least one unit 200 configured as an infeed unit 200 is preferably arranged downstream from the at least one feeder unit 100 in the transport direction T. The at least one infeed unit 200 is preferably configured to feed sheets 02, preferably from a sequential supply of sheets 02, to the at least one shaping unit 300. The at least one infeed unit 200 preferably comprises at least one device for detecting sheets 02. A respective sheet 02 can preferably be at least partially, preferably completely, aligned by the at least one infeed unit 200 with respect to its position in the transport direction T and/or in the transverse direction A.

At least one unit 300 configured as a shaping unit 300 is preferably arranged downstream from the at least one feeder unit 100 in the transport direction T, and preferably downstream from the at least one infeed unit 200. The at least one shaping unit 300 preferably comprises at least one shaping mechanism 301. The shaping mechanism 301 is preferably configured as a die-cutting mechanism 301, more preferably as a flat-bed die-cutting mechanism 301. The corresponding unit 300 is then preferably configured as a die-cutting unit 300 and/or a creasing unit 300 and/or a cutting unit 300 and/or a die cutter 300, more preferably as a flat-bed die-cutting unit 300 and/or a flat-bed die-cutter 300.

Above and below, a device for partially severing and/or reducing the thickness of and/or stripping away the sheet 02 to be processed, in particular of the packaging material, is referred to as a creasing unit 300. In particular, notches and/or creases are introduced into the preferably paper-containing or paperboard-containing packaging material, in particular the sheet 02. In the case of corrugated cardboard, for example, the uppermost layer is severed in at least one creasing unit 300. In particular, the sheet 02, in particular the packaging material, can thus preferably be bent and/or folded into a certain shape, for example a three-dimensional shape, with lower force expenditure. A device for severing, preferably for completely severing, the sheet 02, in particular the packaging material, at certain points is referred to as a cutting unit 300 or a die-cutting unit 300. In particular, the at least one offcut piece 04; 05; 06, in particular the packaging material that is not required, can thus subsequently be easily separated from the multiple-ups 03.

The at least one shaping mechanism 301 preferably comprises at least one upper shaping tool, in particular at least one upper die-cutting tool, and/or at least one lower shaping tool, in particular at least one lower die-cutting tool. The at least one upper shaping tool is preferably in each case assigned at least one lower shaping tool, preferably exactly one lower shaping tool. At least one shaping tool is preferably configured to be movable, preferably movable in the vertical direction V. More preferably, at least one upper shaping tool and/or at least one lower shaping tool is in each case configured to be movable in the vertical direction V. The at least one upper shaping tool and the at least one lower shaping tool are preferably synchronized with respect to one another, and in particular with respect to the multiple-up 03 and/or the sheet 02. Preferably, in particular when both the at least one upper shaping tool and the at least one lower shaping tool are configured to be movable, the movement of respective shaping tools is preferably synchronized and/or can be synchronized in terms of time. The respective upper shaping tool and the respective lower shaping tool preferably have opposing relative movements with respect to one another during a die-cutting operation, so that the shaping tools are moved and/or can be moved relative toward one another and/or away from one another in the vertical direction V. The at least one upper shaping tool is preferably at least temporarily, preferably at least once per machine cycle, more preferably in a closed position of the at least one shaping mechanism 301, in direct contact with the at least one lower shaping tool. The at least one upper shaping tool is preferably spaced apart from the at least one lower shaping tool at a distance of greater than zero in an open position of the shaping mechanism 301.

The processing machine 01 preferably comprises at least one drive system 1000. The respective shaping tool is preferably in contact with, preferably functionally connected to, the at least one drive system 1000 and/or can be at least temporarily driven, preferably by way of a cyclical movement, by the drive system 1000.

A sheet 02 that has been processed by the at least one shaping unit 300, i.e., that is arranged downstream from the at least one shaping unit 300 on the transport path in the transport direction T, preferably includes at least one die-cut impression. The at least one die-cut impression is configured as a crease and/or a score mark and/or an embossment and/or a cut and/or a perforation, for example. The at least one die-cut impression, in particular when it is configured as a perforation and/or a cut, is preferably configured to at least partially separate the at least one multiple-up 03 from at least one offcut piece 04; 05; 06 and/or from at least one further multiple-up 03 of the relevant sheet 02. A sheet 02 that has been processed by the at least one shaping unit 300, i.e., that is arranged downstream from the at least one shaping unit 300 on the transport path in the transport direction T, preferably comprises the at least one multiple-up 03, preferably at least two multiple-ups 03, and at least one offcut piece 04; 05; 06.

At least one unit 400 configured as a stripping unit 400 is arranged downstream from the at least one shaping unit 300 in the transport direction T, preferably subsequent to the at least one shaping unit 300, more preferably without a further unit of the processing machine 01 being interposed. The at least one stripping unit 400 is preferably configured to remove the at least one first offcut piece 04, preferably to remove the at least one scrap piece 04, from the respective sheet 02. The at least one stripping unit 400 preferably comprises at least one stripping mechanism 401.

A sheet 02 that has been processed by the at least one stripping unit 400, i.e., that is arranged downstream from the at least one stripping unit 400 on the transport path in the transport direction T, preferably only comprises the at least one multiple-up 03, in particular a multiplicity of multiple-ups 03, and the at least one second offcut piece 06. For example, the sheet 02 that has been processed by the at least one stripping unit 400 additionally comprises the at least one crosspiece 05.

At least one unit 500 configured as a multiple-up separating unit 500 is preferably arranged downstream from the at least one shaping unit 300, in particular the at least one die-cutting unit 300. When the at least one stripping unit 400 is present, the at least one multiple-up separating unit 500 is also arranged downstream from the at least one stripping unit 400 in the transport direction T. The at least one multiple-up separating unit 500 comprises at least one multiple-up separating mechanism 501 for separating the multiple-ups 03 and the at least one remaining offcut piece 05; 06 from one another.

The sheet processing machine 01 furthermore preferably comprises at least one unit 600, in particular a delivery unit 600 for delivering and stacking the multiple-ups 03, more preferably a delivery 600. In the transport path of the sheets 02, the at least one delivery unit 600 is arranged downstream from the at least one die-cutting unit 300, and more preferably the at least one multiple-up separating unit 500 and/or the at least one stripping unit 400. In a preferred embodiment, the at least one multiple-up separating unit 500 comprises the at least one delivery unit 600, with the two units 500; 600 preferably being configured as a joint unit 650.

Furthermore, the sheet processing machine 01 preferably comprises the at least one unit 700, which is preferably configured as a sheet insert unit 700. The at least one sheet insert unit 700 is preferably assigned to the at least one multiple-up separating unit 500, and more preferably is arranged downstream from the at least one multiple-up separating unit 500 in the transport direction T. The at least one sheet insert unit 700 preferably inserts at least one sheet 02, preferably at least one unprocessed sheet 02, into a pile of sheets 02 and/or multiple-ups 03, which are preferably separated from one another, to increase the stability. The sheet processing machine 01, in particular, comprises the sheet insert unit 700 for inserting a sheet 02 into a pile of multiple-ups 03. The sheet insert unit 700 preferably comprises at least one pile formation device 701. Furthermore, the at least one pile formation unit 700 comprises at least one sheet cartridge 702, in particular an intermediate sheet cartridge 702, for holding, preferably unprocessed, sheets 02. The sheet insert unit 700 can also be arranged downstream from the joint unit 650.

Furthermore, the sheet processing machine 01 preferably comprises at least one unit 800 for collecting offcut piece 05; 06 configured as an offcut piece delivery unit 800. In particular, the at least one offcut piece 05; 06 is separated from the at least one multiple-up 03, preferably all multiple-ups 03. The at least one offcut piece delivery unit 800 is preferably arranged downstream from the multiple-up separating unit 700 in the transport direction T. More preferably, the at least one offcut piece delivery unit 800 is arranged downstream from the at least one delivery unit 600. In a preferred embodiment, the at least one offcut piece delivery unit 800 is encompassed by the at least one sheet insert unit 700, and these are configured as a joint unit 900.

The at least one drive system 1000 is preferably functionally connected to at least one system 1100, in particular a control system 1100, and/or the at least one transport system 1200.

The at least one drive system 1000 preferably comprises at least one clock generator and/or angular position transducer, more preferably exactly one clock generator and/or angular position transducer. The at least one clock generator and/or angular position transducer is preferably configured to generate a guide value, for example a virtual guide value and/or a guide value in the form of pulses, by way of which movements of components of the processing machine 01 can be synchronized and/or are synchronized.

Furthermore, the at least one sheet processing machine 01 comprises at least one system 1200 configured as a transport system 1200. The at least one transport system 1200 guides the sheets 02, preferably continuously holding them, through the sheet processing machine 01 and, in particular, at least through the units 300; 400; 500; 650. In particular, the sheets 02 are preferably guided at least substantially horizontally in the transport direction T through the sheet processing machine 01. The transport system 1200 is preferably configured as a chain transport system 1200, and more preferably as a chain gripper system 1200. In particular, the at least one chain transport system 1200 comprises at least one guide device 1203, wherein the at least one guide device 1203 is preferably configured as at least one chain 1203. In particular, the at least one guide device 1203 is at least partially, preferably completely, arranged outside the transport path. The chain gripper system 1200 is preferably configured with at least one carriage, preferably with multiple carriages, 1201, in particular a gripper carriage 1201. In particular, the at least one guide device 1203 holds the at least one gripper carriage 1201, preferably all gripper carriages 1201, and establishes the position of the at least one gripper carriage 1201 in at least one transport system 1200. In particular, the respective gripper carriage 1201, during sheet guidance, has a position in the transport direction T that is predefined by the at least one guide device 1203. The at least one holding element 1202, in particular the at least one gripper 1202, is preferably arranged at each carriage 1201. In particular, each gripper carriage 1201 comprises multiple holding elements 1202, preferably grippers 1202, in the transverse direction A across the working width, preferably at equal distances with respect to one another. The at least one holding element 1202 is preferably transferred from an open position into a closed position for gripping a sheet 02. A sheet 02 is preferably seized by the at least one holding element 1202 at the transfer position of the at least one infeed unit 200. For depositing the at least one second offcut piece 06, preferably in the at least one offcut piece delivery unit 800, the at least one holding element 1202 is preferably transferred from a closed position into an open position. The chain gripper system 1200 preferably has a cyclical and/or periodic movement for transporting sheets through the units 300; 400; 500; 650. In particular, the movement is configured to be so periodic and/or cyclical that the sheet 02 and/or the gripper carriage 1201, in particular the chain gripper carriage 1201, are at a standstill during the processing step in one of the units 300; 400; 500; 650. In particular, the at least one chain gripper carriage 1201 and/or the sheet 02 are in motion between the individual processing steps. The transport system 1200 is coupled to and synchronized with the transport means of the individual units via the control system 1100 and the drive system 1000.

The at least one drive system 1000 preferably comprises at least one drive 1001. For example, the at least one drive 1001 is configured as a central drive of the processing machine 01. The drive system 1000 preferably comprises a drive 1001 configured as a central drive. The at least one drive 1001 is preferably configured to transmit torque and/or linear movement to at least one component of at least one unit 100; 200; 300; 400; 500; 600; 650; 700; 800; 900, for example at least one transport means 103; 104; 108; 204, and/or to at least one component of the transport system 1200. The at least one drive 1001 is preferably configured to transmit torque and/or linear movement to at least two different components of the same unit 100; 200; 300; 400; 500; 600; 650; 700; 800; 900 and/or two different units 100; 200; 300; 400; 500; 600; 650; 700; 800; 900 and/or to at least one component of the transport system 1200. The at least one drive 1001 is preferably in contact with and/or functionally connected to at least one component of at least one unit 100; 200; 300; 400; 500; 600; 650; 700; 800; 900 which is to be moved at least temporarily and/or at least one component of the transport system 1200. The at least one drive 1001 of the at least one drive system 1000 is preferably linked, or can be linked, to at least one component of at least one unit 100; 200; 300; 400; 500; 600; 650; 700; 800; 900 to be moved, preferably to all components of the respective unit 100; 200; 300; 400; 500; 600; 650; 700; 800; 900, or of the respective units 100; 200; 300; 400; 500; 600; 650; 700; 800; 900, which are to be moved by the respective drive 1001, and/or to at least one component of the transport system 1200 to be moved, in such a way that the respective component to be moved, and preferably all components to be moved by the drive 1001, can be operated and/or are operated in a synchronized manner.

The at least one drive system 1000 is preferably configured to transmit cyclical and/or periodic movements to at least one component of at least one unit 100; 200; 300; 400; 500; 600; 650; 700; 800; 900 and/or of the transport system 1200 by way of the at least one drive 1001.

In a preferred embodiment, the at least one drive system 1000 comprises exactly one drive 1001, which is preferably linked to different components of different units 100; 200; 300; 400; 500; 600; 650; 700; 800; 900 and/or to at least one component of the transport system 1200.

The at least one drive 1001 of the drive system 1000 is preferably configured as an electric motor, more preferably as a servo motor.

The sheet processing machine 01 preferably comprises at least one system 1100, in particular at least one control system 1100 for open-loop and/or for closed-loop control. The at least one control system 1100 is functionally connected to the units 100; 200; 300, 400; 500; 600; 650; 700; 800; 900 and the at least one drive 1001, for example. The multiple units 100; 200; 300, 400; 500; 600; 650; 700; 800; 900 are preferably functionally connected to one another via the at least one control system 1100 and are synchronized and/or can be synchronized. The sheet processing machine 01 comprises multiple sensors, wherein the input signals thereof are detected and processed in at least one control system 1100. For example, at least one output signal is generated via the at least one control system 1100, which controls, by open-loop and/or closed-loop control, at least one component of a unit 100; 200; 300, 400; 500; 600; 650; 700; 800; 900, and/or is connected to a component of a unit 100; 200; 300, 400; 500; 600; 650; 700; 800; 900 so as to control the same by open-loop and/or closed-loop control. For example, the at least one drive 1001 of the at least one drive system 1000 and/or an alignment of sheets 02 and/or an infeed of sheets 02 into the processing machine 01 and/or an insertion of sheets into the at least one delivery pile can be controlled, by open-loop control and/or closed-loop control, via the at least one control system 1100. An operator can, for example, at least partially intervene in the mode of operation of the sheet processing machine 01 via a control console that is functionally connected to the at least one control system 1100.

The at least one infeed unit 200 preferably comprises at least one transport means, which is preferably configured as at least one transport roller and/or at least one transport brush. Sheets 02 are preferably transported by means of the at least one transport means of the at least one infeed unit 200, which is preferably configured as at least one transport roller and/or at least one transport brush, in the transport direction T along the transport path of sheets 02 toward an alignment position PA.

The infeed unit 200 preferably comprises at least one infeed system 202. The infeed unit 200 is preferably arranged upstream from the at least one shaping unit 300. The infeed unit is preferably arranged downstream from the at least one feeder unit 100. The at least one infeed system 202 is preferably arranged downstream from the feeder unit 100 preferably configured as a sheet feeder 100. The at least one infeed system 202 preferably comprises at least one stop 203, preferably at least two stops 203, which are preferably at least temporarily arranged within the plane of the transport path at the alignment position PA. The at least one infeed system 202 preferably comprises at least one transport means 204, which is preferably configured as a transfer means 204 and/or a holding means 204. The at least one infeed system 202 preferably comprises the at least one transport means 204, which is preferably configured as a transfer means 204 and/or a holding means 204 and which is preferably configured to transport sheets 02 sequentially from the alignment position PA to a transfer position PU, wherein the transfer position PU is arranged along the transport path in the transport direction T downstream from the alignment position PA. At the transfer position PU, a respective, preferably the at least one, sheet 02 can preferably be transferred and/or is transferred to the at least one transport system 1200 of the processing machine 01, in particular when at least one holding element 1202 of the transport system 1200 is situated in the transfer position PU at the time of transfer. The at least one sheet 02 is preferably transferred at the transfer position PU to the at least one holding element 1202 of the transport system 1200, preferably by the at least one transport means 204 of the infeed system 202.

Preferably in addition or as an alternative, the at least one infeed unit 200 comprises at least one device for detecting sheets 02, in particular at least one sensor device 251. The at least one sensor device 251 preferably comprises at least one sensor 252, more preferably at least two sensors 252, more preferably at least three sensors 252. The at least one sensor device 251 preferably comprises at least one sensor 252, more preferably at least two sensors 252, more preferably exactly two sensors 252, which are arranged next to one another in the transport direction T, i.e., behind one another in the transverse direction A. Preferably, the at least one sensor 252 is, preferably the at least two sensors 252 are, arranged outside the transport path of sheets 02, and directed at the transport path of sheets 02. Preferably, the at least one sensor 252 is, preferably the at least two sensors 252 are, configured to selectively detect at least one printing mark 11 and/or at least one edge 07; 08; 09 of sheets 02, preferably of the at least one sheet 02. Preferably, a respective sensor 252 of the sensor device 251, preferably each sensor 252 of the at least two sensors 252, is configured to selectively detect at least one printing mark 11 of the at least one sheet 02 and/or at least one edge 07; 08; 09 of the at least one sheet 02. Preferably, a respective sensor 252 of the sensor device 251, preferably the at least one sensor 252, more preferably each sensor 252 of the at least two sensors 252, is configured to selectively detect, at least partially, at least one printing mark 11 of a respective, preferably of the at least one, sheet 02 and/or at least one edge 07; 08; 09 of the respective, preferably of the at least one, sheet 02, in particular the leading edge 07 of the respective sheet 02 and/or at least one side edge 09 of the respective sheet 02 which is arranged parallel to the transport direction T, preferably in at least one detection zone 253, more preferably in a detection zone 253 having a surface area of no more than 10% of a respective upper side and/or underside of the respective, preferably of the at least one, sheet 02. The detection zone 253 of a sensor 252 is preferably the surface area within the plane of the transport path which can be detected and/or is detected, at least temporarily, by the relevant sensor 252, preferably by the at least one sensor 252, more preferably by the at least one sensor 252 of the at least two sensors 252. The detection zone 253 is preferably at least 10 mm (ten millimeters), preferably at least 15 mm (fifteen millimeters), more preferably at least 20 mm (twenty millimeters), and/or no more than 40 mm (forty millimeters), preferably no more than 30 mm (thirty millimeters), in the transport direction T.

Above and below, the selective detection of at least one edge 07; 08; 09 and/or at least one printing mark 11 preferably describes that the at least one sensor device 251 of the sheet processing machine 01, preferably at least one of the at least two sensors 252, more preferably the at least two sensors 252, have at least two, preferably at least three, operating modes that can be distinguished from one another. In a, for example first, preferred operating mode, the at least one sensor device 251, preferably at least one of the at least two sensors 252, more preferably the at least two sensors 252, are configured to detect the at least one printing mark 11. In a, for example second, operating mode, the at least one sensor device 251, preferably at least one of the at least two sensors 252, more preferably the at least two sensors 252, are configured to detect the at least one edge 07; 08; 09. In a, for example third, operating mode, the at least one sensor device 251, preferably at least one of the at least two sensors 252, more preferably the at least two sensors 252, are configured to detect the at least one printing mark 11 and the at least one edge 07; 08; 09. It is preferably possible to select between the at least two, preferably at least three, operating modes, at least for the present print job, preferably for the at least one sheet 02, more preferably for each individual sheet 02. In particular, the at least one sensor device 251, preferably at least one of the at least two sensors 252, more preferably the at least two sensors 252, can be operated both in the first operating mode, i.e., in which the at least one printing mark 11 is detected, and in the second operating mode, i.e., in which the at least one edge 07; 08; 09 is detected, and also in the third operating mode, i.e., in which both the printing mark 11 and the edge 07; 08; 09 are detected, and/or are operated either in the first operating mode or the second operating mode or the third operating mode.

The at least one sensor device 251 is preferably configured to generate at least one signal, which is processed and/or can be processed by the at least one control system 1100. The at least one infeed unit 200 is preferably configured to at least partially, preferably completely, align the respective at least one sheet 02 with respect to its position in the transport direction T and/or in the transverse direction A, in particular based on the at least one signal of the at least one sensor device 251 and/or based on at least one signal of the at least one control system 1100. A respective sheet 02, preferably the at least one sheet 02, can preferably be at least partially, preferably completely, aligned by the at least one infeed unit 200 in terms of its position in the transport direction T and/or in the transverse direction A. Preferably, the at least one signal of the at least one sensor device 251 and/or the at least one signal of the at least one control system 1100 can be processed and/or is processed for aligning the at least one sheet 02 by the at least one infeed system 202.

The infeed system 202 is preferably configured to feed sheets 02 to a unit 300; 400; 500; 600; 650; 700; 800; 900 arranged downstream in the transport direction T, in particular to the shaping unit 300. In addition, a sheet 02, preferably the at least one sheet 02, is preferably at least partially aligned by the infeed system 202, so that the sheet 02 is processed and/or can be processed in the correct position by the units 300; 400; 500; 600; 650; 700; 800; 900 arranged downstream in the transport direction T.

A sheet 02 transported in the infeed unit 200, preferably the at least one sheet 02, is preferably transported to the alignment position PA. The alignment position PA is preferably established by the at least one stop 203, in particular the at least two stops 203, each preferably being configured as a front lay mark 203. The alignment position PA is preferably established by the at least two front lay marks 203 arranged horizontally with respect to the transport direction T and parallel next to one another. The at least two front lay marks 203 are preferably arranged parallel next to one another in the transport direction T and spaced apart from one another. The infeed system 202, in the transport direction T, preferably comprises the at least two front lay marks 203 arranged parallel to one another, which are configured to roughly align the at least one sheet 02 in the alignment position PA. For example, the at least two front lay marks 203 are configured as rough alignment means. Advantageously, larger infeed errors, for example a deviation in the position of the sheet 02 from its target position by more than 10%, preferably more than 15%, preferably more than 20%, more preferably more than 30%, are thus corrected.

A rough alignment preferably describes an alignment of sheets 02, wherein the position of the at least one sheet 02 still deviates from a reference after the rough alignment. Preferably, a deviation of a measured value, preferably of the position, of the sheets 02, preferably of the at least one sheet 02, from its reference is reduced to no more than 8 mm (eight millimeters), preferably no more than 5 mm (five millimeters), more preferably no more than 4 mm (four millimeters), more preferably no more than 3 mm (three millimeters), during a rough alignment.

Preferably in addition, the infeed system 202 comprises at least one servo drive 218, which is configured to finely align sheets 02. The infeed system 202 preferably comprises at least two servo drives 218. For example, the at least one servo drive 218 is configured as a fine alignment means. The infeed system 202, in the transport direction T, preferably comprises at least two front lay marks 203 arranged parallel to one another, which are configured to roughly align the at least one sheet 02 in the alignment position PA, and the at least one servo drive 218, which is configured to finely align sheets 02.

A fine alignment preferably describes an alignment of sheets 02, wherein the position of the at least one sheet 02 preferably only deviates minimally, preferably not at all, from a reference after the fine alignment. Preferably, a deviation of a measured value, preferably of the position, of the sheets 02, preferably of the at least one sheet 02, from its reference is reduced to no more than 1 mm (one millimeter), preferably no more than 0.5 mm (zero point five millimeter), more preferably no more than 0.1 mm (zero point one millimeter), more preferably no more than 0.05 mm (zero point zero five millimeter), more preferably no more than 0.01 mm (zero point zero one millimeter), more preferably no more than 0.005 mm (zero point zero zero five millimeter), during a fine alignment.

The at least one front lay mark 203 is, preferably the at least two front lay marks 203 are, in each case configured to protrude and/or protrude at least temporarily into the transport path of sheets 02. The at least one front lay mark 203 is, preferably the at least two front lay marks 203 are, preferably configured to protrude at least temporarily into the transport path of sheets 02. At least a portion of the at least one front lay mark 203 is preferably at least temporarily arranged within the plane of the transport path at the alignment position PA. In this way, the at least one front lay mark 203, preferably the at least two front lay marks 203, preferably at least temporarily form a barrier in the transport direction T for sheets 02 transported along the transport path, so that the movement of these sheets 02 in the transport direction T is preferably at least temporarily impeded at the position of the relevant at least one front lay mark 203. Preferably in addition, the at least one front lay mark 203, preferably the at least two front lay marks 203, are configured to be pivotable and/or to be pivoted and/or to pivot and/or are pivoted outside the transport path of sheets 02. Preferably, the least one portion of the at least one front lay mark 203 which is at least temporarily arranged within the plane of the transport path in the alignment position can be pivoted and/or is pivoted at least temporarily out of the plane of the transport path in the alignment position PA. The at least one front lay mark 203, preferably the at least two front lay marks 203, preferably at least temporarily protrude into the transport path of sheets 02 and are preferably at least temporarily pivoted outside the transport path of sheets 02.

The at least two front lay marks 203 arranged parallel to and next to one another in the transport direction T, preferably at least four, more preferably at least eight, more preferably all front lay marks 203 arranged parallel next to one another in the transport direction T, are preferably connected to one another via at least one shaft. The shaft of the front lay marks 203 is preferably arranged outside the transport path of sheets 02, in particular in the vertical direction V beneath the transport path of sheets 02. The at least one front lay mark 203 is preferably connected to at least one roller lever 208, preferably via the at least one shaft of the front lay marks 203. For example, the infeed system 202 of the sheet processing machine 01 comprises two roller levers 208 assigned to the at least two front lay marks 203. The respective, preferably the at least one, front lay mark 203 and the at least one roller lever 208 are preferably configured to be movable, preferably at least in and/or counter to the transport direction T. Preferably, at least one profiled cam 209, the position of which is preferably fixed, in particular in the transport direction T, is assigned in each case to the respective roller lever 208. The respective, preferably the at least one, profiled cam 209 preferably has a different height in the vertical direction V, in particular along the transport direction T. The respective, preferably the at least one, roller lever 208 is preferably configured to carry out a rolling motion along the surface of the profiled cam 209 assigned thereto, preferably at least in and/or counter to the transport direction T, in particular in the case of a movement of the roller lever 208 in and/or counter to the transport direction T.

The infeed system 202 preferably comprises the at least one transport means 204, which is preferably configured as a transfer means 204 and/or as a holding means 204. The at least one transport means 204 preferably is at least one gripper 204. The infeed system 202 preferably comprises at least two transport means 204 that are spaced apart from one another, more preferably at least four, more preferably at least eight, for example eleven, in particular a multiplicity of transport means 204 that are spaced apart from one another, which are preferably arranged horizontally next to one another in the transport direction T, i.e., behind one another in the transverse direction A. The individual transport means 204 are preferably connected to one another via at least one shaft 221, in particular at least one gripper shaft 221, and/or each of the individual transport means 204 is attached to the at least one gripper shaft 221. The at least one transport means 204 is preferably attached to the at least one gripper shaft 221. Preferably, a multiplicity of grippers 204 that are spaced from one another in the transverse direction A are attached to the at least one gripper shaft 221 and/or connected to one another via the at least one gripper shaft 221.

The at least one transport means 204 preferably comprises at least one transfer element 206; 207. Each of the at least one transport means 204 preferably comprises at least one upper holder 206 and/or at least one lower holder 207. The upper holder 206 is preferably configured as an upper transfer element 206, for example as an upper half of the gripper 204. The upper holder 206 is preferably at least primarily arranged in the vertical direction V above the plane of the transport path at the position of the transport means 204. The lower holder 207 is preferably configured as a lower transfer element 207, for example as a lower half of the gripper 204. The lower holder 207 is preferably at least primarily arranged in the vertical direction V below the plane of the transport path at the position of the transport means 204. Each of the at least one upper holder 206 preferably comprises an upper holding surface 233, which corresponds to the region of the upper holder 206 that makes direct contact at least temporarily with a sheet 02 to be transported and/or that faces the respective, preferably the at least one, lower holder 207, i.e., is arranged in the vertical direction V downwardly at the relevant upper holder 206, and/or that can be arranged and/or is arranged at least temporarily at the alignment position PA in the vertical direction V, coming from above, within the plane of the transport path. Each of the at least one lower holder 207 preferably comprises a lower holding surface 234, which corresponds to the region of the lower holder 207 that makes direct contact at least temporarily with a sheet 02 to be transported and/or that faces the respective, preferably the at least one, upper holder 206, i.e., is arranged in the vertical direction V upwardly at the relevant lower holder 207, and/or that can be arranged and/or is arranged at least temporarily at the alignment position PA in the vertical direction V, coming from beneath, within the plane of the transport path.

The at least one respective transfer element 206; 207, preferably the at least one upper holder 206 and/or the at least one lower holder 207, of the transport means 204 is preferably configured to at least temporarily detect a respective, preferably the at least one, sheet 02 in an edge region and/or outside the at least one print image of the sheet 02. For example, the at least one transport means 204 seizes the at least one sheet 02 in an edge region and/or outside the at least one print image, preferably by means of the at least one upper holder 206 and the at least one lower holder 207.

The at least one transport means 204 configured as a transfer means 204 and/or as a holding means 204 is preferably configured to sequentially transport sheets 02, in particular from the alignment position PA to the transfer position PU. The transport means 204 configured in particular as a transfer means 204 and/or as a holding means 204 preferably has a straight guidance or a linear guidance. The at least one transport means 204 can be moved and/or is moved, preferably horizontally, along the transport path in the transport direction T and/or counter to the transport direction T. The at least one transport means 204 is preferably configured to move and/or to be movable and/or to be moved from the alignment position PA to the transfer position PU and/or back. The at least one transport means 204, during its movement from the alignment position PA to the transfer position PU, and preferably additionally back from the transfer position PU to the alignment position PA, preferably has a rectilinear movement, preferably a forward movement and/or a backward movement in the horizontal plane, preferably in a plane spanned by the transport direction T and the transverse direction A. The at least one transport means 204 of the infeed system 202 preferably carries out a planar transport of sheets 02. The transfer of the at least one sheet 02 to the transport system 1200 downstream from the infeed system 202, preferably the transfer of the at least one sheet 02 from the at least one transport means 204 of the infeed system 202 to the at least one holding element 1202 of the transport system 1200, preferably takes place in a horizontal plane, preferably in a plane spanned by the transport direction T and the transverse direction A.

Preferably, at least one component of the infeed system 202, in particular at least the at least one transport means 204 configured as a transfer means 204 and/or as a holding means 204, preferably configured as a gripper 204, can be moved and/or is moved at least partially in the transport direction T and/or in the transverse direction A. The infeed system 202 preferably has at least one mounting point S, about which preferably at least one connecting point 219 is pivotingly and/or pivotably arranged, the connecting point 219 preferably being connected to the at least one transport means 204. The at least one connecting point 219 is preferably pivotingly and/or pivotably arranged about the at least one mounting point S as a function of a rotation of a drive shaft 1002, which is preferably configured as an infeed drive shaft 1002.

The at least one drive shaft 1002 is preferably connected to the at least one drive 1001 of the drive system 1000 and/or is driven at least temporarily, preferably permanently, by the at least one drive 1001. The at least one drive system 1000 preferably comprises at least one clock generator and/or angular position transducer and/or at least one rotary encoder, more preferably exactly one clock generator and/or angular position transducer and/or rotary encoder. The at least one drive shaft 1002 is preferably configured as a single-turn shaft 1002 and, per machine cycle, carries out exactly one full rotation of 360° about an axis of rotation D of the drive shaft 1002.

The infeed system 202 preferably comprises at least one gear mechanism, preferably at least one cam mechanism, preferably to carry out the movement in and/or counter to the transport direction T, and preferably additionally or alternatively in and/or counter to the transverse direction A. The at least one infeed system 202 of the sheet processing machine 01 preferably comprises the at least one cam mechanism, preferably so as to at least partially transmit a movement from the drive shaft 1002 to the at least one transfer means 204 of the infeed system 202. The at least one drive shaft

1002, preferably as a result of its rotational movement, preferably by way of the at least one drive 1001, is preferably configured to generate a preferably continuous movement, for example a fixed stroke, of the cam mechanism. Preferably in addition or as an alternative, the at least one infeed system 202 comprises at least one servo drive 218 that is independent of the drive shaft 1002, preferably of the at least one drive 1001. The at least one servo drive 218 is preferably mechanically independent of, preferably mechanically decoupled from, the drive shaft 1002, preferably the at least one drive 1001.

The at least one infeed system 202 of the sheet processing machine 01 preferably comprises the at least one cam mechanism. The at least one infeed system 202 preferably comprises at least two cam mechanisms. The at least one cam mechanism preferably comprises at least one cam disk 212; 223.

At least one of the cam mechanisms preferably comprises at least one cam disk 212. Each of the at least one cam mechanism is preferably configured as a disk cam mechanism, preferably including at least one cam disk 212. Each of the at least one cam mechanism preferably has the at least one cam disk 212 and an axis of rotation D of the at least one cam disk 212. The cam mechanism is preferably connected to the at least one drive shaft 1002. The at least one cam mechanism is preferably driven by the at least one drive 1001, preferably via the at least one drive shaft 1002, preferably continuously. The axis of rotation D of the drive shaft 1002 is preferably identical to the axis of rotation D of the at least one cam disk 212 of the at least one cam mechanism. The at least one cam disk 212 is preferably concentrically arranged about the at least one drive shaft 1002. Preferably, the at least one cam disk 212 of the at least one cam mechanism thus carries out a complete rotation about the axis of rotation D per machine cycle. The at least one cam mechanism preferably comprises at least two cam disks 212, preferably in each case exactly two cam disks 212.

The at least one drive 1001 of the at least one drive shaft 1002 of the cam mechanism is preferably mechanically connected to at least one drive of the transport system 1200 arranged downstream from the infeed system 202 in the transport direction T of sheets 02. For example, the drive shaft 1002 and the transport system 1200 arranged downstream from the infeed system 202 in the transport direction T of sheets 02 comprise a joint drive 1001, to which they are preferably connected, for example via different gear mechanisms. The sequence of motions of the infeed system 202 is preferably at least partially coupled to and/or synchronized with the sequence of motions of the transport system 1200 arranged downstream in the transport direction T of sheets 02.

Preferably, at least one scanning element 213 is arranged to rest against and/or rests against the at least one cam disk 212. The at least one scanning element 213 is preferably configured as a roller. The respective, preferably the at least one, scanning element 213 is preferably assigned to at least one drive lever 214. The infeed system 202 preferably comprises the at least one drive lever 214 assigned to the respective, preferably the at least one, cam disk 212. The at least one scanning element 213 of the at least one drive lever 214 is preferably configured to rest permanently without clearance against a cam disk 212 of the respective, preferably at least one, cam mechanism. In particular while the scanning element 213 rests without clearance against the at least one cam disk 212, the center of gravity of the at least one scanning element 213 preferably has a distance L213 with respect to the axis of rotation D of the drive shaft 1002, which preferably changes during a rotation of the at least one cam disk 212 about its axis of rotation D. Each of the at least one drive lever 214 preferably has the at least one mounting point S. The at least one mounting point S is preferably configured as the pivot point S of the drive lever 214 and/or as a pivot axis S of the drive lever 214. The pivot axis S is preferably oriented parallel to the transverse direction A. The at least one scanning element 213 is preferably arranged at a position along the drive lever 214 which is spaced apart from the mounting point S, and is configured to pivot and/or be pivotable about the mounting point S.

The at least one sensing element 213 is preferably connected to the at least one transport means 204 via the at least one drive lever 214. The at least one drive lever 214 is preferably connected to the at least one transport means 204 via at least one coupler 216. The at least one drive lever 214 and the at least one coupler 216 preferably have the at least one connecting point 219 to one another. The at least one connecting point 219 is preferably in each case positioned spaced apart from the at least one scanning element 213 and/or from the mounting point S along the drive lever 214, and is preferably configured to pivot and/or be pivotable about the mounting point S.

The at least one drive lever 214 is preferably configured to have at least one rotational movement of the cam mechanism scanned by the at least one scanning element 213. Preferably in addition or as an alternative, the at least one drive lever 214 is configured to convert the at least one rotational movement of the cam mechanism into at least one linear movement of the transfer means 204. The at least one drive lever 214 is preferably configured to transmit the at least one rotational movement of the cam mechanism to the connecting point 219, whereby the at least one assigned coupler 216 is preferably made to carry out at least one, preferably at least primarily linear, movement, preferably having a main component of the movement direction in and/or counter to the transport direction T.

At least one cam mechanism of the cam mechanisms of the infeed system 202 is preferably configured as a dual cam mechanism, each preferably comprising at least two cam disks 212. The at least one cam mechanism is preferably configured as a dual cam mechanism, each preferably comprising at least two cam disks 212. The at least two cam disks 212 of the at least one dual cam mechanism are preferably arranged behind one another in the transverse direction A. At least one scanning element 213 is arranged so as to rest without clearance, in particular so as to rest permanently without clearance, against each of the at least two cam disks 212 of the dual cam mechanism. The at least two scanning elements 213 of the dual cam mechanism are preferably arranged on a joint drive lever 214. The at least two scanning elements 213 of the dual cam mechanism are preferably arranged on a joint drive lever 214, with the mounting point S therebetween. The at least one scanning element 213 of the at least one drive lever 214 is preferably configured to rest permanently without clearance against a cam disk 212 of the respective, preferably at least one, cam mechanism. The respective, preferably the at least one, scanning element 213 is preferably configured to permanently rest without clearance against the respective, preferably at least one, cam disk 212, without suspension. A scanning element 213 of the at least two scanning elements 213 of a drive lever 214 preferably in each case rests permanently without clearance against a cam disk 212 of the dual cam mechanism. The respective at least one further scanning element 213 is preferably configured as a pressing element of the respective at least one another scanning element 213. The distance L213 between the respective, preferably the at least one, scanning element 213 and the axis of rotation D of the drive shaft 1002 for the scanning element 213 assigned to a first cam disk 212 is preferably different from the distance L213 for the scanning element 213 of the same cam mechanism assigned to a second cam disk 212.

Each of the at least one cam disk 212 preferably comprises at least two, preferably at least three, more preferably at least four, regions, with regions abutting one another having different radii. The at least one cam disk 212 preferably has at least two different radii with respect to its axis of rotation D along its circumference. For example, the at least one cam disk 212, along its circumference, includes at least one depression and/or at least one elevation and/or at least one lobe with respect to the surrounding regions. A cam function of the circumference of the at least one cam disk 212 is preferably continuous, preferably continuously differentiable, in all points along its arc length. The cam function of the at least one cam disk 212 is preferably configured to correspond to a movement profile of the at least one transport means 204, which is configured to transfer sheets 02 to the transport system 1200 arranged downstream from the infeed system 202 in the transport direction T. The cam function, preferably in each case at least a region, of the at least one cam disk 212 preferably corresponds to a movement of the at least one transport means 204 from the alignment position PA to the transfer position PU, and vice versa, as well as the residence time of the at least one transport means 204 in the alignment position PA and/or in the transfer position PU.

The at least two cam disks 213 of the dual cam mechanism are preferably displaced with respect to one another by at least one angle of rotation. The at least two cam disks 213 of the dual cam mechanism are preferably displaced with respect to one another by at least one angle of rotation, so that the joint projection of the at least two cam disks 213 of a dual cam mechanism, in a plane spanned by the transport direction T and the vertical direction V, has a larger surface area than the projection of an individual one of the at least two cam disks 213 in the same plane. At least one cam disk 213 of the dual cam mechanism is preferably configured as a spring replacement for the at least one drive lever 214, so that in each case at least one, preferably each, scanning element 213 of the drive lever 214 rests permanently without clearance against a respective cam disk 213 of the dual cam mechanism.

The scanning element 213 preferably has a minimal distance L213 with respect to the axis of rotation D of the drive shaft 1002 when the radius of the assigned cam disk 212 is minimal in the region that, at this time, faces the relevant scanning element 213. The scanning element 213 preferably has a maximal distance L213 with respect to the axis of rotation D of the drive shaft 1002 when the radius of the assigned cam disk 212 is maximal in the region that, at this time, faces the relevant scanning element 213. The at least one drive lever 214 is preferably configured to pivot about its mounting point S. The at least one drive lever 214 is preferably configured to pivot about its mounting point S, corresponding to the distance L213 between the at least one scanning element 213 and the axis of rotation D of the drive shaft 1002.

By scanning the circumference of the at least one cam disk 212 using the at least one scanning element 213, in particular by the scanning element 213 that is preferably configured as a roller, carrying out a rolling motion on the respective cam disk 212, the at least one assigned drive lever 214 is pivoted about its mounting point S. The drive lever 214 is preferably deflected from its existing position about its mounting point S by the profile of the at least one cam disk 212. Likewise, the connecting point 219 thus pivots about the mounting point S. The at least one coupler 216 connected to the connecting point 219 is moved, wherein the respective movement direction preferably has a largest component of its orientation in and/or counter to the transport direction T. The at least one transport means 204 is thus preferably moved along its linear guidance in and/or counter to the transport direction T. The at least one transport means 204 is preferably configured to move and/or is moved in and/or counter to the transport direction T by the at least one drive lever 214 being pivoted about its mounting point S. The at least one transport means 204 is preferably configured to move and/or is moved in and/or counter to the transport direction T by the profile of the at least one cam disk 212.

The distance between the mounting point S of the at least one drive lever 214 and the axis of rotation D of the drive shaft 1002 and/or the axis of rotation D of the at least one cam disk 212 is preferably constant.

The mounting point S and the axis of rotation D are preferably configured to be adjustable and/or to be adjusted and/or to adjust relative to one another and/or are adjusted relative to one another. More preferably, the mounting point S and the axis of rotation D are preferably configured to be pivotable and/or to be pivoted and/or to pivot relative to one another and/or are preferably pivoted relative to one another. The relative pivoting of the mounting point S and of the axis of rotation D with respect to one another, preferably a pivoting of the mounting point S about the axis of rotation D, preferably changes a relative position of the mounting point S and of the axis of rotation D with respect to one another. A relative position of the at least one transport means 204 is preferably configured to be changeable and/or to be changed and/or is changed by the relative adjustment, preferably pivoting, of the mounting point S and of the axis of rotation D, more preferably a pivoting of the mounting point S about the axis of rotation D, with respect to one another.

The at least one infeed system 202 preferably comprises the at least one servo drive 218. The infeed system 202 preferably comprises at least two cam mechanisms, which are arranged parallel to one another in the transport direction T, on the at least one drive shaft 1002 and/or preferably at least one servo drive, preferably two servo drives 218, which are independent of the drive shaft 1002 and are preferably each assigned to one of the cam mechanisms. The at least one servo drive 218 is preferably configured as a hand wheel or a mechanical drive or an electric drive, preferably as an actuator and/or an electric motor. The at least one servo drive 218 is preferably independent of, preferably mechanically independent of, more preferably mechanically decoupled from, the at least one drive 1001, in particular independent of the drive system 1000 of the processing machine 01. The at least one servo drive 218 is preferably configured to intervene and/or intervenes in the at least one cam mechanism of the infeed system 202, in particular in a respective cam mechanism assigned to the servo drive.

The at least one servo drive 218 is preferably connected via at least one rocking lever 217 to the mounting point S of the at least one drive lever 214. The rocking lever 217 is preferably arranged to pivot about the axis of rotation D of the drive shaft 1002. The at least one servo drive 218 is preferably configured to pivot the at least one rocking lever 217 about the axis of rotation D of the drive shaft 1002.

The at least one servo drive 218 is preferably configured to adjust, preferably pivot, the mounting point S relative to the axis of rotation D. The at least one servo drive 218 is preferably configured to adjust, preferably pivot, the mounting point S of the at least one drive lever 214 relative to the axis of rotation D of the drive shaft 1002 and/or of the axis of rotation D of the at least one cam disk 212, and/or adjusts, preferably pivots, these relative to one another. The mounting point S and the axis of rotation D are preferably arranged to be pivotable and/or to be pivoted and/or to pivot and/or are pivoted relative to one another by the at least one servo drive 218. The mounting point S and the axis of rotation D are preferably arranged to be pivotable and/or to be pivoted and/or are pivoted relative to one another as a function of a detection of the respective, preferably the at least one, sheet 02 by the at least one sensor device 251. The mounting point S is preferably arranged to pivot about the axis of rotation D. More preferably, the at least one mounting point S has a fixed relative position with respect to the at least one rocking lever 217 and is preferably arranged to pivot and/or to be pivotable and/or to be pivoted about the axis of rotation D together with the relevant at least one rocking lever 217.

As a result of the open-loop and/or closed-loop control of the at least one servo drive 218, a movement that is transmitted from the at least one drive shaft 1002 to the at least one transfer means 204 can preferably be at least temporarily superimposed and/or is superimposed by a movement that is transmitted from the at least one servo drive 218. As a result of the open-loop and/or closed-loop control of the at least one servo drive 218, a movement that is transmitted from the at least one drive shaft 1002 to the at least one transfer means 204 can preferably be at least temporarily superimposed and/or is superimposed by a movement that is transmitted from the at least one servo drive 218 to the at least one transfer means 204. A movement that is transmitted from the at least one drive shaft 1002 to the at least one transfer means 204 is preferably superimposed by a movement of the at least one servo drive 218, and thus, preferably, at least one position error of the respective sheet 02, preferably of the at least one sheet 02 of the sheets 02, can be compensated for and/or is compensated for. The at least one servo drive 218 is preferably configured to intervene in a movement that is transmitted from the at least one drive shaft 1002, preferably generated by the at least one drive 1001, to the at least one transport means 204, preferably to change this movement, more preferably to superimpose this movement, and/or intervenes.

The at least one transport means 204 preferably transports sheets 02 from the alignment position PA to the transfer position PU. The transport path of the at least one sheet 02 is preferably horizontal. The transport movement of the at least one transport means 204, in particular from the alignment position PA to the transfer position PU, preferably takes place in a plane, preferably spanned by the transport direction T and the transverse direction A, more preferably horizontally. The sheet processing machine 01 preferably comprises the at least one transport system 1200 arranged downstream from the at least one infeed system 202 in the transport direction T, preferably including the at least two holding elements 1202 that are spaced apart from one another orthogonally to the transport direction T. The respective holding element 1202 of the transport system 1200 is preferably spaced apart from an assigned transfer element 206; 207 of the transport means 204 in the transfer position PU, in each case at a first distance. in the transport direction T. One of the at least two holding elements 1202 is in each case preferably spaced apart from an assigned transfer element 206; 207 in the transfer position PU at a first distance in the transport direction T.

By adjusting, preferably pivoting, the mounting point S and the axis of rotation D relative to one another, the one holding element 1202 of the at least two holding elements 1202 is preferably spaced apart from the assigned transfer element 206; 207 at a second distance in the transfer position PU. By adjusting the mounting point S of the at least one drive lever 214 and the axis of rotation D relative to one another, the respective holding element 1202 of the transport system 1200 is spaced apart from the respective assigned transfer element 206; 207 at a second distance in the transport direction T in the transfer position PU. In particular, the second distance for two holding elements 1202 of the transport system 1200, which are spaced apart from one another in the transverse direction A, differs with respect to the respective assigned transfer element 206; 207. The second distance of two holding elements 1202 that are spaced apart from one another in the transverse direction A preferably differs in particular when the gripper shaft 221 is not arranged parallel to the transverse direction A and/or is arranged in a direction that differs from the transverse direction A. The respective second distance is preferably different from the first distance.

The mounting point S and the axis of rotation D are preferably adjusted relative to one another and/or can be adjusted relative to one another by the at least one servo drive 218, in particular at least by the at least one servo drive 218 assigned for the transport of sheets 02, more preferably by the at least one servo drive 218 intervening in the at least one cam mechanism. The mounting point S and the axis of rotation D are preferably adjusted relative to one another and/or can be adjusted relative to one another as a function of the detection of the preferably at least one respective sheet 02 by the sensor device 251, in particular by the at least one sensor 252, preferably the at least two sensors 252, of the sensor device 251. The at least one transport means 204 can be adjusted and/or adjusts and/or is adjusted in the transport direction T and/or transverse direction A as a function of the detection by the at least one sensor device 251.

The at least one drive lever 214 preferably scans the at least one rotational movement of the at least one cam mechanism by way of the at least one scanning element 213. Preferably in addition or as an alternative, the at least one drive lever 214 converts the at least one rotational movement of the at least one cam mechanism into at least one linear movement of the at least one transfer means 204.

The sheet 02, preferably the at least one sheet 02, preferably comprises the at least one printing mark 11, preferably at least two printing marks 11, more preferably at least three printing marks 11. Above and below, a printing mark 11 is a mark, for example, for monitoring a color register and/or a perfecting register and/or preferably for aligning the sheet 02 in the transport direction T and/or transverse direction A. The at least one printing mark 11 is preferably configured as a mark for monitoring a color register, preferably as an element for color management, preferably for zonal color measurement, and/or for monitoring a perfecting register and/or preferably for aligning, in particular for a position determination on which the alignment is based, the at least one sheet 02 in the transport direction T and/or in the transverse direction A.

The at least one sheet 02 preferably comprises at least one element for color management, preferably at least two elements, more preferably at least four elements, more preferably at least as many elements as there are printing colors that are used to generate the print image. Preferably at least one, preferably at least two, more preferably at least three, more preferably at least four, of the colors black and/or yellow and/or red and/or blue and/or green and/or cyan and/or magenta and/or special colors are used and/or are contained in at least one print image of the at least one sheet 02. Each of the at least one element for color management preferably has a printing color. The at least one element for color management is preferably configured for zonal color measurement, preferably at least one measurement of the color density, for example the optical color density and/or the spectral color density, for example by densitometry, and/or a measurement of at least one spectral value, for example by spectrophotometry, and/or a measurement of the area coverage of the preferably individual printed printing colors. The at least one sensor device 251 and/or at least one sensor 252 are preferably configured to evaluate and/or detect the at least one element for color management.

The at least one sheet 02 preferably includes at least one print control strip, also referred to as color control strip. The at least one print control strip preferably comprises the at least one element for color management, more preferably at least two elements for color management, more preferably at least four elements for color management, preferably elements for color management for solid colors and/or halftone and/or gray balance and/or solid color overlap print. The at least one print control strip preferably comprises at least one element for color management and/or at least one, preferably at least two, more preferably at least four, print register elements, for example at least one register element used to set at least one printing couple, and/or at least one, preferably at least two, printing marks 11, preferably at least one printing mark 11 at least for aligning the at least one sheet 02 in the sheet processing machine 01, for example in the at least one infeed system 202. The at least one print register element is preferably configured to monitor a color register and/or a perfecting register. The at least one element for color management and the at least one print register element and the at least one printing mark 11 are preferably different elements of the at least one print control strip. As an alternative, for example, the at least one printing mark 11 is configured both to align the sheet 02 in the transport direction T and/or transverse direction A, and as at least one element for color management and/or as a print register element, for example for monitoring a color register and/or a perfecting register.

The at least one print control strip is preferably positioned on the at least one sheet 02 in a region outside the at least one print image and/or in an edge region of the at least one sheet 02 and/or preferably in the region of the leading edge 07 and/or preferably spaced apart from the leading edge 07. As an alternative, for example, the at least one print control strip is integrated into at least one print image of the at least one sheet 02.

The at least one sheet 02 is preferably fed to the sheet processing machine 01 in such a way that the at least one printing mark 11 and/or the at least one print control strip are preferably positioned, on the at least one sheet 02, at the front in the transport direction T and/or preferably in the region of the leading edge 07 and/or preferably spaced apart from the leading edge 07 and/or on the upper side and/or on the underside.

Preferably, the at least one printing mark 11, preferably the at least two printing marks 11, are integrated into the at least one print control strip. For example, at least two printing marks 11 are integrated into the at least one print control strip, wherein the at least two printing marks 11 are preferably spaced apart from one another and/or wherein preferably at least one element for color management is arranged between the at least two printing marks 11 and/or wherein the at least two printing marks 11 are preferably arranged symmetrically with respect to an axis of symmetry of the print control strip. As a result of the integration of the at least one printing mark 11 into the at least one print control strip, space is preferably saved on the sheet 02 and/or additional printing marks 11 can be saved, in addition to the at least one print control strip. For example, the at least one printing mark 11 is surrounded by at least one unprinted and/or differently colored, for example white, and/or unicolor region, in particular when the at least one printing mark 11 is integrated into the at least one print control strip. In this way, the contrast preferably increases, and/or the at least one printing mark 11 can be identified more easily compared to a printing mark 11 that is not surrounded by an unprinted and/or differently colored region.

The respective, preferably the at least one, sheet 02 preferably comprises the at least one printing mark 11 in a region outside the at least one print image. The at least one sheet 02 preferably comprises at least two printing marks 11, which are preferably arranged parallel to one another along the leading edge 07 of the at least one sheet 02, i.e., next to one another in the transport direction T, and/or are spaced apart from one another and/or, preferably additionally, are spaced apart from the leading edge 07. Preferably a respective sheet 02, preferably the at least one sheet 02, comprises at least two printing marks 11, which are arranged parallel to one another along the leading edge 07 of the sheet 02 and are spaced apart from one another and preferably additionally are spaced apart from the leading edge 07. For example, the at least one printing mark 11 is spaced at least 5 mm (five millimeters), preferably at least 10 mm (ten millimeters), and/or no more than 20 mm (twenty millimeters), preferably no more than 15 mm (fifteen millimeters) apart from the at least one edge 07; 09 of the at least one sheet 02, preferably from the leading edge 07. Preferably a respective sheet 02, preferably the at least one sheet 02, comprises at least one further printing mark 11, which is arranged at a smaller distance from at least one side edge 09 of the sheet 02 than from its leading edge 07.

As an alternative or in addition, for example, the at least one printing mark 11 is configured as at least a portion of the at least one print image. For example, the at least one print image comprises at least one element that is distinguishable from its surrounding environment, which preferably acts as a printing mark 11. As a result of the at least one element, a contrast is preferably present in the print image, which can be evaluated and/or is evaluated by the at least one sensor device 251. In particular, the detection zone 253 of the at least one sensor 252, for example of the at least two sensors 252, is directed at the at least one print image, in particular at the at least one element of the print image which is distinguishable from its surrounding environment. The at least one sensor device 251, preferably at least one sensor 252 of the at least two sensors 252, is preferably configured to detect and/or detects the at least one printing mark 11, wherein the at least one printing mark 11 is configured as at least one element of the at least one print image of the at least one sheet 02 which is distinguishable from its surrounding environment.

The at least one sheet 02 preferably comprises at least the at least one, more preferably at least two, more preferably at least four, printing marks 11. For example, the at least one sheet 02 comprises the at least one printing mark 11 in a region outside the at least one print image and/or in an edge region of the at least one sheet 02 in the region of the leading edge 07 and/or preferably spaced apart from the edge 07 of the at least one sheet 02 which is configured as the leading edge 07. For example, the at least one sheet 02 comprises at least one printing mark 11 for each printing color used and/or for each printing couple used, for example the printing couple of the processing machine 01 or the printing couple of a printing press arranged upstream from the processing machine 01. For example, the processing machine 01 comprises at least one, preferably two, more preferably at least four, printing couples printing the at least one sheet 02. The at least one printing couple is preferably arranged upstream from the at least one shaping unit 300, more preferably upstream from the at least one infeed unit 200.

The at least one printing mark 11 preferably comprises at least one two-dimensional element, preferably at least one line-shaped element. For example, the at least one printing mark 11 is configured in each case as a bar and/or a cross and/or a rectangle and/or a QR code. A sheet 02, preferably the at least one sheet 02, preferably comprises at least one printing mark 11 for each printing color with which the respective sheet 02 is at least partially printed. As an alternative, a respective printing mark 11 is composed of preferably at least two, preferably all, printing colors that are used. The at least one printing mark 11 is preferably configured as a rectangle, more preferably as a square. As an alternative, for example, the at least one printing mark 11 is configured as a dot or a circle. A simple and rapid evaluation of the at least one printing mark 11 preferably takes place when the printing mark has at least one straight edge or side, in particular when it is configured as a rectangle and/or a square. The at least one printing mark 11 is preferably filled with printing color, for example black. Preferably, at least one side and/or axis of the at least one printing mark 11 is arranged parallel to the leading edge 07 of the at least one sheet 02 and/or parallel to the transverse direction A. Preferably, at least one side and/or axis of the at least one printing mark 11 is arranged parallel to the side edge 09 of the at least one sheet 02 and/or parallel to the transport direction T. If the at least one printing mark 11 is configured as a rectangle, for example, preferably a square, at least one side is preferably arranged parallel to the transport direction T and at least one side is arranged parallel to the transverse direction A. If the at least one printing mark 11 is configured as a cross, for example, at least one axis, for example the longitudinal axis, is preferably arranged parallel to the transport direction T, and at least one axis, for example the transverse axis, is arranged parallel to the transverse direction A. The at least one printing mark 11 preferably enables a plurality of measurement points, which can be used to evaluate position information of the at least one sheet 02. The arrangement of the at least one printing mark 11 and/or the configuration as a rectangle, preferably a square, and/or the configuration as a cross preferably increase the accuracy of the evaluation of the at least one printing mark 11. The at least one printing mark 11 preferably has a surface area of at least 1.5 $mm^2$ (one point five square millimeters), more preferably at least 1.8 $mm^2$ (one point eight square millimeters), more preferably at least 1.9 $mm^2$ (one point nine square millimeters), more preferably at least 2.5 $mm^2$ (two point five square millimeters). The at least one printing mark 11 preferably has a surface area of no more than 25 $mm^2$ (twenty-five square millimeters), more preferably no more than 22 $mm^2$ (twenty-two square millimeters), more preferably no more than 20 $mm^2$ (twenty square millimeters), more preferably no more than 17 $mm^2$ (seventeen square millimeters). In this way, it is preferably possible to optimally detect the at least one printing mark 11 since blurring of the edge regions of the printing mark 11 is minimized and/or since the surface area generates sufficient contrast compared to its surrounding environment.

The at least one printing mark 11 is preferably configured so that the position of the at least one sheet 02 in the transport direction T and/or in the transverse direction A is preferably determined and/or can be determined by the at least one printing mark 11. Preferably, the position of the at least one sheet 02 in the transport direction T and in the transverse direction A is determined and/or can be determinable by the at least one printing mark 11. More preferably, the position of the at least one sheet 02 in the transport direction T and/or in the transverse direction A is determined and/or can be determined by at least two printing marks 11, more preferably by no more than four printing marks 11, more preferably by two printing marks 11, the at least two printing marks 11 preferably being positioned on the at least one sheet 02 in a region along the leading edge 07 of the at least one sheet 02 and/or the at least two printing marks 11 preferably being positioned on the at least one sheet 02 parallel next to one another in the transport direction T and/or the at least two printing marks 11 being integrated into the at least one print control strip. For example, the at least two printing marks 11 are sufficient and/or, in addition to the at least two printing marks 11, preferably no further printing mark 11, for example lateral printing mark 11, is necessary to determine the position of the at least one sheet 02, in particular in the transverse direction A.

Above and below, a distance between two surface areas or between two points or between one surface area and one point or between one direction and one further element describes the shortest connection between these two elements.

A sheet 02 to be transported by the infeed unit 200, preferably the at least one sheet 02, for example, has at least one position error when arriving at the alignment position PA. The position error of a sheet 02 describes a deviation of its positioning along the transport path relative to a target positioning. This is the case, for example, in the case of a position error in the transport direction T when the time at which the leading edge 07 and/or at least one printing mark 11 of the sheet 02 actually arrive at the alignment position PA deviates from an expected and/or required time at which the leading edge 07 and/or at least one printing mark 11 of the sheet 02 arrive. For example, if a sheet 02 arrives at the alignment position PA at a later time than expected and/or required, its leading edge 07 and/or the relevant at least one printing mark 11 are situated upstream from the expected and/or required position in the transport direction T at the expected and/or required time. For example, a position error of the sheet 02 also exists in the case of a skewed position of the sheet 02. In the case of a skewed position of the sheet 02, for example, its leading edge 07 has an angle of greater than 0° (zero degrees) with respect to the transverse direction A and/or its side edges 09 have an angle of greater than 0° (zero degrees) with respect to the transport direction T. In the case of a skewed position of the sheet 02, at least two printing marks 11 arranged parallel to and spaced apart from one another along the leading edge 07 of the sheet 02 have different coordinates along the transport direction T. In this way, at least one of the relevant printing marks 11 is arranged upstream from the respective, at least one further printing mark 11 in the transport direction T. An in particular lateral position error also exists when the sheet 02 is arranged displaced with respect to its expected and/or required position in the transverse direction A.

A respective sheet 02, preferably the at least one sheet 02, is preferably roughly aligned by the at least two front lay marks 203 arranged horizontally parallel to one another in the transport direction T of sheets 02. The rough alignment describes a reduction of the position error relative to the expected and/or required positioning of the sheet 02, due to the sheet 02 striking against the at least two front lay marks 203 in the alignment position PA. A sheet 02 is preferably fixed during the rough alignment, at least in the vertical direction V, in particular by the at least one transport means 204.

Preferably in addition or as an alternative, a respective, preferably the at least one, sheet 02 is finely aligned by adjusting the mounting point S and the axis of rotation D relative to one another. The at least one feed system 202 is preferably configured to finely align the at least one sheet 02 by adjusting the mounting point S and the axis of rotation D relative to one another. In addition, or as an alternative, the respective, preferably the at least one, sheet 02 is more preferably finely aligned by adjusting, preferably pivoting, the mounting point S and the axis of rotation D relative to one another. As a result of the fine alignment of the sheet 02, it is ensured that the sheet 02, in the transfer position PU, is transferred, while maintaining register accuracy, to the at least one holding element 1202 of the transport system 1200. The relative position of the at least one transport means 204 is preferably changed during the alignment of the sheet 02. A finely aligned sheet 02 is preferably situated in its expected and/or required position at the expected and/or required time, preferably with only minimal deviation of the position from the expected and/or required position, more preferably without any deviation of the position.

A position displacement of the mounting point S relative to the axis of rotation D is preferably configured to compensate for and/or compensates for at least one position error of the at least one sheet 02. To compensate for a position error of the at least one sheet 02, the mounting point S and the axis of rotation D can preferably be configured to be movable and/or to move and/or to be adjustable and/or to be adjusted and/or to adjust relative to one another. The at least one drive lever 214 is preferably deflected by an at least partial rotation of the at least one cam disk 212, preferably pivoted about its mounting point S. The deflection of the at least one drive lever 214 as a result of the at least partial rotation of the at least one cam disk 212 is preferably configured to move the at least one transport means 204 in and/or counter to the transport direction T. As a result of a position displacement of the mounting point S of the at least one drive lever 214 and of the axis of rotation D of the at least one cam disk 212 relative to one another, at least one position error of the respective sheet 02, in particular at least one position error of the leading edge 07 and/or of at least one printing mark 11 in the transport direction T and/or due to a skewed position of the respective sheet 02 can preferably be compensated for and/or is compensated for, in addition to a deflection of the at least one drive lever 214, as a result of an at least partial rotation of the at least one cam disk 212. The at least one cam mechanism is preferably driven by the drive system 1000, preferably by means of the at least one drive 1001, more preferably by means of the at least one drive shaft 1002, preferably continuously. The at least one servo drive 218 preferably adjusts the position of the mounting point S relative to the position of the axis of rotation D, preferably while the operating situation of the cam mechanism is being maintained by the drive system 1000.

The at least one servo drive 218 preferably adjusts the position of the mounting point S relative to the position of the axis of rotation D, preferably while the at least one cam mechanism 212 is being driven, preferably rotated, by the at least one drive shaft 1002, preferably by the at least one drive 1001.

The at least one infeed system 202 preferably comprises at least two cam mechanisms. The at least one infeed system 202 preferably comprises at least two cam mechanisms at the at least one drive shaft 1002, which are arranged parallel to one another in the transport direction T. Preferably, the at least two cam mechanisms simultaneously pick up the driving torque from the at least one drive shaft 1002. In addition, or as an alternative, the at least one infeed system 202 preferably comprises at least two servo drives 218 which are independent of the drive shaft 1002 and which are preferably assigned to one of the cam mechanisms. Preferably in addition or as an alternative, the at least one infeed system 202 comprises the at least two servo drives 218, which are preferably operated independently of the at least one drive 1001. Each of the at least two servo drives 218 is preferably configured to intervene in one of the at least two cam mechanisms, preferably to adjust the mounting point S relative to the axis of rotation.

At least one servo drive 218 is preferably activated and/or controlled by closed-loop control at least during a compensation for a skewed position of the sheet 02. The at least one servo drive 218 preferably generates a larger relative displacement of the mounting point S and of the axis of rotation D with respect to one another than a further servo drive 218, which is preferably activated and/or controlled by closed-loop control at the same time. The at least one servo drive 218 is preferably configured to be activatable and/or to be activated and/or to be controllable by closed-loop control and/or to be controlled by closed-loop control at least during a compensation for a skewed position of the sheet 02.

Preferably in addition or as an alternative, at least two servo drives 218 are configured to be activatable and/or activated and/or controllable by closed-loop control and/or controlled by closed-loop control and/or are activated and/or are controlled by closed-loop control, at least during a compensation for a position error in the transport direction T. Preferably, each of the at least two servo drives 218 generates an identical relative displacement of the mounting point S and the axis of rotation D with respect to one another.

The sheet 02 is preferably finely aligned laterally, preferably in the transverse direction A, to compensate for a lateral position error. In the case of a lateral fine alignment of the sheet 02 orthogonal to the transport direction T, in particular and/or in the transverse direction, at least the at least one transport means 204 of the infeed system 202 is preferably adjusted horizontally and orthogonally to the transport direction T, via at least one servo drive 237, which is preferably independent of the at least one drive shaft 1002, more preferably of the at least one drive 1001, of the lateral alignment. For example, the at least one coupler 216 is adjusted in the transverse direction A, at its connection to the at least one transport means 204, out of its existing position in the transverse direction A, while the connecting point 219 preferably remains in its position in the transverse direction A. For example, the at least one coupler 216 comprises at least one self-aligning bearing for this purpose. The respective sheet 02 is preferably adjusted horizontally and orthogonally to the transport direction T, as a function of the preferably selective detection of the at least one printing mark 11, preferably of the at least one lateral printing mark 11 and/or the at least one side edge 09 of the sheet 02. The at least one servo drive 237 of the lateral alignment is preferably configured as a hand wheel or a mechanical drive or an electric drive, preferably as an actuator and/or a linear motor and/or an electric motor. During a lateral alignment of the at least one sheet 02 of the sheets 02, the control system 1100 and/or the at least one sensor device 251 are preferably configured to activate the at least one servo drive 237 of the lateral alignment, preferably as a function of the at least one sensor device 251, in particular the detection of the sheet 02 by the at least one sensor device 251.

By adjusting the at least one coupler 216 in the transverse direction A, the path of the sheet 02, which it covers from the alignment position PA to the transfer position PU along the transport path, is at least partially shortened, in particular at the location of the adjusted coupler 216.

Preferably in addition or as an alternative, the at least one infeed unit 200 comprises at least one pulling device 238 for a lateral alignment of sheets 02. At least one support of the at least one pulling device 238, which is preferably configured as a vacuum plate 273, preferably seizes the relevant sheet 02, which is to be laterally aligned. Preferably, the relevant sheet 02 is moved, preferably pulled, against at least one lateral stop 272 of the at least one pulling device 238, in particular by the at least one vacuum plate 273. The at least one lateral stop 272 is preferably adapted to the format width of the sheet 02. The relevant sheet 02 is preferably only moved with respect to the transverse direction A during the lateral movement to the at least one lateral stop 272. Preferably, at least one lateral stop 272 is positioned on each of the two sides of the transport path. The pulling device 238 is preferably configured so that the relevant sheet 02 is moved and/or can be moved in and/or counter to the transverse direction A. The relevant sheet 02 is preferably at least roughly aligned with respect to the transverse direction A by the at least one pulling device 238.

The at least one infeed system 202 of the sheet processing machine 01 preferably comprises the at least one transport means 204, which is, in particular, configured as a holding means 204, preferably as a gripper 204, and which includes the at least one upper holder 206 and the at least one lower holder 207. The at least one holding surface 233; 234 of at least one holder 206; 207, preferably at least the at least one upper holder 206, is preferably configured to at least temporarily pivot and/or be pivotable and/or be pivoted about the at least one gripper shaft 221, preferably configured as a pivot axis 221, of the relevant holder 206; 207, preferably of the at least one upper holder 206. The at least one holding surface 233; 234 of at least one holder 206; 207 preferably pivots and/or is pivotable, preferably at least temporarily, about the at least one pivot axis 221 of the relevant holder 206; 207. The at least one lower holder 207 is preferably rigidly arranged within the at least one infeed system 202, and the at least one upper holder 206 is arranged to pivot and/or to be pivotable about the pivot axis 221.

Preferably, the at least one holding means 204, in particular the at least one transport means 204, preferably the at least one gripper 204, can be arranged and/or is arranged in at least three states. The at least one transport means 204 preferably has a minimally closed state, and a maximally closed state, and at least a mean state and/or is arranged and/or can be arranged in these states. The at least one upper holder 206 preferably has a maximum distance with respect to the at least one lower holder 207 in the minimally closed state, a minimal distance in the maximally closed state, and at least a mean distance in the at least one mean state.

A minimally closed state of the at least one holding means 204, in particular of the at least one transport means 204, preferably corresponds to a maximum distance between at least one upper holding surface 233 of the at least one respective upper holder 206 and at least one lower holding surface 234 of the lower holder 207 assigned to the respective upper holder 206. The minimally closed state of the at least one holding means 204 preferably corresponds to a maximally open state of the holding means 204. Preferably, the distance between the at least one upper holding surface 233 and the at least one assigned lower holding surface 234 in the minimally closed state of the at least one transport means 204, preferably holding means 204, is preferably at least greater than twice the thickness of a sheet 02 to be transported. Preferably, the distance between the at least one upper holding surface 233 and the at least one assigned lower holding surface 234 in the minimally closed state of the at least one holding means 204 is preferably at least greater than twice the thickness of a sheet 02 to be transported, so that the position of the respective sheet 02, in particular the leading edge 07 of the sheet 02, can preferably be at least partially moved in the transport direction T and/or in the transverse direction A and/or in the vertical direction V.

A maximally closed state of the at least one holding means 204 preferably corresponds to a minimum distance between the at least one upper holding surface 233 of the at least one respective upper holder 206 and the at least one lower holding surface 234 of the lower holder 207 assigned to the respective upper holder 206. Preferably, the distance between the at least one upper holding surface 233 and the at least one assigned lower holding surface 234 in the maximally closed state of the at least one transport means 204, preferably holding means 204, is preferably not greater than the thickness of a sheet 02 to be transported. Preferably, the distance between the at least one upper holding surface 233 and the at least one assigned lower holding surface 234 in the maximally closed state of the at least one holding means 204 is preferably not greater than the thickness of a sheet 02 to be transported, so that the position of the respective sheet 02, in particular of the leading edge 07 of the sheet 02, in the transport direction T and/or in the transverse direction A and/or in the vertical direction V is preferably completely fixed.

At least one mean state of the at least one holding means 204 preferably corresponds to at least a mean distance between the at least one upper holding surface 233 of the at least one respective upper holder 206 and the at least one lower holding surface 234 of the lower holder 207 assigned to the respective upper holder 206. In the mean state of the at least one holding means 204, the position of the respective sheet 02 is preferably fixed at least partially, preferably at least partially in the vertical direction V, more preferably completely in the vertical direction V. In a mean state of the at least one holding means 204, the respective sheet 02 is preferably configured to be movable and/or to move at least partially, preferably at least in the transport direction T and/or transverse direction A. The at least one mean state of the at least one transport means 204, preferably of the at least one holding means 204, preferably differs both from the maximally closed state and from the minimally closed state of the at least one transport means 204.

The state of the at least one holding means 204 is preferably dependent on the rotation of the drive shaft 1002 about its axis of rotation D. The state of the at least one holding means 204 preferably changes at least once during a machine cycle. The at least one holding means 204, preferably the at least one transport means 204 preferably configured as a holding means 204, preferably has the minimally closed state at least once, and the maximally closed state at least once, and the at least one mean state at least once during a machine cycle. The at least three states, these being the maximally closed state, the minimally closed state, and the at least one mean state, preferably occur during a machine cycle.

In the alignment position PA, preferably at least during a rough alignment of sheets 02 and/or preferably during a lateral alignment of sheets 02, the at least one transport means 204 preferably at least temporarily has the at least one mean state, preferably the at least one mean distance between the at least one upper holder 206 and the at least one lower holder 207 and/or the at least one mean distance between the holding surfaces 233, 234. Preferably, in the alignment position PA, the at least one transport means 204 preferably at least temporarily has the maximally closed state, preferably the minimal distance between the at least one upper holder 206 and the at least one lower holder 207 and/or the minimal distance between the holding surfaces 233, 234, preferably after being arranged in the at least one mean state, more preferably at least during a detection of the at least one sheet 02 by the at least one sensor device 251. Preferably, the at least one transport means 204 has the maximally closed state at least during its movement from the alignment position PA to the transfer position PU. Preferably, the at least one transport means 204 has the minimally closed state, preferably the maximal distance between the at least one upper holder 206 and the at least one lower holder 207 and/or the maximal distance between the holding surfaces 233, 234, at least while being moved from the transfer position PU to the alignment position PA, preferably at least while the at least one transport means 204 is being returned to the alignment position PA.

At the alignment position PA, preferably the at least one holding means 204, preferably the at least one transport means 204, preferably at least temporarily has the at least one mean state, in particular a mean distance between the holding surfaces 233; 234, for a rough alignment of sheets 02. The at least one holding means 204, preferably the at least one transport means 204, preferably at the alignment position PA, is at least temporarily arranged at the at least one mean distance between the at least one upper holding surface 233 of the at least one respective upper holder 206 and the at least one lower holding surface 234 of the respective lower holder 207 assigned to the respective upper holder 206, preferably in the at least one mean state, during the rough alignment of sheets 02. The at least one mean state preferably corresponds to a holding down of sheets 02, in particular of the leading edge 07 of the sheet 02, which at least partially, preferably completely, fixes the respective sheet 02, in particular the leading edge 07 of the sheet 02, in the vertical direction V, and/or which only allows a movement of the respective, preferably of the at least one, sheet 02, in particular of the leading edge 07 of the sheet 02, in the transport direction T and/or the transverse direction A, preferably in a horizontal plane. The at least one transport means 204 is preferably at least temporarily, preferably at least during a rough alignment of the at least one sheet 02 and/or during a lateral alignment of the at least one sheet 02, arranged in the at least one mean state, preferably is fixed in this state, more preferably is immobilized in this state.

The distance between the at least one upper holder 206 and the at least one lower holder 207 in the at least one mean state of the at least one transport means 204 is preferably greater than the thickness of the at least one sheet 02, preferably the sheet to be transported. Preferably, the distance between the at least one upper holder 206 and the at least one lower holder 207, preferably the distance between the at least one upper holding surface 233 and the at least one assigned lower holding surface 234, in the at least one mean state of the holding means 204, preferably of the at least one transport means 204, is preferably at least greater than the thickness of a sheet 02 to be transported, preferably one and half times, more preferably at least twice as large as the thickness of a sheet 02 to be transported. The at least one mean distance between the at least one upper holding surface 233 and the at least one assigned lower holding surface 234 is preferably at least greater than the thickness of a sheet 02 to be transported, preferably one and half times, more preferably at least twice as large as the thickness of a sheet 02 to be transported.

Preferably, the at least one mean state, preferably the at least one mean distance between the at least one upper holding surface 233 of the at least one upper holder 206 and the at least one lower holding surface 234 of the lower holder 207 assigned to the at least one upper holder 206, is adapted to a maximum thickness of sheets 02 and/or set accordingly to a maximum thickness of the sheets 02 to be transported. Preferably, the at least one mean distance between the at least one upper holding surface 233 of the at least one respective upper holder 206 and the at least one lower holding surface 234 of the lower holder 207 assigned to the respective upper holder 206, is adapted to a maximum thickness of sheets 02, in particular which are preferably at least partially transported by the sheet processing machine 01 at this time and/or which are preferably arranged within the infeed system 202 at this time. Preferably, the at least one mean state, preferably the at least one mean distance, is set at least once for each processing job and/or is set according to the present processing order.

The at least one pivotable holding surface 233; 234, preferably the at least one holding surface 233 of the upper holder 206, is preferably functionally connected to the at least one drive shaft 1002, preferably to the at least one drive 1001, in particular via at least one gear mechanism. Preferably, the at least one pivotable holding surface 233; 234, preferably the at least one holding surface 233 of the upper holder 206, is functionally connected to at least one opening element 223, configured as a cam disk 223, via at least one scanning lever 226. Preferably, at least one scanning element 224 of the at least one scanning lever 226 is configured to rest permanently without clearance against the at least one cam disk 223. Preferably, the at least one scanning element 224 is configured to rest permanently without clearance against the at least one cam disk 223 as a result of at least one spring, preferably a compression spring, at the scanning lever 226 and/or a preload of the scanning lever 226. The at least one sensing element 224 is preferably configured as a roller and/or is configured to carry out a rolling motion at the at least one cam disk 223.

At least one of the cam mechanisms of the infeed system 202 preferably comprises the at least one cam disk 223. For example, the at least one cam mechanism that comprises the at least one cam disk 223 is different from the cam mechanism that is configured to transmit the movement in and/or counter to the transport direction T of the at least one transport means 204. Preferably, the at least one cam mechanism that comprises the at least one cam disk 223 is configured to set the state of the at least one transport means 204.

The at least one cam disk 223 is preferably arranged at the at least one drive shaft 1002 and is configured to rotate about the axis of rotation D thereof, in particular rotating together with the relevant drive shaft 1002. The at least one cam disk 223 is preferably concentrically arranged about the at least one drive shaft 1002. The at least one pivotable holding surface 233; 234, preferably the at least one holding surface 233 of the upper holder 206, preferably has the respective state corresponding to the angle of rotation of the drive shaft 1002, and thus the angle of rotation of the at least one cam disk 223 about the axis of rotation D. The state of the at least one transport means 204, preferably the distance between the at least one upper holder 206 and the at least one lower holder 207 of the at least one transport means 204, is preferably set and/or settable via the at least one cam disk 223. The at least one cam mechanism, preferably the at least one cam disk 223, preferably by a rotation of the at least one drive shaft 1002 and/or by virtue of the at least one drive 1001, is preferably configured to set and/or sets the state, preferably the maximally closed state and the minimally closed state and the at least one mean state, of the at least one transport means 204.

Preferably, the at least one scanning lever 226 is coupled via at least one transmission shaft 227 to the pivot axis 221 of the relevant holder 206; 207, preferably the at least one upper holder 206. More preferably, the at least one scanning lever 226 is coupled via at least one transmission shaft 227 to the pivot axis 221 of the relevant holder 206; 207, preferably the at least one upper holder 206, wherein the at least one transmission shaft 227 is arranged eccentrically in at least one adjusting shaft 228. The at least one transmission shaft 227 is preferably functionally connected via the at least one scanning lever 226 to the at least one cam disk 223 and/or the at least one drive shaft 1002. The at least one transmission shaft 227 is preferably functionally connected via at least one coupler 222 and/or at least one transmission lever 229, preferably via both at least one coupler 222 and at least one transmission lever 229, to the at least one pivot axis 221.

The scanning lever 226 is preferably arranged to pivot about the axis of rotation U of the at least one transmission shaft 227. The at least one transmission lever 229 is preferably connected to the transmission shaft 227 and arranged to pivot about the axis of rotation U thereof. The at least one coupler 222 is preferably connected to the at least one transmission lever 229. In the case of pivoting of the transmission lever 229, the coupler 222 preferably has an at least partial movement, preferably an at least primarily linear movement, with the main component in and/or counter to the vertical direction V. For example, the at least one coupler 222 is connected via at least one connecting lever 236 and/or at least one bearing to the at least one pivot axis 221. In the case of an at least partial linear movement of the at least one coupler 222, the pivot axis 221, which is preferably configured as a gripper shaft 221, is preferably made to at least partially rotate and/or at least partially pivot by way of the at least one connecting lever 236. The at least partial rotation and/or the at least partial pivoting of the gripper shaft 221 preferably generates a change in the state of the at least one holding means 204.

The at least one cam disk 223 preferably comprises at least three regions, wherein regions abutting one another have different radii. As a result of the different radii of the individual regions of the at least one cam disk 223, the distance between the axis of rotation D of the drive shaft 1002 and the center of gravity of the assigned at least one scanning element 224 is at least partially changed for the respective regions as a function of the present angle of rotation of the drive shaft 1002 and/or cam disk 223. The at least one cam disk 223 preferably has at least three different radii with respect to the axis of rotation D of the drive shaft 1002 along its circumference. A cam function of the circumference of the at least one cam disk 223 is preferably continuous, preferably continuously differentiable, in all points along its arc length. For example, the at least one cam disk 223, along its circumference, includes at least one depression and/or at least one elevation and/or at least one lobe with respect to the surrounding regions.

The respective regions of the at least one cam disk 223 preferably each correlate with a state of the at least one holding means 204, preferably of the at least one transport means 204. In the case of the minimally closed state of the at least one holding means 204, the at least one scanning element 224 is preferably arranged at the region of the cam disk 223 that has a maximal radius. In the case of the maximally closed state of the at least one holding means 204, the at least one scanning element 224 is preferably arranged at the region of the cam disk 223 that has a minimal radius. In the case of the at least one mean state of the at least one holding means 204, the at least one scanning element 224 is preferably arranged at the region of the cam disk 223 that has a mean radius. The minimal radius of the at least one cam disk 223 preferably corresponds to the minimal distance between the at least one upper holding surface 233 of the at least one respective upper holder 206 and the at least one lower holding surface 234 of the lower holder 207 assigned to the respective upper holder 206. The maximal radius of the at least one cam disk 223 preferably corresponds to the maximal distance between the at least one upper holding surface 233 of the at least one respective upper holder 206 and the at least one lower holding surface 234 of the lower holder 207 assigned to the respective upper holder 206. At least one mean radius of the at least one cam disk 223 preferably corresponds to the mean distance between the at least one upper holding surface 233 of the at least one respective upper holder 206 and the at least one lower holding surface 234 of the lower holder 207 assigned to the respective upper holder 206.

The at least one cam disk 223 preferably comprises at least one region that corresponds to a phase of a transport movement at least of the at least one holding means 204 from the alignment position PA to the transfer position PU arranged downstream along the transport direction T of sheets 02. Preferably additionally, the distance between the at least one upper holding surface 233 of the at least one respective upper holder 206 and the at least one lower holding surface 234 of the lower holder 207 assigned to the respective upper holder 206 is minimal in this region, in particular when the at least one scanning element 224 is arranged at this region of the at least one cam disk 223. In this way, the state of the at least one holding means 204 during the transport movement of at least the at least one holding means 204 from the alignment position PA to the transfer position PU arranged downstream along the transport direction T of sheets 02 is preferably unchanged and/or constant.

The at least one mean state of the at least one holding means 204 is preferably settable and/or is set, preferably as a function of the thickness in the vertical direction V of the sheets 02 to be transported, preferably the at least one sheet 02. Preferably, the at least one mean state is set by way of the position of the axis of rotation U of the at least one transmission shaft 227, preferably when the corresponding region of the at least one cam disk 223 for the mean state of the at least one holding means 204 is in contact with the at least one scanning element 224.

The at least one infeed system 202 preferably comprises the at least one adjusting shaft 228. The at least one transmission shaft 227 is preferably eccentrically arranged in the at least one adjusting shaft 228. In this way, the axis of rotation U of the at least one transmission shaft 227 has a distance greater than zero with respect to an axis of rotation E of the adjusting shaft 228. The distance between the axis of rotation E of the adjusting shaft 228 and the axis of rotation U of the at least one transmission shaft 227 is preferably dependent on the maximum adjustment range of the thickness of the sheets 02 to be transported. The angle of rotation at which the axis of rotation U of the at least one transmission shaft 227 is arranged relative to the axis of rotation E of the at least one adjusting shaft 228 is preferably settable and/or set. The angle of rotation of the axis of rotation U of the at least one transmission shaft 227 with respect to the axis of rotation E of the at least one adjusting shaft 228 is preferably no more than 90° (ninety degrees), preferably no more than 75° (seventy-five degrees), more preferably no more than 60° (sixty degrees), more preferably no more than 45° (forty-five degrees), more preferably no more than 35° (thirty-five degrees).

The at least one infeed system 202 preferably comprises the at least one servo drive 231. The at least one infeed system 202 additionally, in particular in addition to the at least one drive shaft 1002 and/or the at least one drive 1001 of the drive system 1000, comprises at least one servo drive 231. The at least one servo drive 231 is preferably configured as a hand wheel or a mechanical drive or an electric drive, preferably as an actuator and/or a linear motor and/or an electric motor. The at least one servo drive 231 is preferably at least temporarily configured to intervene in the functional connection between the at least one cam disk 223 and the at least one pivotable holding surface 233; 234 and/or at least temporarily intervenes in the functional connection between the at least one cam disk 223 and the at least one pivotable holding surface 233; 234. Preferably, the at least one servo drive 231 is independent, preferably mechanically independent, of the at least one drive shaft 1002 and/or the at least one drive 1001 of the drive system 1000. Preferably, the at least one servo drive 231 is configured to set, preferably adjust, and/or sets the at least one mean state of the at least one transport means 204, preferably the at least one mean distance between the at least one upper holder 206 and the at least one lower holder 207. Preferably, the at least one servo drive 231 is configured to change and/or changes the at least one mean state of the at least one transport means 204. Preferably, the at least one servo drive 231 is configured to set and/or adjust and/or change, and/or sets and/or adjusts and/or changes, the at least one mean state of the at least one transport means 204 as a function of the thickness of the at least one sheet 02, preferably the sheet to be transported.

The axis of rotation U of the at least one transmission shaft 227 and the axis of rotation E of the at least one adjusting shaft 228 are preferably adjusted relative to one another by the at least one servo drive 231. The at least one servo drive 231 is preferably configured to adjust the axis of rotation U of the at least one transmission shaft 227 and the axis of rotation E of the at least one adjusting shaft 228 relative to one another. Preferably in addition or as an alternative, the axis of rotation U of the at least one transmission shaft 227 and the axis of rotation E of the at least one adjusting shaft 228 are adjusted relative to one another by the at least one servo drive 231. More preferably, the at least one servo drive 231 is configured to at least temporarily pivot the at least one adjusting shaft 228 about its axis of rotation E thereof. The at least one servo drive 231 preferably at least temporarily pivots the at least one adjusting shaft 228 about its axis of rotation E. Preferably, the at least one servo drive 231 is connected via at least one adjusting lever 232 to the at least one adjusting shaft 228. The at least one adjusting lever 232 is preferably moved by the at least one servo drive 231, whereby the at least one adjusting shaft 228 preferably at least partially pivots about its axis of rotation E. The at least one transmission shaft 227 is preferably at least partially pivoted about the axis of rotation E of the at least one adjusting shaft 228 by the at least partial pivoting movement of the at least one adjusting shaft 228. The at least one mean distance between the at least one upper holding surface 233 of the at least one respective upper holder 206 and the at least one lower holding surface 234 of the lower holder 207 assigned to the respective upper holder 206 is preferably set by an at least partial pivoting of the at least one transmission shaft 227 about the axis of rotation E of the at least one adjusting shaft 228.

As a result of an at least partial pivoting of the at least one adjusting shaft 228 about its axis of rotation E, the at least one scanning element 224 of the scanning lever 226, which is preferably in direct contact with the at least one cam disk 223, is preferably displaced by an angle of rotation of no more than 3° (three degrees), preferably of no more than 2° (two degrees), more preferably of no more than 1° (one degree), along the surface of the cam disk 223 about the axis of rotation D of the at least one cam disk 223 relative to the original position of the at least one scanning element 224. Preferably, the at least one mean distance between the at least one upper holding surface 233 of the at least one respective upper holder 206 and the at least one lower holding surface 234 of the lower holder 207 assigned to the respective upper holder 206 can be set and/or is set by at least partially pivoting the at least one adjusting shaft 228 about its axis of rotation E.

Preferably, the axis of rotation U of the at least one transmission shaft 227 is preferably arranged relative to the axis of rotation E of the at least one adjusting shaft 228, preferably independently of an adjustment of the axis of rotation E of the at least one adjusting shaft 228 relative to the axis of rotation U of the at least one transmission shaft 227, in such a way that the axis of rotation U of the at least one transmission shaft 227 has a maximal distance of preferably 50 mm (fifty millimeters), preferably of more than 35 mm (thirty-five millimeters), more preferably of no more than 10 mm (ten millimeters), with respect to a connecting line of the axis of rotation E of the at least one adjusting shaft 228 with a contact point of the at least one scanning element 224 with the at least one assigned cam disk 223. More preferably, the axis of rotation U of the at least one transmission shaft 227, preferably independently of an adjustment of the axis of rotation E of the at least one adjusting shaft 228 relative to the axis of rotation U of the at least one transmission shaft 227, is at least partially arranged in the connecting line of the axis of rotation E of the at least one adjusting shaft 228 with a contact point of the at least one scanning element 224 with the at least one cam disk 223. Preferably, the times at which the at least one transport means 204 has the maximally closed state and the minimally closed state and the at least one mean state is almost not influenced by, preferably independent of, a setting made by the at least one servo drive 231.

The at least one infeed system 202 preferably comprises at least one cam mechanism. Preferably, the at least one infeed system 202 comprises at least one cam mechanism moving the at least one transport means 204 from the alignment position PA to the transfer position PU and/or aligning sheets 02. Preferably in addition or as an alternative, the at least one infeed system 202 comprises at least one cam mechanism setting the state of the at least one transport means 204, preferably the distance between the at least one upper holder 206 and the at least one lower holder 207. Preferably, the at least one infeed system 202 of the processing machine 01 comprises at least one cam mechanism for at least a transport from the alignment position PA to the transfer position PU and/or at least an alignment of sheets 02, and preferably additionally at least one cam mechanism for at least setting the relevant state of the at least one transport means 204, in particular holding means 204. Preferably, the at least one infeed system 202 comprises at least one servo drive 218 intervening in, preferably superimposing, the movement of the at least one transport means 204 from the alignment position PA to the transfer position PU. Preferably in addition or as an alternative, the at least one infeed system 202 comprises at least one servo drive 231 setting, preferably adjusting, the at least one mean state of the at least one transport means 204. Preferably, the at least one infeed system 202 comprises at least one servo drive 218, in particular for aligning sheets 02, and at least one servo drive 231, in particular for setting the respective state of the at least one transport means 204, in particular of the at least one holding means 204.

The sheet processing machine 01 preferably comprises the at least one sensor device 251. The at least one sensor device 251 is preferably arranged within the at least one infeed unit 200 and/or is assigned to the at least one infeed unit 200. The sensor device 251 comprises the at least one sensor 252, preferably the at least two sensors 252. Preferably, the sensor device 251 comprises exactly two sensors 252, alternatively the sensor device 251 comprises at least three sensors 252. The respective, preferably the at least one, preferably the at least two sensors 252 are preferably directed at the transport path of sheets 02.

The at least one sensor device 251 is preferably arranged above or beneath the transport path of sheets 02. As an alternative, at least one sensor device 251 is preferably arranged above and at least one further sensor device 151 is arranged beneath the transport path.

For example, the at least one sensor 252 is, preferably the at least two sensors 252 are, more preferably at least three sensors 252 are, arranged above or beneath the transport path of the sheets 02. For example, both at least one sensor 252, preferably the at least two sensors 252, more preferably at least three sensors 252, are arranged above the transport path of the sheets 02, and at least one sensor 252, preferably at least one further sensor 252, preferably at least two further sensors 252, more preferably at least three further sensors 252, are arranged beneath the transport path. In this way the preferably at least one sheet 02 is at least partially detected and/or detectable from above and/or from beneath by the sensor device 251, preferably by the at least one sensor 252, preferably by the at least two sensors 252, preferably in at least one detection zone 253 of the respective, preferably at least one, sensor 252.

Preferably, the respective, preferably the at least one, more preferably the at least two sensors 252 are configured as a camera 252, more preferably as a color camera, more preferably as an area scan camera, more preferably as at least one CMOS sensor and/or at least one CCD sensor. The at least two sensors 252 are preferably each configured as a color camera and/or as an area scan camera and/or as at least one CMOS sensor and/or as at least one CCD sensor. In a preferred embodiment, each of the at least two sensors 252 is preferably configured as area scan camera. Preferably, at least one light source configured as an illumination device, for example an LED light source, in particular a light source for white light, is assigned to the respective, preferably the at least one, preferably the at least two sensors 252. Preferably, at least one illumination device is arranged in each case in the transport direction T directly upstream and/or directly downstream from a detection zone 253 of the respective, preferably at least one, preferably the at least two sensors 252, and is directed at the detection zone 253. Preferably, the at least one, preferably the at least two, sensors 252 in each case comprise at least one optical device, for example at least one lens, which is preferably arranged between the at least one sensor 252 and the transport path intended for the transport of sheets 02.

Preferably, the at least one sensor 252, preferably the at least two sensors 252, of the at least one sensor device 251 are configured to selectively detect, and/or detect, at least one edge 07; 08; 09, preferably the leading edge 07, and/or at least one printing mark 11 of sheets 02, preferably of the at least one sheet 02. The position and/or alignment of the sheet 02 is preferably determined and/or can be determined independently of the present format of the at least one sheet 02 and/or the embodiment of the leading edge 07 of the at least one sheet 02, for example due to fraying or uneven cutting, and/or the presence of at least one print image. Preferably, the at least one sensor device 251 and/or the at least one control system 1100 connected to the sensor device 251 are configured to selectively evaluate, and/or evaluate, the at least one detected edge 07; 08; 09 and/or the at least one detected printing mark 11, preferably with respect to position information of the at least one sheet 02 of the sheets 02. After the at least one edge 07; 08; 09 and/or printing mark 11 have been detected, the position information is preferably evaluated. More preferably, information is derived, for example by the at least one sensor device 251 and/or by the control system 1100, from the evaluation of the position information, as to how at least one setting variable of the processing machine 01 is to be changed, preferably as to how the at least one servo drive 218; 231; 237 of the infeed system 202, more preferably the at least one servo drive 218 influencing and/or superimposing the movement of the at least one transport means 204 from the alignment position PA to the transfer position PU, is to be activated. The at least one sensor device 251 and/or the at least one control system 1100 connected to the sensor device 251 are preferably configured to derive, and/or derive, information from the evaluation of the position information as to how at least one setting variable of the processing machine 01 is to be changed, preferably as to how the at least one servo drive 218; 231; 237 of the infeed system 202 is to be activated. The at least one sensor device 251 and/or the at least one control system 1100 connected to the sensor device 251 are preferably configured to derive, and/or derive, information from the evaluation of the position information as to how the servo drive 218 influencing and/or superimposing a movement of the at least one transport means 204 from the alignment position PA to the transfer position PU is to be activated. Advantageously, it is possible to select between the evaluation of the information of the detected edge 07; 08; 09 and/or printing mark 11, for example as a function of the quality of the detected edge 07; 08; 09 and/or printing mark 11 and/or of the completeness of the detected information. More preferably, the at least one, preferably the at least two, sensors 252 of the sensor device 251 are configured, each in an unchanged position of the relevant sensor 252, to selectively detect at least one edge 07; 08; 09 and/or printing mark 11 of sheets 02. Preferably, the respective, preferably the at least one, more preferably the at least two, sensors 252 are positioned so that preferably at least one edge 07; 08; 09, preferably the leading edge 07, and/or at least one side edge 09 of the respective, preferably of the at least one, sheet 02, and preferably additionally at least one region of the sheet 02 can be detected by at least one printing mark 11, in particular within a measurement, preferably simultaneously, and/or preferably in an unchanged position of the relevant, preferably of the at least one, more preferably of the at least two sensors 252, preferably within the one detection zone 253 of the respective, preferably the at least one, sensor 252.

The sheet processing machine 01 preferably comprises the at least one sensor device 251 comprising the at least two sensors 252, each of the at least two sensors 252 being configured to preferably selectively detect at least one printing mark 11 and/or at least one edge 07; 08; 09 of the respective sheet 02, without changing the position of the respective sensor 252, wherein the sheet 02 is arranged in the alignment position PA. The sheet processing machine 01 preferably comprises the at least one sensor device 251 comprising the at least two sensors 252, each of which preferably selectively detects at least one printing mark 11 and/or at least one edge 07; 08; 09 of the respective sheet 02, without changing the position of the respective sensor 252, wherein the respective sheet 02 is arranged in the alignment position PA. The sheet processing machine 01 preferably comprises the at least one sensor device 251 comprising the at least two sensors 252, each of which preferably selectively detects at least one printing mark 11 and/or at least one edge 07; 08; 09 of the respective sheet 02, which is arranged in the alignment position PA, without changing the position of the respective sensor 252. At least the at least one sensor 252, preferably the at least two sensors 252, which are configured to selectively detect an edge 07; 08; 09 and/or a printing mark 11 of the at least one sheet 02, preferably has at least two different positions, for example the positions corresponding to different formats of sheets 02. For example, when the format of the sheets 02 is changed, preferably the at least one sensor 252, preferably the at least two sensors 252 are moved by means of at least one positioning drive.

The at least two sensors 252, in particular exactly two sensors 252, are preferably arranged parallel next to one another in the transport direction T of sheets 02. The at least two sensors 252 arranged parallel next to one another in the transport direction T, that is, behind one another in the transverse direction A, are preferably arranged spaced apart from one another at a distance of greater than zero. The at least two sensors 252 of the sensor device 251 are preferably arranged next to one another in the transport direction T at the alignment position PA, wherein the alignment position PA is established by at least two front lay marks 203 of the infeed system 202 of the sheet processing machine 01 which are arranged horizontally to the transport direction T and parallel next to one another. Preferably, these at least two sensors 252 are configured to preferably selectively detect the leading edge 07 and/or at least one printing mark 11 of a respective sheet 02.

The at least one sensor device 251 preferably comprises at least one positioning drive. The at least one positioning drive is preferably configured to move and/or moves at least one sensor 252 of the at least two sensors 252. Preferably, the at least one sensor 252, preferably the at least two sensors 252 comprise at least one positioning drive, for example at least one linear motor and/or electric motor and/or motor comprising a threaded spindle. Preferably, the position of the at least one sensor 252, preferably of the at least two sensors 252, is adapted by the at least one positioning drive to the respective width and/or the respective format of the at least one sheet 02, in particular orthogonal to the transport direction T. As an alternative, the at least two sensors 252 arranged parallel to one another are mechanically adjusted. In a preferred embodiment, the at least two sensors 252 arranged parallel next to one another in the transport direction T comprise at least one positioning drive of at least one respective sensor 252. The at least two sensors 252 arranged parallel next to one another in the transport direction T, that is, behind one another in the transverse direction A, preferably comprise a joint positioning drive or each comprise a dedicated positioning drive. The relevant at least two sensors 252 arranged parallel next to one another in the transport direction T, that is, behind one another in the transverse direction A, preferably comprise a joint positioning drive or each comprise a dedicated positioning drive.

The at least one sensor device 251, preferably the at least two sensors 252, the at least two sensors 252 preferably being arranged next to one another in the transport direction T, are preferably configured to determine the position of the at least one sheet 02 in the transport direction T and/or, preferably and, in the transverse direction A. In a preferred embodiment of the sensor device 251, the at least two sensors 252 that are preferably arranged next to one another in the transport direction T are configured to determine the position of the at least one sheet 02 in the transport direction T and/or in the transverse direction A, preferably both in the transport direction A and in the transverse direction A, by evaluating the preferably selective detection of the at least one printing mark 11, preferably at least two printing marks 11, more preferably at least two printing marks 11 arranged next to one another in the transport direction T, more preferably at least one printing mark 11 per sensor 252 and/or the at least one edge 07; 08; 09. Preferably, in this way, the position of the at least one sheet 02 in the transport direction T and in the transverse direction A and an oblique position or skewed position of the at least one sheet 02 is determined, preferably unambiguously determined, by the at least two sensors 252 arranged next to one another in the transport direction T.

Preferably, the at least one sensor 252, preferably at least one sensor 252 of the at least two sensors 252, is configured to selectively detect the at least one edge 07; 08; 09, preferably the leading edge 07, and/or the at least one printing mark 11, preferably to determine the position of the at least one sheet 02 and/or preferably to establish at least one position error of the at least one sheet 02. The at least one sensor 252, preferably at least one sensor 252 of the at least two sensors 252, more preferably the at least two sensors 252 are preferably configured to detect the position of the preferably selectively detected at least one edge 07; 08; 09 and/or printing mark 11 relative to a reference position and/or, for example, the arrival time of the preferably selectively detected at least one edge 07; 08; 09 and/or printing mark 11 at the alignment position PA and/or in the at least one detection zone 253, relative to a reference, and/or detects the position and/or the arrival time. For example, when using the at least two sensors 252, it is possible to form a mean value, and to thus increase the accuracy of the position detection.

To determine the position in the transport direction T of the at least one sheet 02 and/or a position error in the transport direction T of the at least one sheet 02, the at least one sensor 252, preferably at least one sensor 252 of the at least two sensors 252, is preferably configured to detect the position, in particular in the transport direction T, of the preferably selectively detected at least one edge 07; 08; 09, preferably the leading edge 07, and/or printing mark 11 relative to a reference position. As an alternative, for example, the at least one sensor 252 is configured to detect the arrival time of the preferably selectively detected at least one edge 07; 08; 09, preferably the leading edge 07, and/or printing mark 11 at the alignment position PA. The at least one preferably selectively detected edge 07; 08; 09 and/or printing mark 11 preferably includes at least one measurement point, preferably at least two measurement points, more preferably at least four measurement points, more preferably a multiplicity of measurement points, for determining a position error in the transport direction T. The at least two measurement points are preferably arranged next to one another in the transport direction T. The at least two measurement points are preferably simultaneously detected and/or evaluated. In the event of a deviation from a reference, preferably the target position, a position error in the transport direction T of the at least one sheet 02 is preferably present.

To determine a position error of the at least one sheet 02 in the form of a skewed position, each of the at least two sensors 252 is preferably configured to detect the position, in particular in the transport direction T, of the preferably selectively detected at least one edge 07; 08; 09, preferably the leading edge 07, and/or printing mark 11. As an alternative, for example, each of the at least two sensors 252 is configured to detect the arrival time of the preferably selectively detected at least one edge 07; 08; 09, preferably the leading edge 07, and/or printing mark 11 at the alignment position PA. The at least two determined positions and/or arrival times are preferably compared to one another. In the event of a deviation from one another, a skewed position of the at least one sheet 02 is preferably present.

To determine the position in the transverse direction A of the at least one sheet 02 and/or a position error in the transverse direction A of the at least one sheet 02, the at least one sensor 252, preferably at least one sensor 252 of the at least two sensors 252, for example, only one sensor 252 of the at least two sensors 252, is preferably configured to detect the position, in particular in the transverse direction A, of the preferably selectively detected at least one edge 07; 08; 09, for example the side edge 09, and/or printing mark 11 relative to a reference position. The at least one preferably selectively detected edge 07; 08; 09 and/or printing mark 11 preferably includes at least one measurement point, preferably at least two measurement points, more preferably at least four measurement points, more preferably a multiplicity of measurement points, for determining a position error in the transverse direction A. The at least two measurement points are preferably arranged next one another in the transverse direction A, that is, behind one another in the transport direction T. The at least two measurement points are preferably simultaneously detected and/or evaluated. In the event of a deviation from a reference, preferably the target position, a position error in the transverse direction A of the at least one sheet 02 is preferably present.

The position of the at least one printing mark 11, preferably thus the position of the at least one sheet 02, is preferably determined at least by way of the center, for example the centroid, of the at least one printing mark 11. For this purpose, preferably the shape corresponding to the printing mark 11 on the at least one sheet 02, for example at least the boundary lines of the at least one printing mark 11, is detected, and the center, for example the centroid, of the at least one printing mark 11 is calculated therefrom. As an alternative, for example, the position of the at least one printing mark 11 in the transport direction T is determined by a side and/or an edge and/or an axis of the at least one printing mark 11, which is preferably parallel to the transverse direction A. As an alternative, for example, the position of the at least one printing mark 11 in the transverse direction A is determined by a side and/or an edge and/or an axis of the at least one printing mark 11, which is preferably parallel to the transport direction T.

The at least one sensor 252, preferably at least one sensor 252 of the at least two sensors 252, more preferably the at least two sensors 252 are preferably each configured to detect and/or to determine the position in the transport direction T of the at least one sheet 02 and/or, preferably and, the position in the transverse direction A of the at least one sheet 02 and/or detect the position and/or determine the position. The at least one sensor 252, preferably at least one sensor 252 of the at least two sensors 252, more preferably the at least two sensors 252 are preferably each configured to detect and/or to determine a position error in the transport direction T of the at least one sheet 02 and/or, preferably and, a position error in the transverse direction A of the at least one sheet 02 and/or detect the position error and/or determine the position error. In particular, the at least one sensor 252, preferably at least one sensor 252 of the at least two sensors 252 are configured to detect and/or to determine both a position error in the transport direction T of the at least one sheet 02 and a position error in the transverse direction A of the at least one sheet 02 and/or detect the position error and/or determine the position error. Preferably, the at least two sensors 252 are configured to detect and/or to determine a skewed position of the at least one sheet 02 and/or detect the skewed position and/or determine the skewed position.

Preferably in addition, at least one sensor 252, for example at least one sensor 252 of the at least two sensors 252 arranged next to one another in the transport direction T, or at least one third sensor 252, is configured to detect the at least one sheet 02 laterally, for example preferably selectively at its at least one side edge 09 and/or by at least one printing mark 11. The at least one sensor 252 is preferably configured to determine the lateral positioning in the transverse direction A of the at least one sheet 02. In the event of a lateral alignment of the at least one sheet 02 of the sheets 02, the control system 1100 and/or the at least one sensor device 251, preferably the at least two sensors 252 preferably arranged next to one another in the transport direction T, are preferably configured to activate the at least one servo drive 237 of the lateral alignment, as a function of the detection of the sheet 02, preferably the selective detection of the at least one edge 07; 08; 09, preferably the leading edge 07, and/or the at least one printing mark 11, preferably the at least one printing mark 11 of the at least two printing marks 11 preferably arranged next to one another in the transport direction T, by way of the at least one sensor device 251, preferably by way of the at least two sensors 252.

In a preferred embodiment, the sensor device 251 comprises the at least one, preferably third, sensor 252 for laterally detecting the at least one sheet 02. For example, the at least one third sensor 252 is arranged in the transport direction T for laterally detecting sheets 02. Preferably, the at least one third sensor 252 is arranged in the transport direction T to laterally detect at least one sheet 02, preferably the at least one sheet 02 of the sheets 02. Preferably, the at least one sensor 252, preferably the at least one third sensor 252, comprises at least one positioning drive for changing a position of at least the relevant sensor 252, for example at least one linear motor and/or electric motor and/or motor comprising a threaded spindle. Preferably, the positioning drive assigned thereto is configured to change the position, preferably at least in the transverse direction A, of the at least one sensor 252, preferably of at least one sensor 252 of the at least two sensors 252. Preferably, the at least one positioning drive is configured to change the position, preferably at least in the transverse direction A, of the at least one sensor 252, preferably of at least one sensor 252 of the at least two sensors 252. Preferably, the at least one sensor 252, preferably selectively detecting at least one lateral printing mark 11 and/or at least one side edge 09 of sheets 02 in the transport direction T in front of the alignment position PA is arranged so that a detection zone 253 of the relevant sensor 252 is configured to at least temporarily detect the at least one lateral printing mark 11 and/or the at least one side edge 09 of the, preferably at least one, sheet 02 of the sheets 02.

Preferably, the at least one sensor 252, preferably the at least one third sensor 252, for the preferably selective detection of at least one lateral printing mark 11 and/or at least one side edge 09 of sheets 02 in the transport direction T in front of the alignment position PA is arranged so that the detection zone 253 of the relevant sensor 252, preferably of the at least one third sensor, is configured to at least temporarily detect the at least one lateral printing mark 11 and/or the at least one side edge 09 of the sheet 02. The at least one, preferably third, sensor 252 for the lateral detection of sheets 02 preferably comprises at least one positioning drive for changing a position of at least the relevant, preferably at least one third, sensor 252. The position of the relevant, preferably of the at least one third, sensor 252 is preferably adapted by the at least one positioning drive to the respective width and/or the respective format of the sheet 02 to be detected, in particular orthogonal to the transport direction T.

Preferably, a sheet 02, preferably the at least one sheet 02 of the sheets 02, is at rest in the alignment position PA during the detection by the at least one sensor 252, preferably the at least two sensors 252, more preferably the at least two sensors 252 arranged parallel next to one another, of the sensor device 251. The at least one sensor device 251, preferably the at least two sensors 252 are preferably configured to detect the at least one sheet 02 at rest in the alignment position PA. In addition, or as an alternative, a sheet 02, preferably the at least one sheet 02 of the sheets 02, is at least partially fixed in its position by the at least one holder 206; 207 of the at least one transport means 204 of the at least one infeed system 202 during the detection by the at least one sensor 252, preferably the at least two sensors 252, more preferably the at least two sensors 252 arranged parallel next to one another. Preferably, the at least one holder 206; 207 of the at least one transport means 204 of the at least one infeed system 202 is configured to at least partially fix the at least one sheet 02 in its position during the detection by the at least one sensor 252, preferably the at least two sensors 252, more preferably the at least two sensors 252 arranged parallel next to one another.

Preferably, the at least one sensor device 251, in particular the at least one respective sensor 252 of the sensor device 251, preferably each sensor 252 of the sensor device 251, is connected to at least one control unit of the control system 1100 and/or preferably comprises at least one control unit of the control system 1100. Preferably, the respective, preferably at least one, sensor 252, preferably the at least two sensors 252 generate at least one measurement signal, which is preferably processed in the control unit and/or which is compared to a reference stored in the control unit. Preferably, the at least one control unit issues at least one signal, in particular at least one open-loop control signal and/or at least one closed-loop control signal, to at least one component of the sheet processing machine 01. Preferably, the at least one sensor device 251 is configured to control by open-loop control and/or by closed-loop control the at least one servo drive 218; 231; 237 of the infeed system 202, in particular all respective servo drives 218; 231; 237 of the infeed system 202, and/or controls by open-loop control and/or closed-loop control the at least one servo drive 218; 231; 237, as a function of the detection of the respective, preferably at least one, sheet 02 by the at least one sensor 252, preferably the at least two sensors 252.

The at least one sensor device 251, preferably at least one sensor 252 of the at least two sensors 252, more preferably the at least two sensors 252 are preferably configured to detect and/or detect the at least one printing mark 11, preferably at least two printing marks 11, more preferably two printing marks 11, the at least one printing mark 11 being integrated into the at least one print control strip. The at least one sensor device 251, preferably at least one sensor 252 of the at least two sensors 252, more preferably the at least two sensors 252 are preferably configured to detect and/or detect the at least one printing mark 11, preferably at least two printing marks 11, more preferably two printing marks 11, the at least one printing mark 11 being configured as a mark for monitoring a color register and/or for monitoring a perfecting register and/or for aligning the at least one sheet 02 in the transport direction T and in the transverse direction A. The at least one sensor device 251, preferably at least one sensor 252 of the at least two sensors 252, more preferably the at least two sensors 252 are preferably configured to detect and/or detect the at least one printing mark 11, preferably at least two printing marks 11, more preferably two printing marks 11, wherein the at least one sheet 02 comprises the at least one printing mark 11 in a region outside at least one print image and/or in an edge region of the at least one sheet 02 in the region of the edge 07, configured as the leading edge 07, of the at least one sheet 02 and/or preferably spaced apart from the leading edge 07. The at least one sensor device 251, preferably at least one sensor 252 of the at least two sensors 252, more preferably the at least two sensors 252 are preferably configured to detect and/or detect the at least one printing mark 11, preferably at least two printing marks 11, more preferably two printing marks 11, the at least one printing mark 11 being configured as a rectangle and/or a square. The at least one sensor device 251, preferably at least one sensor 252 of the at least two sensors 252, more preferably the at least two sensors 252 are preferably configured to detect and/or detect the at least one printing mark 11, preferably at least two printing marks 11, more preferably two printing marks 11, wherein at least one side and/or axis of the at least one printing mark 11 is arranged parallel to the leading edge 07 of the at least one sheet 02 and/or parallel to the transverse direction A and/or wherein at least one side and/or axis of the at least one printing mark 11 is arranged parallel to the side edge 09 of the at least one sheet 02 and/or parallel to the transport direction T. The at least one sensor device 251, preferably the at least two sensors 252, are preferably configured to detect and/or detect at least two printing marks 11 of the at least one sheet 02, more preferably two printing marks 11, the at least two printing marks 11 being arranged parallel to one another and spaced apart from one another along the leading edge 07 of the at least one sheet 02. Each of the at least two sensors 252 is preferably configured to detect and/or detects at least one printing mark 11 of the at least two printing marks 11.

Preferably, sheets 02 are fed to the at least one sheet-working unit 300, in particular to the at least one die-cutting unit 300, by feeding sheets 02 from the at least one feeder 100 via the at least one infeed unit 200.

The feeder unit 100 preferably comprises at least one feeder pile 101, which preferably comprises a multiplicity of sheets 02, wherein the multiplicity of sheets 02 are preferably present at least temporarily in a stacked manner, on top of one another in the vertical direction V. The spatial area of the at least one feeder pile 101 is preferably delimited by at least one front stop in the transport direction T. The feeder unit 100 preferably comprises at least one suction device 102, which is preferably arranged above, i.e., in the vertical direction V above the at least one feeder pile 101. The feeder unit 100 preferably comprises at least one transport means 103; 104. Preferably, the at least one suction device 102 comprises the at least one transport means 103; 104 of the feeder unit 100 for transporting sheets 02, preferably the respective uppermost sheet 02 of the feeder pile 101, from the feeder pile 101 to at least one unit 200; 300; 400; 500; 600; 650; 700; 800; 900 arranged downstream from the feeder unit 100 in the transport direction T. The feeder unit 100 preferably comprises the at least one transport means 103 configured as a vertical suction element 103 and/or the at least one transport means 104 configured as a horizontal suction element 104.

The at least one vertical suction element 103 is preferably configured to at least partially lift sheets 02, preferably the respective uppermost sheet 02 of the feeder pile 101, in the vertical direction V. Preferably in addition or as an alternative, the at least one vertical suction element 103 is configured to at least partially position sheets 02, preferably the respective uppermost sheet 02 of the feeder pile 101, within a plane of the transport path for further transport within the processing machine 01.

The plane of the transport path is preferably the plane that is spanned by the transport direction T and the transverse direction A at the relevant location of the transport path.

The at least one horizontal suction element 104 is preferably configured to at least partially, preferably completely, transport the respective sheet 02, which was preferably at least partially lifted by the vertical suction element 103, within the plane of the transport path in the transport direction T. The at least one transport means 103; 104 of the feeder unit 100, preferably the at least one horizontal suction element 104, is preferably configured to feed the respective sheet 02 to at least one feeder table 107 arranged downstream from the feeder pile 101 in the transport direction T.

For example, the at least one feeder unit 100 comprises at least one device, preferably at least one blower device, preferably for supporting the transport of sheets 02 within the at least one feeder unit 100. Preferably, the at least one blower device is configured to generate at least one air current and/or at least one air current can be generated, which at least one air current is directed beneath, i.e., to a position located beneath, in the vertical direction V, an underside of a respective sheet 02, which was preferably lifted from the at least one feeder pile 101 by the at least one vertical suction element 103. The sheet 02 that was removed from the at least one feeder pile 101 is thus preferably positioned to a large extent, preferably completely, within the plane of the transport path of the processing machine 01 on at least one feeder table 107 of the at least one feeder unit 100.

Preferably in addition or as an alternative, the at least one transport means 103; 104 of the at least one feeder unit 100 is configured to generate at least one preferably imbricated stream of sheets 02.

The at least one feeder unit 100 preferably comprises at least one transport means 108 of the at least one feeder unit 100. The at least one transport means 108 of the at least one feeder unit 100 is preferably configured as at least one conveyor belt 108. Preferably, sheets 02 are transported by means of the at least one transport means 108 of the at least one feeder unit 100 in the transport direction T from the at least one feeder unit 100 to a unit 200; 300; 400; 500; 600; 650; 700; 800; 900 arranged downstream in the transport direction T.

The at least one feeder 100 is preferably connected to the at least one infeed unit 200 via the at least one feeder table 107. Preferably, the at least one transport means 108 of the feeder 100, which is preferably configured as a conveyor belt 108, is arranged in the transport direction T between the at least one feeder pile 101 and the at least one infeed unit 200. The at least one transport means 108 of the feeder 100 is preferably arranged at the at least one feeder table 107. In a preferred embodiment, the at least one transport means 108 is configured as at least one conveyor belt 108 and/or as at least one suction conveyor belt 108. For example, the at least one transport means 108 comprises at least two conveyor belts 108 that are preferably arranged parallel to one another, wherein preferably at least one of the conveyor belts 108 is configured as a suction conveyor belt 108. Sheets 02 are preferably transported on the at least one transport means 108 and/or are located on the at least one transport means 108.

The at least one transport means 108 preferably comprises at least one drive 111. The at least one drive 111 of the at least one transport means 108 is preferably configured as a dedicated drive. For example, the at least one drive 111 is configured as an electric motor. The at least one drive 111 is preferably controlled by closed-loop control and/or open-loop control independently of the at least one drive 1001 of the drive system 1000.

The at least one infeed unit 200 preferably comprises at least one sensor 261 configured as a detection sensor 261, preferably exactly one detection sensor 261, having at least one detection zone 262. The at least one detection sensor 261 is preferably configured as a reflex scanner 261 or as a light barrier. The at least one detection sensor 261 is preferably arranged above or beneath the transport path and oriented thereat. The at least one detection sensor 261 is preferably configured to generate at least one signal, which can be processed and/or is processed by the at least one control system 1100, for example.

The detection zone 262 of the at least one detection sensor 261 is preferably arranged downstream from the at least one transport means 108, which is in particular configured as a conveyor belt 108, in the transport direction T and preferably additionally upstream from the alignment position PA on the transport path of sheets 02. The detection zone 262 is preferably the region of the transport path which is detected by the respective detection sensor 261. Each of the at least one detection sensor 261 preferably detects a sheet 02 in the detection zone 262. The detection zone 262 of the at least one detection sensor 261, on the transport path of sheets 02, orthogonal to the transport direction T along the working width of the sheet processing machine 01, preferably has at least a distance of at least one third of the working width, preferably at least two fifths of the working width, with respect to each delimitation of the working width. More preferably, the detection zone 262 of the at least one detection sensor 261, preferably of the exactly one detection sensor 261, is centrally arranged along the working width.

The at least one detection zone 262 is preferably arranged upstream from the alignment position PA. More preferably, the at least one detection zone 262 is spaced apart from the alignment position PA at a distance L262, in particular at a distance L262 of greater than zero. Preferably, the at least one detection zone 262 is arranged upstream from the gripper shaft 221 in the transport direction T when the at least one holding means 204 is in the alignment position PA. Preferably, the distance L262 between the at least one detection zone 262 and the alignment position PA is at least so large that at least one signal of the relevant detection sensor 261 can be processed and/or is processed by the at least one control system 1100, for example, before the sheet 02 generating the relevant signal reaches the alignment position PA.

The sheet processing machine 01, in particular the infeed unit 200, preferably comprises at least the at least one sensor device 251 comprising the at least two sensors 252, and additionally the at least one detection sensor 261. The at least two sensors 252 of the at least one sensor device 251 are preferably arranged next to one another in the transport direction T at the alignment position PA. Preferably, the at least one detection sensor 261 is arranged upstream from the at least two sensors 251 of the at least one sensor device 251 in the transport direction T and/or the at least one detection sensor 261 is arranged spaced apart from the at least two sensors 251 of the at least one sensor device 251 in the transport direction T, in particular at a distance of greater than zero.

Preferably, the at least one detection sensor 261 is at least connected to the at least one transport means 108, which is preferably configured as a conveyor belt 108, via the at least one control system 1100.

Each of the at least one detection sensor 261 preferably detects a sheet 02 that is transported along the transport path in the at least one detection zone 262. Each of the at least one detection sensor 261 preferably detects a sheet 02 prior to its arrival at the alignment position PA. The at least one detection sensor 261 is preferably configured to detect the respective at least one sheet 02 at its leading edge 07 and/or the at least one detection sensor 261 detects the respective at least one sheet 02 at its leading edge 07. More preferably, the at least one detection sensor 261 detects the respective at least one sheet 02 at a distance of at least one third with respect to the respective side edges 09, preferably centrally, at its leading edge 07. The at least one detection sensor 261 preferably detects at least one sheet 02, preferably exactly one sheet 02, per machine cycle.

In a preferred embodiment, the leading edge 07 of the sheet 02 detected by the at least one detection sensor 261 in the transport direction T is spaced apart from the trailing edge 08 of a respective preceding sheet 02, at least at the position of the transport path at which the at least one detection sensor 261 is configured to detect and/or detects the relevant sheet 02. Preferably, the leading edge 07 of the sheet 02 detected by the at least one detection sensor 261 has a distance L02, in the form of a sheet gap L02, with respect to the trailing edge 08 of the respective preceding sheet 02. The leading edge 07 of a sheet 02 is preferably detected by the at least one detection sensor 261 by way of a sheet gap L02 preceding it.

Preferably in addition or as an alternative, the at least one transport means 103; 104 of the at least one feeder unit 100 is configured to generate at least one preferably imbricated stream of sheets 02. As an alternative, at least the at least one transport means 103; 104 of the at least one feeder unit 100 is configured to generate at least one stream of separated sheets 02.

Above and below, a machine cycle preferably describes a sum of those process steps and/or procedures that take place within the processing machine 01, preferably within a unit 100; 200; 300; 400; 500; 600; 650; 700; 800; 900, in a consistent order. The relevant process steps and/or procedures are preferably only repeated during the next machine cycle in the same order. For example, a preferably clock-generating drive shaft 1002 carries out a complete rotation about its axis of rotation D within a machine cycle. For example, a machine cycle in each case comprises a processing step of a sheet 02 within a unit 300; 400; 500; 650 as well as the transport of the sheet 02 toward a respective processing point and/or the transport from the respective processing point to a downstream unit 400; 500; 600; 700; 800; 900. For example, die cutting, stripping and/or separating multiple-ups 03 are preferably carried out simultaneously during a machine cycle in different units 300; 400; 500; 650 on different sheets 02.

A machine cycle preferably comprises at least one machine phase, in particular at least a plurality of machine phases. Above and below, a machine phase preferably describes a respective process step and/or procedure that takes place at a time of the machine cycle. A machine phase preferably corresponds to at least one angular position, preferably exactly one angular position, of the drive 1001 of the drive system 1000. The sheet processing machine 01 preferably comprises at least one clock-generating element 113, which is configured to move at the machine phase and/or is moved at the machine phase.

Preferably, the at least one clock-generating element 113 is moved at least once, preferably exactly once, per machine cycle from its starting position and/or starting location into a position and/or location different therefrom, and back into its starting position and/or starting location.

Preferably, in particular in the case of single sheet feeding along the at least one transport means 108 preferably configured as a conveyor belt 108, the sheets 02 are in each case arranged spaced apart from one another at the sheet gap L02 on the transport means 108. The respective sheet gap L02 is preferably generated upstream from the leading edge 07 of a relevant sheet 02, in particular in the case of single sheet feeding at least by an acceleration of the at least one transport means 108 and/or at least one transport cylinder 112, at least when preferably a machine cycle is present which differs from a transfer of a sheet 02 from the at least one suction device 102 preferably configured as a separating device 102 to the at least one transport means 108, preferably when the clock-generating element 113 is situated in the plane of the transport path and/or at the plane of the transport path and/or at its lowest position, viewed in the vertical direction V. Preferably in addition or as an alternative, in particular in the case of imbricated feeding of sheets 02, the respective sheet gap L02 is generated upstream from the leading edge 07 of a relevant sheet 02 at least by the at least partial further transport of the immediately preceding sheet 02 to the unit 300 arranged directly downstream from the infeed unit 200. In the case of imbricated feeding of sheets 02, sheets 02 are preferably arranged to at least partially overlap on the at least one transport means 108.

The control system 1100 is preferably configured to control by open-loop control and/or closed-loop control an arrival time of a sheet 02 that is at least temporarily detected by the at least one detection sensor 261 at the alignment position PA by an open-loop control and/or a closed-loop control of the at least one transport means 108, as a function of the detection of the relevant sheet 02 by the at least one detection sensor 261. Preferably, the arrival time of the sheet 02 detected by the at least one detection sensor 261 at the alignment position PA is controlled by open-loop control and/or by closed-loop control by the open-loop control and/or closed-loop control of the at least one transport means 108. More preferably, the arrival time of the sheet 02 detected by the at least one detection sensor 261 at the alignment position PA is controlled by open-loop control and/or by closed-loop control as a function of the machine cycle time and/or as a function of the detection of the relevant sheet 02 by the at least one detection sensor 261.

Preferably, a target value of the arrival time of the relevant sheet 02 at the alignment position PA, in particular the target value of the machine phase, is compared to an actual value of the arrival time of the relevant sheet 02, in particular the actual value of the machine phase. The at least one control system 1100 is preferably configured to compare the target value of the arrival time of the relevant sheet 02 at the alignment position PA to the actual value of the arrival time of the relevant sheet 02.

The actual value is preferably determined by the detection of the relevant sheet 02 by means of the at least one detection sensor 261. The actual value of the arrival time of the relevant sheet 02 at the alignment position PA is preferably established by the detection of relevant the sheet 02 by means of the at least one detection sensor 261, in particular wherein the at least one detection sensor 261 is spaced apart from the alignment position PA in the transport direction T and/or is arranged upstream from the alignment position PA in the transport direction T. More preferably, the actual value corresponds to the preferably calculated arrival time of the sheet 02, in particular the machine phase, at the alignment position PA, at which preferably calculated arrival time the respective sheet 02 would arrive at the alignment position PA at the time this sheet 02 is detected by the at least one detection sensor 261.

The target value of the arrival time of the relevant sheet 02 at the alignment position PA is preferably assigned to an, in particular technologically predefined, machine phase of the machine cycle. The target value of the arrival time of the relevant sheet 02 at the alignment position PA is preferably determined and/or can be determined at least by the distance L262 between the at least one detection zone 262 of the at least one detection sensor 261 and the alignment position PA and/or at least by at least one movement profile of the at least one drive 111 of the at least one transport means 108. The target value of the arrival time of the relevant sheet 02 at the alignment position PA is preferably calculated from at least the distance L262 between the at least one detection zone 262 of the at least one detection sensor 261 and the alignment position PA and/or from at least the at least one movement profile of the at least one drive 111 of the at least one transport means 108, in particular by the at least one control system 1100.

The at least one transport means 108 is preferably at least partially controlled by open-loop control and/or by closed-loop control by the at least one detection sensor 261. The at least one drive 111 of the at least one transport means 108 is preferably controlled by closed-loop control and/or open-loop control as a function of the comparison of the target value of the arrival time of the relevant sheet 02 at the alignment position PA and the actual value of the relevant sheet 02. Preferably, the at least one control system 1100 is configured to control by closed-loop control and/or open-loop control the at least one drive 111 of the at least one transport means 108 as a function of the comparison of the target value of the arrival time of the relevant sheet 02 at the alignment position PA and the actual value of the relevant sheet 02. Preferably in addition or as an alternative, the at least one drive 111 of the at least one transport means 108 is controlled by closed-loop control and/or by open-loop control, and/or is configured to be controllable by closed-loop control and/or by open-loop control, as a function of a detection of a sheet 02 by the at least one detection sensor 261.

Preferably, the relevant sheet 02, which is detected by the at least one detection sensor 261, is accelerated along the transport path between the at least one detection zone 262 of the at least one detection 261 and the alignment position PA, as a function of the comparison of the target value of the arrival time of the relevant sheet 02 at the alignment position PA and the actual value of the relevant sheet 02. The at least one transport means 108 is preferably configured to accelerate at least one respective sheet 02, the at least one detection sensor 261 being configured to detect this sheet 02, along the transport path between the at least one detection zone 262 of the at least one detection sensor 261 and the alignment position PA, as a function of the comparison of the target value of the arrival time of the relevant sheet 02 at the alignment position PA and the actual value of the relevant sheet 02. The acceleration is either positive, so that at least the respective sheet 02 is transported at a higher speed, or negative, so that at least the respective sheet 02 is transported at a lower speed, or equal to zero, so that at least the respective sheet 02 is transported at a preferably unchanged speed. Preferably, all sheets 02 are accelerated as a function of the comparison of the target value of the arrival time of the sheet 02, which is detected at this time by the at least one detection sensor 261, at the alignment position PA and the actual value of the sheet 02 detected at this time by the at least one detection sensor 261, each of the sheets 02 at this time being in direct or indirect contact with the at least one transport means 108, in particular being at least partially located on the at least one transport means 108 and/or being transported by the at least one transport means 108. Preferably, at least the relevant sheet 02 is accelerated in such a way that its actual arrival time at the alignment position PA agrees with the target value, in particular the technologically predefined machine phase.

The feeder 100 preferably comprises the at least one clock-generating element 113. The at least one clock-generating element 113 is preferably configured as at least one timing roller 113. The clock-generating element 113 is preferably configured to be at least partially movable in the vertical direction V. Preferably, the clock-generating element 113 is at least partially moved in the vertical direction V according to the angular position of the drive 1001 of the drive system 1000. Preferably, the clock-generating element 113 is moved at least once per machine cycle in the vertical direction V outside the plane of the transport path of sheets 02. Preferably in addition or as an alternative, the clock-generating element 113 is moved at least once per machine cycle in the vertical direction V in and/or at the plane of the transport path of sheets 02.

Preferably, the at least one detection sensor 261 detects the respective sheet 02 that is arranged at least partially in the detection zone 262, as soon as the at least one clock-generating element 113, configured in particular as a timing roller 113, is in and/or at the plane of the transport path of sheets 02, in particular at its lowest position, viewed in the vertical direction V. Preferably, the at least one clock-generating element 113, at its lowest position in the vertical direction V, is in contact with the transport path of sheets 02 and/or of a sheet 02 and/or at least the transport cylinder 112 preferably arranged beneath the transport path of sheets 02 and/or the at least one transport means 108 arranged, in particular, beneath the transport path of sheets 02.

Preferably, at least one transport cylinder 112 is arranged between the at least one feeder pile 101 and the at least one transport means 108. The at least one transport cylinder 112 is preferably driven via the at least one drive 111 of the at least one transport means 108. In addition or as an alternative, the at least one transport cylinder 112 is preferably arranged separately from the at least one clock-generating element 113 at the same position in the transport direction T of sheets 02, separated by the transport path of sheets 02. The at least one clock-generating element 113 is preferably arranged above the transport path in the vertical direction V, and the at least one transport cylinder 112 is arranged beneath the transport path. Preferably, the at least one transport cylinder 112 is arranged upstream from the at least one transport element 108 in the transport direction T.

Preferably, the at least one transport means 108 has a speed that is identical to the movement of the at least one clock-generating element 113, at least at the time at which a sheet 02 is transferred from the at least one transport means 104, which is preferably configured as a transport element 104, preferably as a horizontal suction element 104, of the at least one separating device 102 of the feeder 100 to the at least one transport means 108. Preferably, the at least one transport means 108 is driven at a speed that is synchronized with, preferably identical to, the movement of the at least one clock-generating element 113, at least at the time at which a sheet 02 is transferred from the at least one transport element 104 of the at least one separating device 102 of the feeder 100 to the at least one transport means 108. Preferably in addition or as an alternative, at least at the time at which a sheet 02 is transferred from the at least one transport element 104 to the at least one transport means 108, at least this one transport element 104 of the at least one separating device 102 of the feeder 100 has a speed that is synchronized with, preferably identical to, the movement of the at least one clock-generating element 113. Preferably in addition or as an alternative, at least at the time at which a sheet 02 is transferred from the at least one transport element 104 to the at least one transport means 108, at least this one transport element 104 of the at least one separating device 102 of the feeder 100 is moved at a speed that is synchronized with the movement of the at least one clock-generating element 113. More preferably, upon arrival of the sheet 02 detected by the at least one detection sensor 261 at the alignment position PA, an adjustment that was possibly made to the at least one transport means 108, from a speed that is matched to the machine phase to a speed deviating therefrom, is reset to a preferably at least partial vertical movement of the at least one clock-generating element 113, in particular a lifting of the clock-generating element 113 out of the plane of the transport path at this position. In a preferred embodiment, a succeeding sheet 02, which is conveyed from the at least one separating device 102 in the transport direction T toward the at least one transport means 108, configured in particular as a conveyor belt 108, at a time at which this sheet 02 makes contact with the at least one transport means 108, has a distance L02 with respect to a directly preceding sheet 02 that is preferably identical to that of two sheets 02 directly succeeding one another, which at this time are already being conveyed by the at least one transport means 108 and/or which at this time are situated on the at least one feeder table 107. Preferably, sheets 02, in particular all sheets 02 that are being conveyed by the at least one transport means 108, have a preferably identical distance L02 with respect to one another, in particular at least with respect to a directly preceding and/or direct succeeding sheet 02, at least at the time at which these sheets 02 are conveyed by the at least one transport means 108.

In a preferred embodiment, the at least one transport means 108 is configured to roughly align at least the sheet 02 detected by the at least one detection sensor 261, at least corresponding to the transport direction T. Preferably, the sheet 02 detected by the at least one detection sensor 261 is roughly aligned at least by the at least one transport means 108, at least corresponding to the transport direction T. Preferably in addition or as an alternative, the sheet 02 detected by the at least one detection sensor 261 is roughly aligned at the alignment position PA at least by at least two front lay marks 203.

Preferably in addition or as an alternative, the infeed system 202 comprises the at least one servo drive 218, which at least partially moves and/or is configured to move the at least one holding means 204, wherein the at least one holding means 204 finely aligns and/or is configured to finely align the at least one sheet 02.

A sheet 02 is preferably at least temporarily transported within the sheet processing machine 01. The sheet processing machine 01 preferably comprises at least the at least one infeed system 202, comprising the at least one transport means 204, preferably configured as a gripper 204, and the at least one transport system 1200, comprising the at least one holding element 1202, preferably configured as a gripper 1202.

Preferably, a method for at least temporarily transporting sheets 02, preferably the at least one sheet 02, comprises at least the following steps.

Positioning a sheet 02, preferably the at least one sheet 02 of the sheets 02, in the at least one infeed system 202 at the alignment position PA, by the sheet 02 striking against the at least two front lay marks 203 arranged orthogonally to the transport direction T of sheets 02 and horizontally next to one another; holding the, preferably at least one, sheet 02 by way of the at least one transport means 204 in the alignment position PA in the maximally closed state of the at least one transport means 204; detecting the, preferably at least one, sheet 02 by the at least two sensors 252 of the at least one sensor device 251 in the alignment position PA in the maximally closed state of the at least one transport means 204; transporting the, preferably at least one, sheet 02 from the alignment position PA to the transfer position PU arranged downstream from the alignment position PA in the transport direction T; transferring the, preferably at least one, sheet 02 from the at least one transport means 204 to the at least one holding element 1202 in the transfer position PU; and returning the at least one transport means 204 to the alignment position PA.

Preferably, a sheet 02, preferably the at least one sheet 02, is at least temporarily positioned in the alignment position PA. Preferably, the sheet 02, preferably the at least one sheet 02, is roughly aligned by the positioning in the alignment position PA. Preferably, the respective sheet 02 is roughly aligned by the positioning in the alignment position PA. Preferably, the at least one transport means 204, in particular the at least one holding means 204, is in the at least one mean state while the sheet 02 is being positioned in the alignment position PA, which differs both from the maximally closed state and from the minimally closed state of the at least one transport means 204, in particular of the at least one holding means 204. Preferably, the at least one transport means 204 has the at least one mean state while the at least one sheet 02 is being positioned in the alignment position PA, preferably at least during the rough alignment of the at least one sheet 02. For an at least temporary transport, preferably at least one sheet 02, preferably the at least one sheet 02, is positioned in the alignment position PA by the sheet 02 striking against the at least two front lay marks 203 that are arranged orthogonally to the transport direction T of sheets 02 and horizontally next to one another, preferably a multiplicity of front lay marks 203. Preferably, the respective, preferably at least one, sheet 02 is roughly aligned by the positioning in the alignment position PA.

The, preferably at least one, sheet 02 is preferably held by way of the at least one transport means 204 in the alignment position PA in the maximally closed state of the at least one transport means 204. The, preferably at least one, sheet 02, after having been positioned in the alignment position PA, is preferably held by the at least one transport means 204 in at least one edge region and/or outside the at least one print image of the sheet 02 in the maximally closed state of the at least one transport means 204. While it is being held in the alignment position PA, the respective, preferably the at least one, sheet 02, in particular the leading edge 07 of the sheet 02, is preferably at least partially, preferably completely, fixed in its position with respect to the transport direction T and/or transverse direction A and/or vertical direction V.

Preferably, the distance between the at least one upper holder 206 and the at least lower holder 207 of the at least one transport means 204, in particular the respective distance between the at least one upper holding surface 233 and the at least one lower holding surface 234, is set via the at least one cam mechanism of the infeed system 202, wherein the relevant cam mechanism is preferably provided for setting the respective state of the at least one transport means 204. Preferably, the at least one cam mechanism sets the state of the at least one transport means 204, preferably the distance of the holders 206; 207 with respect to one another, during an ongoing operation of the processing machine 01, preferably corresponding to the present machine phase.

Preferably, the at least one mean distance between the at least one upper holding surface 233 of the at least one respective upper holder 206 and the at least one lower holding surface 234 of the lower holder 207 assigned to the respective upper holder 206, is set corresponding to a maximum thickness of sheets 02 to be transported, in particular at least once for each processing job involving sheets 02 of the same type. At least one holding surface 233; 234 of the at least one holder 206; 207 preferably pivots and/or is pivotable, at least temporarily, about the pivot axis 221 of the relevant holder 206; 207. The maximally closed state preferably corresponds to the minimal distance, and the minimally closed state preferably corresponds to the maximal distance, and the at least one mean state preferably corresponds to the at least one mean distance, between the at least one upper holding surface 233 of the at least one respective upper holder 206 and the at least one lower holding surface 234 of the lower holder 207 assigned to the respective upper holder 206. Preferably, the at least one pivotable holding surface 233; 234 is functionally connected to at least one cam disk 223 via the at least one scanning lever 226. Preferably, the at least one infeed system 202 additionally comprises the at least one servo drive 231, which at least temporarily intervenes in the functional connection between the at least one cam disk 223 and the at least one pivotable holding surface 233; 234. Preferably, the at least one servo drive 231 sets, preferably adjusts, the at least one mean state of the at least one transport means 204. Preferably, the at least one servo drive 231 sets the at least one mean state of the at least one transport means 204 while an operating situation of the processing machine 01 is being maintained. Preferably, the at least one mean state is set during operation of the processing machine 01. Preferably, this allows sheets 02 having different thicknesses to be processed while an operating situation of the processing machine 01 is being maintained, preferably without interrupting production, more preferably for two consecutive sheets 02.

The at least one servo drive 231 preferably adjust the axis of rotation U of the at least one transmission shaft 227 and the axis of rotation E of the at least one adjusting shaft 228 relative to one another. Preferably in addition or as an alternative, the axis of rotation U of the at least one transmission shaft 227 and the axis of rotation E of the at least one adjusting shaft 228 can be adjusted and/or are adjusted relative to one another by the at least one servo drive 231. Preferably, the at least one mean distance between the at least one upper holding surface 233 of the at least one respective upper holder 206 and the at least one lower holding surface 234 of the lower holder 207 assigned to the respective upper holder 206, which preferably corresponds to the at least one mean state of the at least one transport means 204, is set as a result of the at least partial pivoting of the at least one adjusting shaft 228 about its axis of rotation E.

The at least one sheet 02 is preferably detected by the at least two sensors 252 of the at least one sensor device 251 in the alignment position PA in the maximally closed state of the at least one transport means 204. The at least one sheet 02 is preferably selectively detected in the alignment position PA by the at least two sensors 252 at the leading edge 07 and/or at the at least one printing mark 11 of the sheet 02 in the maximally closed state of the at least one transport means 204. The at least one sheet 02 is more preferably selectively detected in the alignment position PA by the at least two sensors 252 that are arranged orthogonally to the transport direction T and horizontally next to one another at the leading edge 07 and/or at the at least one printing mark 11 of the sheet 02 in the maximally closed state of the at least one transport means 204. The sheet 02 is more preferably selectively detected in the alignment position PA at idle by at least two sensors 252 that are arranged orthogonally to the transport direction T and horizontally next to one another, without repositioning the relevant sensor 252, at the leading edge 07 and/or at at least one printing mark 11 of the sheet 02 in the maximally closed state of the at least one transport means 204. In addition or as an alternative, the sheet 02 is more preferably selectively detected in the alignment position PA at idle by at least one sensor 252, for example the at least one third sensor 252, without repositioning the relevant sensor 252, at at least one side edge 09 and/or at at least one printing mark 11 of the sheet 02, preferably wherein the at least one printing mark 11 preferably has a smaller distance with respect to the at least one side edge 09 than with respect to the leading edge 07, in the maximally closed state of the at least one transport means 204.

Preferably, the at least one sheet 02 is transported from the alignment position PA to the transfer position PU arranged downstream from the alignment position PA in the transport direction T. Prior to and/or preferably during the transport of the sheet 02 from the alignment position PA to the transfer position PU, the at least two front lay marks 203 are preferably adjusted from their positioning within the transport path of sheets 02 into a positioning outside the transport path of sheets 02. Preferably, the at least two front lay marks 203 are adjusted, preferably pivoted, out of the plane of the transport path in the alignment position PA, in particular completely outside the plane of the transport path in the alignment position PA.

In particular during the transport of the, preferably at least one, sheet 02 from the alignment position PA to the transfer position PU and/or in particular during the return of the at least one transport means 204 from the transfer position PU to the alignment position PA, at least one rotative movement of the at least one cam mechanism of the infeed system 202, in particular at least of the at least one cam mechanism assigned to the transport of sheets 02, is preferably converted into at least one linear movement of the at least one transport means 204 by the at least one drive lever 214. More preferably, in particular during the transport of the sheet 02 from the alignment position PA to the transfer position PU and/or in particular during the return of the at least one transport means 204 from the transfer position PU to the alignment position PA, at least one rotative movement of at least two cam mechanisms arranged horizontally next to one another in the transport direction T, in particular of at least two cam mechanisms at least assigned to the transport of sheets 02, is converted into at least one linear movement of the at least one transport means 204 by the at least one drive lever 214.

Preferably, the at least one cam mechanism, preferably the at least two cam mechanisms, more preferably all cam mechanisms of the infeed system 202 are preferably continuously driven by the at least one drive shaft 1002, by way of the at least one drive 1001 of the sheet processing machine 01. Preferably, each of the at least one cam disk 212; 223 is connected to the at least one drive shaft 1002 and/or is arranged at the at least one drive shaft 1002. The movement of the at least one cam disk 212; 223 preferably corresponds to the movement of the at least one drive shaft 1002. Preferably, at least one cam mechanism of the infeed system 202, in particular at least the at least one cam mechanism assigned to the transport of sheets 02, is configured as a dual cam mechanism comprising at least two cam disks 212 in each case.

The at least one cam disk 212; 223 of the infeed system 202, in particular each cam disk 212; 223 of each relevant cam mechanism of the infeed system 202, preferably during a machine cycle, carries out exactly one complete rotation about its axis of rotation D, wherein a machine cycle at least comprises the steps of positioning the sheet 02 in the alignment position PA, holding the sheet 02 in the alignment position PA by way of the at least one transport means 204, detecting the sheet 02 by at least two sensors 252 of the at least one sensor device 251, transporting the sheet 02 from the alignment position PA to the transfer position PU, transferring the sheet 02 from the at least one transport means 204 to the at least one holding element 1202, and returning the at least one transport means 204 to the alignment position PA.

The sheet 02, preferably the at least one sheet 02, is preferably finely aligned by the at least one infeed system 202 during the transport from the alignment position PA to the transfer position PU. The respective sheet 02 is preferably finely aligned by the at least one infeed system 202 during the transport from the alignment position PA to the transfer position PU. The sheet 02 is preferably finely aligned during the transport of the sheet 02 from the alignment position PA to the transfer position PU, as a function of the detection of the sheet 02, in particular the preferably selective detection of at least one printing mark 11 and/or at least one edge 07; 08; 09 of the sheet 02, preferably the preferably selective detection of at least two printing marks 11 and/or of the leading edge 07 of the sheet 02 and/or of at least one side edge 09 of the sheet 02, by the at least one sensor device 251, in particular by means of the at least one infeed system 202. Preferably, the at least one transport means 204, more preferably the at least one sheet 02, is adjusted as a function of the detection by the at least one sensor device 251, preferably the at least one sensor 252, more preferably the at least two sensors 252, in the transport direction T and/or transverse direction A, preferably for compensating for at least one position error of the at least one sheet 02.

In the case of a lateral fine alignment of the sheet 02 orthogonal to the transport direction T, at least the at least one transport means 204 of the infeed system 202 is preferably adjusted horizontally and orthogonally to the transport direction T via at least one servo drive 237 of the lateral alignment.

The infeed system 202 preferably comprises the at least one cam mechanism, each comprising the at least one cam disk 212 and the axis of rotation D of the at least one cam disk 212. The at least one scanning element 213 preferably rests against the at least one cam disk 212. The at least one scanning element 213 is preferably connected to the at least one transport means 204 via the at least one drive lever 214. The at least one drive lever 214 preferably comprises the mounting point S. The mounting point S and the axis of rotation D are preferably configured to be adjustable and/or adjusted relative to one another and/or are adjusted relative to one another.

The alignment in the transport direction T preferably includes at least one position displacement of the mounting point S of the at least one drive lever 214 and of the axis of rotation D of the at least one relevant cam disk 212. A position error of the at least one sheet 02 is preferably compensated for by the position displacement of the mounting point S relative to the axis of rotation D, more preferably the at least one sheet 02 is finely aligned, preferably at least in the transport direction T. The relevant sheet 02 is preferably finely aligned, in particular in the transport direction T, by the at least one position displacement of the mounting point S of the at least one drive lever 214 and of the axis of rotation D of the at least one cam disk 212 relative to one another, in addition to the deflection of the at least one drive lever 214 as a result of an at least partial rotation of the at least one cam disk 212. Preferably, the at least one servo drive 218 is configured to be activatable and/or activated and/or controllable by closed-loop control and/or controlled by closed-loop control during a compensation of at least one skewed position of the sheet 02. Preferably in addition, at least two servo drives 218 are configured to be activatable and/or activated and/or controllable by closed-loop control and/or controlled by closed-loop control during a compensation of at least one position error in the transport direction T. During the fine alignment of the sheet 02 in the transport direction T, the at least one servo drive 218 is preferably at least activated and/or controlled by closed-loop for a compensation for a skewed position of the sheet 02. Preferably in addition, the at least two servo drives 218 are at least activated and/or controlled by closed-loop for a compensation for a position error in the transport direction T during the fine alignment of the sheet 02 in the transport direction T.

During the fine alignment of the sheet 02 in the transport direction T, the open-loop control and/or closed-loop control of the at least one servo drive 218 preferably compensates for at least one skewed position of the sheet 02. Preferably in addition, the preferably simultaneous open-loop control and/or closed-loop control of the at least two servo drives 218 compensates for at least one position error in the transport direction T during the fine alignment of the sheet 02 in the transport direction T.

The respective sheet 02 is preferably simultaneously finely aligned during the transport from the alignment position PA to the transfer position PU, both in the transport direction T and also laterally, i.e., in the transverse direction A. Preferably, at least one signal is transmitted to the respective required servo drive 218; 237 by the at least one control system 1100, in particular as a function of the detection of the sheet 02 by the at least one sensor 252 of the at least one sensor device 251. The respective required servo drives 218; 237 are preferably controlled by open-loop control and/or by closed-loop control so as to be synchronized during the fine alignment of sheets 02. The respective other alignment of the sheet 02 is preferably taken into consideration in the calculation of the at least one signal, so that the respective required servo drives 218; 237 are preferably controlled by open-loop control and/or by closed-loop control so as to be synchronized during the fine alignment of sheets 02.

The respective at least two, preferably three, sensors 252 preferably detect and/or ascertain a deviation of the sheet 02, in particular of the leading edge 07 and/or of the side edge 09 and/or of the at least one printing mark 11, from a respective reference value stored in the control unit 1100. Preferably, first a deviation from the reference value is ascertained from the measurement values of the leading edge 07 and/or printing marks 11 provided at the leading edge 07. A deviation of the position of the side edge 09 as a result of the format of the sheet 02 is preferably subtracted from the skewed position of the sheet 02 ascertained therefrom. This is preferably followed by a shortening of the path that the sheet 02 has to cover between the alignment position PA and the transfer position PU. This shortening is preferably subtracted and/or taken into consideration in the signal for the respective servo drives 218, which control by closed-loop control and/or open-loop control the transport of the sheet 02 in the transport direction T.

The at least one sheet 02 is preferably transferred from the at least one transport means 204 to the at least one holding element 1202 in the transfer position PU. The at least one holding element 1202, which is in particular configured as a gripper 1202, preferably transports the sheet 02 at least within the at least one die-cutting unit 300 arranged downstream from the infeed unit 200.

During the transfer of the sheet 02, the at least one holding element 1202 of the transport system 1200 preferably remains at the transfer position PU in idle. First, preferably the at least one holding element 1202 of the transport system 1200, which is positioned at the transfer position PU, is closed, preferably before the at least one transport means 204 of the infeed system 202 releases the sheet 02 in the transfer position PU. During the transfer from the at least one transport means 204 to the at least one holding element 1202, the sheet 02 is preferably permanently held by at least one component of the sheet processing machine 01, preferably at least either by the at least one transport means 204 or by the at least one holding element 1202 and/or by both the at least one transport means 204 and/or the at least one holding element 1202, preferably at at least one edge 07; 08; 09, more preferably at least at the leading edge 07.

The at least one holding element 1202, preferably the at least one gripper carriage 1201 assigned to the relevant at least one holding element 1202, is arranged so as to be aligned at the transfer position PU. The at least one holding element 1202 is preferably aligned by at least one positioning element, preferably by at least one register unit for aligning the at least one holding element 1202 at the transfer position PU, and/or is fixed in its position at the transfer position PU. In this way, a transfer to the at least one holding element 1202 and/or continued transport, in the correct position, of the aligned sheet 02 by way of the at least one holding element 1202, at least in the at least one die-cutting unit 300 arranged downstream from the infeed unit 200, is ensured.

The at least one transport means 204 is preferably returned to the alignment position PA, in particular after the respective sheet 02 has been transferred to the at least one holding element 1202 of the transport system 1200. The at least one transport means 204, in particular the at least one holding means 204, preferably has the minimally closed state while the at least one transport means 204 is returned to the alignment position PA. Preferably, while the at least one transport means 204 is returned to the alignment position PA, the at least two front lay marks 203 are pivoted at least partially into the plane of the transport path, in particular as soon as the at least one transport means 204 is arranged upstream from the at least two front lay marks 203 in the transport direction T.

Preferably, the respective sheet 02 is further transported by the at least one holding element 1202 of the transport system 1200 while the at least one transport means 204 is returned to the alignment position PA.

Preferably, an option is provided for locking the infeed system 202, preferably for locking the at least one transport means 204 in the minimally dosed state. The control system 1100 is preferably configured to activate the lock. The control system 1100 is preferably configured to at least temporarily, preferably in the event of a lock, immobilize the at least one transport means 204 in the minimally closed state. The at least one servo drive 231 is preferably configured to set, preferably immobilize, the minimally closed state in the event of a lock. During a lock of the infeed system 202, preferably the immobilization of the at least one transport means 204 in the minimally dosed state, the at least one transport means 204 is moved to the transfer position PU in the minimally closed state, preferably without a sheet 02. Preferably, the processing machine 01 is stopped or reduced to idle, whereupon the sheet 02 that is not transported is guided out of and/or removed from the infeed system 202, preferably removed manually. The lock, preferably the immobilization of the at least one transport means 204 in the minimally dosed state, is preferably carried out when the at least one sheet 02 has a position error which exceeds the alignment possibilities of the infeed system 202. Preferably, the position error exceeds the alignment possibilities of the infeed system 202 when the measured value, preferably the detected position, in the transverse direction A deviates by at least 10 mm (ten millimeters), preferably at least 15 mm (fifteen millimeters), from its reference and/or when the measured value, preferably the detected position, in the transport direction T deviates by at least 3 mm (three millimeters), preferably at least 4 mm (four millimeters), more preferably at least 8 mm (eight millimeters), from its reference, preferably after the rough alignment has been carried out by the at least two front lay marks 203.

The processing machine 01, which is in particular configured as a die-cutting machine 01, is preferably configured to process at least one sheet 02 made of paper and/or corrugated cardboard and/or cardboard. Above and below, processing a substrate 02 describes changing at least one property of the relevant substrate 02 with respect to its physical properties and/or material properties, in particular its mass and/or shape and/or appearance. The respective substrate 02 can be converted into at least one intermediate product that can be further worked and/or an end product by at least one processing operation. Above and below, working a substrate 02 describes changing at least one property of the relevant substrate 02, such as its position and/or physical properties and/or material properties. The infeed system 202 is preferably configured to guide sheets 02 to a unit 300; 400; 500; 600; 650; 700; 800; 900 arranged downstream in the transport direction T, in particular the shaping unit 300, respective sheets 02 preferably being processed and/or worked in the downstream unit 300; 400; 500; 600; 650; 700; 800; 900.

The at least one stripping unit 400 preferably comprises at least one stripping mechanism 401. The at least one stripping unit 400, in particular the stripping mechanism 401, preferably comprises at least one tool 402; 403. The at least one stripping mechanism 401 preferably comprises at least one tool 402 configured as an upper stripping tool 402 and/or preferably at least one tool 403 configured as a lower stripping tool 403. The at least one stripping mechanism 401 preferably comprises at least one tool 402 configured as an upper stripping tool 402 and/or at least one tool 403 configured as a lower stripping tool 403, wherein the respective stripping tool 402; 403 is preferably configured to be movable in the vertical direction V and/or to move in the vertical direction V. The upper stripping tool 402 is preferably configured to be movable and/or to move with a vertical relative movement with respect to the lower stripping tool 403. The at least one upper stripping tool 402 and the at least one lower stripping tool 403 are preferably configured to be movable relative toward one another and/or away from one another in the vertical direction V. The at least one upper stripping tool 402 and the at least one lower stripping tool 403 are preferably synchronized with respect to one another, and in particular with respect to the multiple-up 03. The at least one upper stripping tool 402 is preferably at least temporarily, preferably at least once per machine cycle, more preferably in a closed position of the at least one stripping mechanism 401, in direct contact with the at least one lower stripping tool 403. The at least one upper stripping tool 402 is preferably spaced apart from the at least one lower stripping tool 403 at a distance of greater than zero in an open position of the stripping mechanism 401.

The respective stripping tool 402; 403 is preferably in contact with, preferably functionally connected to, the at least one drive system 1000 and/or can be at least temporarily driven and/or is driven, preferably by way of a cyclical movement, by the at least one drive 1001 of the drive system 1000. The movement of the respective stripping tools 402; 403 is preferably synchronized and/or can be synchronized in terms of time.

Preferably, the at least one first offcut piece 04 can be separated and/or is separated at least partially, preferably completely, from the at least one multiple-up 03 of the sheet 02 and/or can be removed and/or is removed at least partially, preferably completely, from the at least one sheet 02, by closing the respective stripping tools 402; 403, i.e., by positioning the relevant stripping mechanism 401 in the closed position.

The multiple-up separating unit 500, in particular the multiple-up separating mechanism 501, preferably comprises at least one tool 502. In particular, the at least one multiple-up separating mechanism 501 of the at least one multiple-up separating unit 500 comprises at least one tool 502, which is arranged above in the vertical direction V and configured as an upper multiple-up separating tool 502, and at least one tool (not shown in the figures), which is arranged therebeneath and configured as a lower multiple-up separating tool. The at least one upper multiple-up separating tool 502 and the at least one lower multiple-up separating tool are preferably synchronized with respect to one another, and in particular with respect to the multiple-up 03. The lower multiple-up separating tool comprises a spatial area for stacking and/or storing, on an intermediate basis, the multiple-ups 03. The at least one upper multiple-up separating tool 502 preferably comprises at least one pushing device, in particular a pushing device configured as an elevation of the at least one upper multiple-up separating tool 502. The at least one pushing device is configured so as to be protrudable and, in a closed position of the at least one multiple-up separating mechanism 501, to protrude into the spatial area, in particular into a recess, of the at least one lower multiple-up separating tool. The transport path of the sheet 02, established by the transport system 1200, in particular by the transport system 1200 configured as a chain gripper system 1200, through the at least one multiple-up separating unit 500 is preferably arranged between the at least one upper multiple-up separating tool 502 and the at least one lower multiple-up separating tool in an open position of the relevant multiple-up separating mechanism 501. In a closed position of the relevant multiple-up separating mechanism 501, at least the upper multiple-up separating tool 502 is arranged so as to penetrate into the transport path of the sheet 02. The multiple-ups 03 are separated from the at least one remaining offcut piece 06 by changing the position of the at least one multiple-up separating mechanism 501, preferably only of the upper multiple-up separating mechanism 502, from the open position into the closed position. In particular, a multiple-up 03 is thus arranged so as to be detached from contact with the at least one transport system 1200. This process is, in particular, repeated cyclically and/or periodically by coupling to the at least one drive system 1000. In particular, the position of the at least one multiple-up separating mechanism 501 is changed exactly whenever a sheet 02 is situated in the transport path beneath the at least one upper multiple-up separating tool 502.

In this preferred embodiment, the at least one delivery 600 is, in particular, arranged in the vertical direction beneath the lower multiple-up separating tool. The multiple-ups 03 are preferably stacked on at least one delivery pile after having been stored on an intermediate basis in the lower multiple-up separating tool. The at least one delivery pile preferably comprises at least two, preferably a multiplicity, of individual piles of multiple-ups 03 next to one another. The at least one delivery pile is preferably arranged so as to be movable and/or adjustable in the vertical direction V by means of a lifting device. In particular, it is thus possible to adapt the height of the at least one delivery pile, for example, to the lower multiple-up separating tool and/or to at least one pile formation device 701.

The at least one pile formation device 701, for the purpose of pile formation, is preferably arranged to be movable and/or insertable and/or to move and/or be inserted between the lower multiple-up separating tool and the at least one delivery pile. This is in particular the case when the at least one intermediate reservoir of the at least one lower multiple-up separating tool in the at least one multiple-up separating unit 500 is at least partially, preferably completely, filled with multiple-ups 03 and/or has a sufficiently great instability, so that at least one individual pile is at risk of tilting. In particular, the at least one lifting device is preferably matched to the at least one pile formation device 701, and is in particular arranged in the vertical direction V beneath, preferably without any further device being interposed, the at least one pile formation device 701.

In particular, the offcut pieces 06 in the at least one offcut piece delivery unit 800 are detached by at least one holding element 1202, in particular at least one gripper 1202, of the at least one transport system 1200 and collected as scrap by means of at least one collection device. For example, this at least one collection device is configured as at least one conveyor belt comprising at least one collection container.

The processing machine 01 preferably configured as a sheet processing machine 01 preferably comprises the at least one drive system 1000. The at least one drive system 1000 preferably comprises the at least one drive 1001, which is preferably configured as a central drive. The at least one drive 1001 is preferably arranged outside the transport path of sheets 02 within the sheet processing machine 01. The at least one drive system 1000 preferably comprises those components of the different units 100; 200; 300; 400; 500; 600; 650; 700; 800; 900 that are connected to the at least one drive 1001 and/or are functionally connected to the at least one drive 1001. Depending on their positions within the processing machine 01, the individual components of the drive system 1000, which the drive system 1000 comprises, are preferably likewise assigned to the respective unit 100; 200; 300; 400; 500; 600; 650; 700; 800; 900 encompassing this position and/or are comprised by the respective unit 100; 200; 300; 400; 500; 600; 650; 700; 800; 900.

Preferably in addition or as an alternative, the at least one shaping unit 300 comprises the at least one shaping tool. The at least one stripping unit 400 preferably comprises the at least one stripping tool 402; 403. Preferably in addition or as an alternative, the at least one multiple-up separating unit 500 comprises the at least one multiple-up separating tool 502. Preferably in addition or as an alternative, the infeed unit 200 comprises the at least one infeed drive shaft 1002. Preferably in addition or as an alternative, the processing machine 01 comprises the at least one transport system 1200, preferably the at least one chain transport system 1200 comprising at least one transport means 1201, which is in particular configured as the at least one gripper carriage 1201, and the at least one guide device 1203. Preferably in addition or as an alternative, the at least one drive 1001 is configured to drive at least two components, selected from the at least one shaping tool 302; 303 and/or the at least one stripping tool 402; 403 and/or the at least one multiple-up separating tool 502 and/or the at least one transport system 1200 and/or the at least one infeed drive shaft 1002 of the infeed unit 200.

In addition to the at least one drive 1001, the sheet processing machine 01 preferably comprises at least one dedicated drive, which is configured to drive at least one component of at least one unit 100; 200; 300; 400; 500; 600; 650; 700; 800; 900 independently of the at least one drive 1001.

The at least one drive 1001 is preferably coupled to at least one gear mechanism 1004; 1007 transmitting at least a force and/or torque. The at least one drive 1001 is preferably coupled, preferably directly coupled, to at least one gear mechanism 1004, in particular at least one drawing means gear mechanism 1004. The at least one transmitting gear mechanism 1004, which is in particular coupled directly to the at least one drive 1001, in particular the at least one drawing means gear mechanism 1004, is preferably configured as a positive drawing means gear mechanism 1004, in particular as a toothed belt drive, or as a non-positive drawing means gear mechanism 1004, in particular as a belt drive.

The at least one drawing means gear mechanism 1004 preferably comprises at least one drawing means 1003, which is preferably configured as a belt 1003 or a chain 1003.

Above and below, a gear mechanism describes a system for converting and/or transmitting movements and/or forces. A gear mechanism comprises at least one driving member and at least one driven member. A gear mechanism preferably comprises at least one driving member, at least one driven member, and at least one stand. In a gear mechanism, at least the magnitude and/or the direction of a rotational movement and/or of torque can preferably be transformed and/or are transformed in one or more gear stages. Preferably, the at least one transmitting gear mechanism 1004, which is in particular directly coupled to the at least one drive 1001, is coupled, in particular directly coupled, to at least one, preferably exactly one, drive shaft 1006 configured in particular as the main drive shaft 1006.

Above and below, directly coupled preferably denotes at least a coupling of at least two components, without further connecting members and/or components being interposed.

Above and below, a coupling preferably denotes a machine element for rigidly or elastically or movably or detachably connecting to components to one another. Preferably, mechanical work, for example torque, preferably movement, is transmitted from the one component to the other component, and/or vice versa, by means of the coupling.

The at least one main drive shaft 1006 preferably comprises at least one thread, in particular at least one screw thread. Preferably, the at least one main drive shaft 1006 is coupled via at least one output of at least one gear mechanism, which is preferably configured as a worm gear, to at least one gear mechanism 1007, which is configured as a drive gear 1007. The at least one main drive shaft 1006 is preferably coupled via the at least one output of at least one gear mechanism, which is preferably configured as a worm gear, to at least one drive shaft 1016, which is in particular configured as a die-cutting drive shaft 1016 and which preferably moves the at least one shaping tool. The at least one die-cutting drive shaft 1016 and the at least one drive gear 1007 are preferably coupled via a joint gear mechanism, preferably the gear mechanism configured as a worm gear, to the main drive shaft 1006. Preferably, at least one spur gear 1009 of the drive gear 1007 is arranged at the at least one die-cutting drive shaft 1016 and/or is preferably positively connected to the die-cutting drive shaft 1016.

Preferably, at least one downstream gear mechanism 1019 is arranged downstream from the at least one gear mechanism 1007, in particular downstream from the at least one drive gear 1007. Preferably, the at least one downstream gear mechanism 1019 is arranged within a drive train of the sheet processing machine 01 downstream from the at least one gear mechanism 1007, in particular downstream from the at least one drive gear 1007. Above and below, the drive train of the processing machine 01 preferably denotes the connection of the elements of the drive train 1000. A first element of the drive train is preferably configured as the at least one drive 1001, which is followed by further elements in at least one order established by at least one coupling. The at least one downstream gear mechanism 1019 is preferably configured to convert at least one rotative movement into at least one reciprocating movement. The at least one downstream gear mechanism 1019 is preferably arranged within at least one housing 1014. The at least one downstream gear mechanism 1019 is preferably configured as at least one disk cam mechanism 1019. In addition or as an alternative, the at least one downstream gear mechanism 1019 preferably comprises at least one scanning lever 1024 and at least one cam disk 1023. The at least one gear mechanism 1019, which is preferably configured as a disk cam mechanism 1019, is preferably configured to convert at least one rotative movement into at least one preferably reciprocating movement.

The at least one gear mechanism 1007 and the at least one downstream gear mechanism 1019, in particular the at least one disk cam mechanism 1019, are preferably arranged on the drive side of the sheet processing machine 01 at the at least one shaping unit 300. The at least one gear mechanism 1007 configured as a drive gear 1007 preferably comprises at least two, preferably at least four, more preferably at least five, spur gears 1009; 1011; 1012; 1013; 1021. The at least two spur gears 1009; 1011; 1012; 1013; 1021 of the drive gear 1007 are preferably arranged on the drive side of the sheet processing machine 01 in the at least one housing 1014. The at least two spur gears 1009; 1011; 1012; 1013; 1021 of the at least one drive gear 1007 are preferably arranged on the drive side of the sheet processing machine 01 in the at least one housing 1014 in the transport direction Tat the at least one shaping unit 300. The at least one housing 1014 is preferably arranged on the drive side of the processing machine 01, which is in particular configured as a die-cutting machine 01, at the at least one shaping unit 300.

Preferably, the at least one gear mechanism 1007, in particular the at least one drive gear 1007, and the at least one downstream gear mechanism 1019, in particular the at least one disk cam mechanism 1019, are configured to be oil-lubricated and/or are oil-lubricated. The at least one housing 1014 preferably includes at least one lubricating oil. Preferably, the at least one housing 1014 includes at least one oil bath of the at least two spur gears 1009; 1011; 1012; 1013; 1021 of the at least one drive gear 1007 and/or of the at least one downstream gear mechanism 1019, which is in particular configured as a disk cam mechanism 1019.

Preferably, the at least one spur gear 1009, which is preferably in direct contact with the at least one output of the gear mechanism that is preferably configured as a worm gear, is configured as a die-cutting spur gear 1009. The at least one die-cutting spur gear 1009 is preferably in direct contact with the at least one die-cutting drive shaft 1016. For example, the at least one die-cutting drive shaft 1016 is configured as a crankshaft. Preferably, the at least one die-cutting spur gear 1009 transmits force and/or torque from the at least one drive 1001, at least to the further spur gears 1011; 1012; 1013; 1021 of the at least one drive gear 1007. The at least one die-cutting spur gear 1009 is preferably in contact with at least one spur gear 1012 configured as an infeed spur gear 1012 and/or with at least one spur gear 1013 configured as a chain gripper spur gear 1013 and/or with at least one spur gear 1021 configured as a stripping spur gear 1021. For example, the at least one drive gear 1007 comprises at least one spur gear 1011 configured as a transmitting spur gear 1011, which is arranged between the at least one die-cutting spur gear 1009 and/or the at least one infeed spur gear 1012 and/or the at least one chain gripper spur gear 1013 and/or the at least one stripping spur gear 1021. The at least one infeed spur gear 1012 is preferably arranged to be in, preferably direct, contact with the at least one infeed drive shaft 1002. Preferably, the at least one chain gripper spur gear 1013 is arranged to be in, preferably direct, contact with at least one drive shaft 1017 of the at least one chain transport system 1200 which is configured as a chain gripper drive shaft 1017. The at least one stripping spur gear 1021 is preferably arranged to be in, preferably direct, contact with at least one drive shaft 1022 configured as a stripping drive shaft 1022. The at least one drive 1001 is preferably configured to drive the at least one stripping drive shaft 1022.

The at least one downstream gear mechanism 1019, which is in particular configured as a disk cam mechanism 1019, is preferably arranged at the at least one stripping drive shaft 1022. For example, the at least one downstream gear mechanism 1019, which is preferably configured as a disk cam mechanism 1019, is preferably positively connected to the at least one stripping drive shaft 1022. The at least one cam disk 1023 of the at least one downstream gear mechanism 1019, which is in particular configured as a disk cam mechanism 1019, is preferably configured to be driven and/or drivable by the at least one stripping drive shaft 1022.

Preferably, the at least one infeed spur gear 1012 is arranged in the vertical direction V beneath the at least one chain gripper spur gear 1013 and/or in the transport direction T at the same coordinate of the transport direction T.

Preferably, the at least one chain gripper spur gear 1013 is coupled via at least one gear mechanism to the at least one chain gripper drive shaft 1017 in such a way that the at least one continuous movement of the at least one drive 1001 is converted and/or can be converted into the at least one cyclical and/or periodic and/or discontinuous movement of the at least one chain gripper system 1200 for sheet transport. The at least one chain gripper spur gear 1013 is preferably positively connected to at least one shaft. At least one further shaft, preferably the at least one chain gripper drive shaft 1017, is preferably mounted in the at least one shaft to which the at least one chain gripper spur gear 1013 is connected, wherein the at least two shafts are preferably mounted to be movable at least partially independently of one another. The at least two shafts are preferably functionally connected to one another via at least one toothed segment. The at least one chain gripper spur gear 1013 is preferably configured to transmit at least one rotative movement to the at least one toothed segment. The at least one toothed segment is preferably configured to be forcibly guided along at least one cam. The at least one toothed segment preferably transmits at least one preferably cyclical and/or periodic and/or discontinuous rotative movement to at least one gear wheel, which is preferably positively connected to the at least one chain gripper drive shaft 1017. The transmission of movement from the at least one toothed segment to the at least one gear wheel is preferably dependent on the movement profile that the at least one toothed segment carries out as a result of the guide cam. The at least one chain gripper drive shaft 1017 preferably comprises at least one gear wheel, in particular at least two gear wheels, each being in direct contact with the at least one chain 1203 of the chain gripper system 1200 and/or each driving the at least one chain 1203. Preferably, at least one gear wheel is in each case arranged at the at least one chain gripper drive shaft 1017 in the transverse direction A upstream from the transport path of sheets 02, and in each case at least one gear wheel is arranged at the at least one chain gripper drive shaft 1017 in the transverse direction A downstream from the transport path of sheets 02.

At least one cam disk 1041 is preferably arranged at the at least one die-cutting drive shaft 1016, preferably on the drive side of the processing machine 01. The at least one cam disk 1041 of the die-cutting drive shaft 1016 is preferably arranged within the housing 1014 of the driving gear 1007. The at least one cam disk 1041 is preferably positively connected to the die-cutting drive shaft 1016. The at least one cam disk 1041 of the die-cutting drive shaft 1016 is preferably arranged in the transverse direction A downstream from the at least one die-cutting spur gear 1009, i.e., is preferably arranged further away from the transport path of sheets 02 than the at least one die-cutting spur gear 1009.

The at least cam disk 1041 of the die-cutting drive shaft 1016 is preferably assigned at least one tapping member 1042. The at least one tapping member 1042 preferably comprises at least one pick-up, which is arranged to be in direct contact with the at least one cam disk 1041. The at least one tapping member 1042 is preferably connected to at least one lifting device 1044 via at least one connecting element 1043. The at least one lifting device 1044 is preferably in contact with the at least one guide device 1203 of the at least one chain transport system 1200, in particular in contact with at least one rail and/or supporting surface of the at least one guide device 1203. Preferably, at least one component of the at least one lifting device 1044 is at least temporarily moved in the vertical direction V, as a result of the scanning of the at least one cam disk 1041 by means of the at least one tapping member 1042, in such a way that the at least one guide device 1203, which is in particular configured as a chain 1203, is at least temporarily displaced along the vertical direction V out of a guide path of the guide device 1203. In particular the at least one supporting surface and/or rail of the at least one guide device 1203 is preferably at least temporarily moved in the vertical direction V, whereby the at least one guide device 1203 is at least temporarily moved in the vertical direction V. The at least one guide device 1203 is preferably displaced out of its guide path in the vertical direction V precisely when a sheet 02 is transported from at least one unit 300; 400; 500; 650 processing the sheet 02 to the subsequent unit 400; 500; 650 processing the sheet 02, preferably the at least one sheet 02.

The guide path of the guide device 1203 is preferably the spatial area that is at least temporarily taken up by the at least one guide device 1203. The at least one guide device 1203 is preferably configured to at least temporarily guide the at least one transport means 1201 on the guide path. The guide path is preferably established by multiple components of the sheet processing machine 01. For example, the at least one sheet processing machine 01 comprises different guide elements and/or the at least one supporting surface of the guide device 1203 and/or the at least one rail of the guide device 1203.

Via the at least one gear mechanism 1007, preferably the at least one drive gear 1007, the at least one drive 1001 preferably drives the at least one tool 402; 403, configured as a stripping tool 402; 403, of the at least one stripping mechanism 401 of the at least one stripping unit 400 and/or at least one tool 502, configured as a multiple-up separating tool 502, of at least one multiple-up separating mechanism 501 of the at least one multiple-up separating unit 500. The at least one drive 1001 is preferably configured to drive, via the at least one gear mechanism 1007, preferably the drive gear 1007, the at least one stripping tool 402; 403 of the at least one stripping mechanism 401 of the at least one stripping unit 400 and/or the at least one multiple-up separating tool 502 of the at least one multiple-up separating mechanism 501 of the at least one multiple-up separating unit 500. The at least one drive 1001 is preferably connected via the at least one gear mechanism 1007, which is in particular configured as the at least one drive gear 1007, to the at least one stripping drive shaft 1022. The at least one stripping spur gear 1021 is preferably arranged to be in, preferably direct, contact with the at least one stripping drive shaft 1022. The at least one stripping spur gear 1021 is preferably positively connected to the at least one stripping drive shaft 1022. The at least one stripping drive shaft 1022 is preferably configured to drive the at least one tool 402; 403, configured as the stripping tool 402; 403, of the at least one stripping mechanism 401 of the at least one stripping unit 400 and/or the at least one tool 502, configured as the multiple-up separating tool 502, of the at least one multiple-up separating mechanism 501 of the at least one multiple-up separating unit 500.

The at least one downstream gear mechanism 1019, which is in particular configured as a disk cam mechanism 1019, is preferably in contact with the at least one stripping drive shaft 1022. At least one cam disk 1023, preferably at least two cam disks 1023, more preferably exactly two cam disks 1023, of the at least one gear mechanism 1019, which is in particular configured as a disk cam mechanism 1019 and arranged downstream from the at least one drive gear 1007, is arranged at the at least one stripping drive shaft 1022. The at least one disk cam mechanism 1019, preferably the at least one cam disk 1023, is preferably arranged within the at least one housing 1014 of the at least one drive gear 1007. The at least one cam disk 1023 is preferably arranged downstream from the at least one stripping spur gear 1021 in the transverse direction at the at least one stripping drive shaft 1022, i.e., in particular further away from the transport path. The at least one cam disk 1023, preferably the at least two cam disks 1023, are preferably positively connected to the at least one stripping drive shaft 1022.

The at least one downstream gear mechanism 1019, which is in particular configured as a disk cam mechanism 1019, is preferably coupled to the at least one stripping tool 402; 403, preferably the at least one upper stripping tool 402 and/or preferably the at least one lower stripping tool 403, of the at least one stripping unit 400 and/or to the at least one multiple-up separating tool 502, preferably the at least one upper multiple-up separating tool 502, of the at least one multiple-up separating unit 500. The at least one stripping tool 402; 403, preferably the at least one upper stripping tool 402 and/or preferably the at least one lower stripping tool 403, of the at least one stripping unit 400 and/or the at least one multiple-up separating tool 502, preferably the at least one upper multiple-up separating tool 502, of the at least one multiple-up separating unit 500 are moved and/or can be moved in and/or counter to a vertical direction V by the at least one downstream gear mechanism 1019.

At least one transmitting element 1026; 1027; 1028; 1029 is preferably arranged between the at least one downstream gear mechanism 1019 and the at least one stripping tool 402; 403. Preferably, at least one transmitting element 1026; 1027; 1028; 1029 is arranged between the at least one downstream gear mechanism 1019 and the at least one multiple-up separating tool 502. The at least one gear mechanism 1019, which is in particular configured as a disk cam mechanism 1019 and arranged downstream from the at least one drive gear 1007, is preferably coupled to at least one transmitting element 1026; 1027; 1028; 1029.

At least one, preferably exactly one, scanning lever 1024, which is in particular configured as a roller lever 1024, is preferably assigned in each case to the at least one cam disk 1023. A respective scanning lever 1024 is preferably in contact with the at least one cam disk 1023 of the at least one stripping drive shaft 1022. At least one element, for example at least one roller, of the scanning lever 1024 is preferably permanently in direct contact with the respective cam disk 1023. The at least one scanning lever 1024 is preferably pivotably mounted. The at least one scanning lever 1024 of the at least one downstream gear mechanism 1019 is preferably configured to be at least reciprocatingly movable and/or to move reciprocatingly.

The respective one scanning lever 1024 is preferably coupled to the at least one transmitting element 1026; 1027; 1028; 1029. The at least one scanning lever 1024 is preferably coupled to the at least one transmitting element 1026; 1027; 1028; 1029. In particular, a scanning lever 1024 is in each case coupled to at least one respective transmitting element 1026; 1027; 1028; 1029. Preferably, the end of the at least one scanning lever 1024 which is located opposite the at least one element of the scanning lever 1024 that is in contact with the at least one cam disk 1023 is coupled to the at least one transmitting element 1026; 1027; 1028; 1029. The at least one transmitting element 1026; 1027; 1028; 1029 is preferably coupled to the at least one stripping tool 402; 403 of the at least one stripping unit 400 and/or to the at least one multiple-up separating tool 502 of the at least one multiple-up separating unit 500. The at least one transmitting element 1026; 1027; 1028; 1029 is preferably configured as a beam and/or a rod.

Above and below, a beam describes a supporting element that is several times greater at least along the direction of its largest extension than orthogonal to this direction. A beam can preferably be subjected to stress transversely and/or along its longitudinal axis. Above and below, a rod describes a supporting element that is thin along its cross-section compared to its longitudinal axis with the largest extension. A rod can preferably be subjected to tensile stress and/or compressive stress.

The at least one transmitting element 1026; 1027; 1028; 1029 is preferably configured to carry out at least one reciprocating movement. The at least one reciprocating movement of the at least one transmitting element 1026; 1027; 1028; 1029 preferably corresponds to at least one movement in at least one direction that is arranged in a plane spanned by the transport direction T and the vertical direction V. The at least one transmitting element 1026; 1027; 1028; 1029 is preferably configured to move and/or movable in the at least one direction, at least along its longitudinal axis, the axis along the direction of its largest extension, the direction being arranged in the plane spanned by the transport direction T and the vertical direction V.

Above and below, a reciprocating movement describes at least one movement from a first position, the starting position, of a component toward at least a second position, which is preferably followed by at least one movement in the opposite direction, i.e., from the at least one second position back into the starting position. A component that is moved reciprocatingly preferably first describes at least one movement out of its starting position into at least one second position and, subsequent thereto, at least one movement back into this starting position. A reciprocating movement preferably takes place within a two-dimensional plane.

The at least one stripping tool 402; 403, preferably at least the at least one upper stripping tool 402 and/or the at least one lower stripping tool 403, and/or the at least one multiple-up separating tool 502, preferably at least the at least one upper multiple-up separating tool 502, are preferably in each case arranged to be movable and/or are moved linearly in the vertical direction V by a transmission and/or by a conversion of at least one reciprocating movement of at least one transmitting element 1026; 1027; 1028; 1029 to the at least one stripping tool 402; 403 and/or to the at least one multiple-up separating tool 502.

The sheet processing machine 01 preferably comprises the at least one transmitting element 1026; 1027; 1028; 1029, preferably at least two transmitting elements 1026; 1027; 1028; 1029, more preferably at least four transmitting elements 1026; 1027; 1028; 1029. The at least one transmitting element 1026; 1027; 1028; 1029 is preferably configured to be reciprocatingly movable and/or to move reciprocatingly.

The sheet processing machine 01 preferably comprises at least one vertical transmitting element 1026; 1027 and/or at least one horizontal transmitting element 1028; 1029. The sheet processing machine 01 preferably comprises at least one transmitting element 1026; 1027 configured as a vertical transmitting element 1026; 1027 and/or at least one transmitting element 1028; 1029 configured as a horizontal transmitting element 1028; 1029. The at least one transmitting element 1026; 1027; 1028; 1029 coupled to the at least one downstream gear mechanism 1019, in particular the at least one drive gear 1007, in particular the at least one disk cam mechanism 1019, is preferably configured as at least one vertical transmitting element 1026; 1027, which is arranged to be, in particular reciprocatingly, movable at least in the vertical direction V. The at least one vertical transmitting element 1026; 1027 is preferably moved at least in the vertical direction V, preferably reciprocatingly. In addition to being coupled to the at least one downstream gear mechanism 1019, in particular the at least one disk cam mechanism 1019, the at least one vertical transmitting element 1026; 1027 is preferably coupled to at least one horizontal transmitting element 1028; 1029, which is arranged to be reciprocatingly movable and/or to move reciprocatingly at least in a horizontal direction, in particular with at least one component along the transport direction T. The at least one horizontal transmitting element 1028; 1029 is preferably moved, preferably reciprocatingly, at least in a horizontal direction, in particular with at least one component along the transport direction T.

Preferably, a respective vertical transmitting element 1026 and/or a respective horizontal transmitting element 1028 are each configured as at least one upper transmitting element 1026; 1028. Preferably, a respective vertical transmitting element 1027 and/or a respective horizontal transmitting element 1029 are each configured as at least one lower transmitting element 1027; 1029.

The sheet processing machine 01 preferably comprises the at least one upper transmitting element 1026; 1028. The at least one upper transmitting element 1026; 1028 is preferably in each case coupled to the at least one upper stripping tool 402 and the at least one upper multiple-up separating tool 502. Preferably, at least one of the transmitting elements 1026; 1027; 1028; 1029 coupled to the at least one downstream gear mechanism 1019 is configured as the at least one upper transmitting element 1026; 1028, wherein the at least one upper transmitting element 1026; 1028 is in each case coupled to the at least one upper stripping tool 402 and the at least one upper multiple-up separating tool 502.

Preferably in addition or as an alternative, the sheet processing machine 01 comprises the at least one lower transmitting element 1027; 1029. The at least one lower transmitting element 1027; 1029 is preferably coupled to the at least one lower stripping tool 403. At least one of the transmitting elements 1026; 1027; 1028; 1029 coupled to the at least one downstream gear mechanism 1019 is preferably configured as the at least one lower transmitting element 1027; 1029, wherein the at least one lower transmitting element 1027; 1029 is coupled to the at least one lower stripping tool 403.

The sheet processing machine 01 preferably comprises at least two, preferably at least four, more preferably at least six, transmitting elements 1026; 1027; 1028; 1029. Preferably, at least one of the transmitting elements 1026; 1027; 1028; 1029 is in each case arranged on the operator side of the sheet processing machine 01, and at least one of the transmitting elements 1026; 1027; 1028; 1029 is arranged on the drive side of the sheet processing machine 01. In a preferred embodiment, at least one horizontal transmitting element 1028; 1029 is in each case arranged on the operator side of the sheet processing machine 01, and in each case at least one horizontal transmitting element 1028; 1029 is arranged on the drive side of the sheet processing machine 01. The drive side and the operator side are preferably arranged parallel to the transport direction T of sheets 02 and opposite one another with respect to the transport path of sheets 02. The at least one upper stripping tool 402 is preferably coupled to at least two horizontal transmitting elements 1028, which are preferably arranged behind one another in the transverse direction A and parallel to one another. The at least one upper multiple-up separating tool 502 is preferably coupled to at least two horizontal transmitting elements 1028, which are preferably arranged behind one another in the transverse direction A and parallel to one another. Preferably, the at least one upper stripping tool 402 and the at least one upper multiple-up separating tool 502 are coupled via the same, preferably horizontal, transmitting elements 1028. Preferably, the at least one lower stripping tool 403 is coupled to at least two horizontal transmitting elements 1029, which are preferably arranged behind one another in the transverse direction A and parallel to one another.

The sheet processing machine 01 preferably comprises at least two transmitting elements 1026; 1027; 1028; 1029. Preferably, one cam disk 1023 and one scanning lever 1024 are in each case functionally connected to one of the at least two transmitting elements 1026; 1027; 1028; 1029. Preferably, the at least one disk cam mechanism 1019 comprises at least two, preferably exactly two, cam disks 1023, which are each in contact with a scanning lever 1024, wherein the respective scanning lever 1024 is either coupled to the at least one upper transmitting element 1026; 1028 or to the at least one lower transmitting element 1027; 1029.

The at least one transmitting element 1026; 1027; 1028; 1029 coupled to the at least one scanning lever 1024 is preferably configured as the at least one vertical transmitting element 1026; 1027, which is arranged to be linearly movable at least in the vertical direction V. Preferably in addition or as an alternative, the at least one vertical transmitting element 1026; 1027, in addition to being coupled to the at least one scanning lever 1024, is coupled to the at least one horizontal transmitting element 1028; 1029, which is arranged to be linearly movable at least in a horizontal direction, preferably at least in and/or counter to the transport direction T. The at least one vertical transmitting element 1026; 1027 is preferably arranged within the at least one housing 1014 of the at least one drive gear 1007.

The at least one drive system 1000 and/or the at least one stripping unit 400 and/or the at least one multiple-up separating unit 500 preferably comprise at least one movement converter 1031; 1032. The at least one movement converter 1031; 1032 is preferably configured as an upper movement converter 1031 or as a lower movement converter 1032. The at least one drive system 1000 and/or the at least one stripping unit 400 and/or the at least one multiple-up separating unit 500 preferably comprise the at least one movement converter 1031 configured as the upper movement converter 1031 and/or the at least one movement converter 1032 configured as the lower movement converter 1032. The at least one movement converter 1031; 1032 is preferably coupled to the at least one drive 1001 via the at least one transmitting element 1026; 1027; 1028; 1029. The at least one stripping tool 402; 403 is preferably in each case coupled to at least one transmitting element 1026; 1027; 1028; 1029 via the at least one movement converter 1031; 1032. The at least one multiple-up separating tool 502 is preferably in each case coupled to at least one transmitting element 1026; 1027; 1028; 1029 via the at least one movement converter 1031; 1032. The at least one transmitting element 1026; 1027; 1028; 1029 is preferably eccentrically arranged, preferably mounted, at the at least one movement converter 1031; 1032.

The at least one movement converter 1031; 1032 is preferably configured as at least one gear mechanism. The at least one movement converter 1031; 1032 is preferably configured as at least one joint 1031; 1032. More preferably, the at least one movement converter 1031; 1032 is configured as at least one gear mechanism and/or as at least one joint 1031; 1032. Above and below, a joint denotes a movable connection between machine parts or parts of a technical device. For example, the joint 1031; 1032 comprises at least one bearing.

The at least one transmitting element 1026; 1027; 1028; 1029 preferably comprises at least one movable connection to the at least one respective movement converter 1031; 1032. The at least one transmitting element 1026; 1027; 1028; 1029 is preferably arranged to be pivotable and/or to pivot about the respective assigned at least one movement converter 1031; 1032. Preferably, the at least one movement converter 1031; 1032 comprises at least one pivot axis, the at least one transmitting element 1026; 1027; 1028; 1029 being arranged to be pivotable and/or to pivot about the pivot axis around the respective at least one movement converter 1031; 1032. The at least one movement converter 1031; 1032 is preferably configured to convert the at least one preferably reciprocating movement of the at least one transmitting element 1026; 1027; 1028; 1029 connected thereto into at least one at least partially rotative movement. The at least one movement converter 1031; 1032 is preferably configured to convert the at least one reciprocating movement of the at least one transmitting element 1026; 1027; 1028; 1029 into at least one rotative movement of at least one transmitting shaft 1033.

The at least one upper stripping tool 402 is preferably coupled to at least the at least one transmitting element 1028 via the at least one, preferably via at least two movement converters 1031. The at least one upper stripping tool 402 is preferably coupled to at least the at least one horizontal upper transmitting element 1028 via the at least one, preferably via at least two upper movement converters 1031. The at least one upper stripping tool 402 is preferably coupled to at least the at least one horizontal upper transmitting element 1028 via the at least one, preferably via at least two movement converters 1031 configured as upper movement converters 1031. The at least one lower stripping tool 403 is preferably coupled to at least the at least one transmitting element 1029 via the at least one, preferably via at least two movement converters 1032. The at least one lower stripping tool 403 is preferably coupled to at least the at least one horizontal lower transmitting element 1029 via the at least one, preferably via at least two lower movement converters 1032. The at least one lower stripping tool 403 is preferably coupled to at least the at least one horizontal lower transmitting element 1029 via the at least one, preferably via at least two movement converters 1032 configured as lower movement converters 1032. Preferably in addition or as an alternative, the at least one multiple-up separating tool 502, preferably the at least one upper multiple-up separating tool 502, is coupled to the at least one transmitting element 1028 via at least one upper movement converter 1031. The at least one upper multiple-up separating tool 502 is preferably coupled to at least the at least one horizontal upper transmitting element 1028 via the at least one, preferably via at least two movement converters 1031. The at least one stripping tool 402 is preferably configured as an upper stripping tool 402. Preferably in addition, the at least one multiple-up separating tool 502 is configured as an upper multiple-up separating tool 502. The at least one upper stripping tool 402 and the at least one upper multiple-up separating tool 502 are preferably coupled to at least one joint transmitting element 1026; 1028.

The at least one stripping tool 402, in particular the upper stripping tool 402, and the at least one multiple-up separating tool 502, in particular the upper multiple-up separating tool 502, are preferably coupled to the at least one drive 1001 via at least one joint transmitting element 1028. The at least one stripping tool 402, in particular the upper stripping tool 402, and the at least one multiple-up separating tool 502, in particular the upper multiple-up separating tool 502, are preferably coupled to the at least one drive 1001 by the at least one stripping drive shaft 1022 via at least one joint transmitting element 1028. The at least one gear mechanism 1019, in particular the at least one disk cam mechanism 1019, which is configured to turn at least one rotative movement into at least one reciprocating movement, is arranged between the at least one drive 1001, preferably at least between the at least one stripping drive shaft 1022, and the at least one transmitting element 1028. The at least one movement converter 1031; 1032, which is configured to turn at least one reciprocating movement into at least one rotative movement, is arranged between the at least one transmitting element 1028 and the at least one stripping tool 402 and/or the at least one multiple-up separating tool 502.

The at least one movement converter 1031; 1032 is preferably configured to convert the at least one preferably reciprocating movement of the at least one transmission element 1026; 1027; 1028; 1029 into at least one at least partially rotative movement of the at least one transmission shaft 1033. The at least one movement converter 1031; 1032 is preferably in each case coupled via the at least one transmitting shaft 1033 to the at least one stripping tool 402; 403, preferably to the at least one upper stripping tool 402 or the at least one lower stripping tool 403. In addition, or as an alternative, the at least one movement converter 1031 is preferably in each case coupled via the at least one transmitting shaft 1033 to the at least one multiple-up separating tool 502, preferably the upper multiple-up separating tool 502. At least one movement converter 1031; 1032 is preferably in each case coupled via the at least one transmitting shaft 1033 to the at least one stripping tool 402; 403, preferably to the at least one upper stripping tool 402 or the at least one lower stripping tool 403. Preferably in addition or as an alternative, at least one movement converter 1031 is in each case coupled via the at least one transmitting shaft 1033 to the at least one multiple-up separating tool 502, preferably the upper multiple-up separating tool 502. The at least one stripping tool 402; 403 and/or the at least one multiple-up separating tool 502 are preferably each coupled via at least two transmitting shafts 1033 to at least two movement converters 1031; 1032.

The at least one pivot axis of the at least one movement converter 1031; 1032, about which the at least one transmitting element 1026; 1027; 1028; 1029 is arranged to be pivotable and/or to pivot, is preferably arranged and/or oriented at least parallel to an axis of rotation of the at least one transmitting shaft 1033. The at least one pivot axis of the at least one movement converter 1031; 1032, about which the at least one transmitting element 1028 is arranged to be pivotable and/or to pivot, is preferably arranged parallel to the transverse direction A.

Preferably, at least one connecting rod is preferably positively connected to the at least one transmitting shaft 1033. The at least one connecting rod preferably comprises at least one main rod 1034. The at least one connecting rod is preferably configured to turn at least one rotative movement of the relevant transmitting shaft 1033 into at least one reciprocating movement. The at least one connecting rod 1034 is preferably directly coupled to the at least one stripping tool 402; 403 or the at least one multiple-up separating tool 502. Preferably, the at least one stripping tool 402; 403 or the at least one multiple-up separating tool 502 is functionally connected via the at least one main rod 1034 to the at least one transmitting shaft 1033. Above and below, a connecting rod and/or main rod describe a connection between at least one shaft and a linearly movable component eccentrically mounted on this shaft, whereby at least one rotative movement is converted and/or can be converted into at least one linear movement, or vice versa.

The at least one stripping mechanism 401 preferably comprises at least one guide element 1037 of the at least one stripping tool 402; 403, preferably at least two guide elements 1037. More preferably, the at least one stripping mechanism 401 comprises at least four guide elements 1037 per stripping tool 402; 403. The at least one multiple-up separating mechanism 501 preferably comprises at least one guide element 1037 of the at least one multiple-up separating tool 502, preferably at least two guide elements 1037. More preferably, the at least one multiple-up separating mechanism 501 comprises at least four guide elements 1037 per multiple-up separating tool 502. The at least one guide element 1037 is preferably configured as a linear guide element 1037. The at least one guide element 1037 is preferably configured to linearly guide, preferably in the vertical direction V, the respective stripping tool 402; 403 or the respective multiple-up separating tool 502.

The at least one stripping mechanism 401 and/or the at least one multiple-up separating mechanism 501 in each case preferably comprise at least one tensioning element 1036 generating at least compressive stress, preferably at least one spring 1036, more preferably at least one compression spring. The respective stripping mechanism 401 preferably in each case comprises at least four tensioning elements 1036 per stripping tool 402; 403. The respective multiple-up separating mechanism 501 preferably in each case comprises at least four tensioning elements 1036 per multiple-up separating tool 502. The at least one tensioning element 1036 is preferably configured to generate compressive stress at least in and/or counter to the vertical direction V. The at least one tensioning element 1036 is preferably configured to push the at least one scanning lever 1024 against the at least one cam disk 1023 of the at least one stripping drive shaft 1022.

The respective at least one tensioning element 1036 is preferably configured to be tensioned when the at least one stripping tool 402; 403 and/or the at least one multiple-up separating tool 502 are each in a first position. The respective at least one tensioning element 1036 is preferably configured to be relaxed when the at least one stripping tool 402; 403 and/or the at least one multiple-up separating tool 502 are each in a second position.

Preferably, the at least one stripping tool 402; 403 and/or the at least one multiple-up separating tool 502, in the first position, are arranged spaced apart from the transport path of sheets 02 at a distance of greater than zero. Preferably, the at least one stripping tool 402; 403 and/or the at least one multiple-up separating tool 502, in the second position, with respect to the transport path of sheets 02, are arranged to be in direct contact with the transport path and/or at least partially within the transport path. The at least one stripping mechanism 401 is preferably closed when the at least one stripping tool 402; 403 is in the second position.

The at least one tensioning element 1036 is preferably configured to transfer the respective stripping tool 402; 403 assigned thereto and/or the respective multiple-up separating tool 502 assigned thereto at least from the respective first position into the second position. Preferably, the at least one reciprocating movement of the at least one transmitting element 1026; 1027; 1028; 1029 is superimposed by the generated compressive stress of the at least one tensioning element 1036. The at least one stripping tool 402; 403 and/or the at least one multiple-up separating tool 502 are, preferably exclusively, transferred by the at least one reciprocating movement of the at least one transmitting element 1026; 1027; 1028; 1029 from the respective second position into the respective first position.

The at least one drive 1001 is preferably configured to drive the at least one main drive shaft 1006 via the at least one drawing means gear mechanism 1004. The at least one main drive shaft 1006 is preferably configured to cause to move and/or to drive the at least one gear mechanism 1007. The at least one main drive shaft 1006 is preferably configured to drive the at least one die-cutting drive shaft 1016. The at least one shaping tool of the at least one shaping mechanism 301 is preferably driven and/or in particular is moved in the vertical direction V by the at least one die-cutting drive shaft 1016. The at least one die-cutting spur gear 1009 preferably drives at least one transmitting spur gear 1011. The at least one transmitting spur gear 1011 preferably drives the at least one infeed spur gear 1012 and, preferably in addition or as an alternative, the at least one stripping spur gear 1021. The at least one infeed spur gear 1012 preferably drives the at least one infeed drive shaft 1002. The at least one infeed spur gear 1012 preferably drives the at least one chain gripper spur gear 1013. As an alternative, for example, at least one transmitting spur gear 1011, for example a second transmitting spur gear 1011, drives the at least one chain gripper spur gear 1013. The at least one chain gripper spur gear 1013 preferably drives the at least one chain gripper drive shaft 1017.

The at least one downstream gear mechanism 1019 preferably comprises the at least one stripping spur gear 1021. The at least one stripping spur gear 1021 preferably drives the at least one stripping drive shaft 1022. The at least one cam disk 1023, in particular the at least two cam disks 1023, of the stripping drive shaft 1022 is preferably rotated and/or driven via the at least one stripping drive shaft 1022. The at least one cam disk 1023, in particular the at least two cam disks 1023, of the at least one downstream gear mechanism 1019, which is preferably configured as a disk cam mechanism 1019, is preferably rotated and/or driven via the at least one stripping drive shaft 1022. The at least one cam disk 1023 of the at least one stripping drive shaft 1022 is preferably functionally connected to the at least one respective scanning lever 1024. The at least one scanning lever 1024 preferably pivots according to the movement of the cam disk 1023 assigned thereto. The at least one scanning lever 1024 is preferably directly coupled to the at least one transmitting element 1026; 1027, which is in particular configured as a vertical transmitting element 1026; 1027 and which is preferably reciprocatingly moved by the pivoting movement of the at least one scanning lever 1024. The at least one vertical transmitting element 1026; 1027 is preferably at least reciprocatingly moved with one component in the vertical direction V.

The at least vertical transmitting element 1026; 1027 is preferably in direct contact with the at least one movement converter 1031; 1032. The at least one movement converter 1031; 1032, which is directly coupled to the at least one vertical transmitting element 1026; 1027, preferably pivots about the axis of rotation of the transmitting shaft 1033 connected thereto. The at least one transmitting shaft 1033 connected to the at least one movement converter 1031; 1032 is preferably rotated and/or pivoted about its axis of rotation as a result of the pivoting of the at least one movement converter 1031; 1032. The at least one horizontal transmitting element 1028; 1029 is preferably directly coupled to the at least one movement converter 1031; 1032. The at least one horizontal transmitting element 1028; 1029 is preferably coupled to the at least one vertical transmitting element 1026; 1027 via the at least one movement converter 1031; 1032. As a result of the reciprocating movement of the at least one vertical transmitting element 1026; 1027 and/or as a result of the at least one pivoting of the at least one movement converter 1031; 1032, which is preferably connected to the at least one vertical transmitting element 1026; 1027 and/or is connected to the at least one scanning lever 1024, the at least one horizontal transmitting element 1028; 1029 is reciprocatingly moved in the at least one direction, the direction being arranged in the plane spanned by the transport direction T and the vertical direction V.

The at least one movement converter 1031; 1032, which is connected to the at least one horizontal transmitting element 1028; 1029, is preferably pivoted and/or moved by the at least one reciprocating movement of the respective horizontal transmitting element 1028; 1029. The respective transmitting shaft 1033, which is functionally connected to the respective horizontal transmitting element 1028; 1029 via the at least one movement converter 1031; 1032, is preferably moved to at least partially pivot and/or at least partially rotate about its axis of rotation. As a result of the at least partial pivoting the at least one transmitting shaft 1033, the at least one main rod 1034 connected to this respective transmitting shaft 1033 is preferably moved at least with at least one component in the vertical direction V.

The at least one upper stripping tool 402 and/or the at least one upper multiple-up separating tool 502 are preferably functionally connected to the at least one upper horizontal transmitting element 1028. As a result of the at least one guide element 1037, the at least one upper stripping tool 402 and/or the at least one upper multiple-up separating tool 502 are preferably moved in and/or counter to the vertical direction V, in particular due to the movement of the at least one main rod 1034 and/or due to the movement of the at least one transmitting shaft 1033 and/or due to the movement of the at least one upper horizontal transmitting element 1028.

The at least one lower stripping tool 403 is preferably functionally connected to the at least one lower transmitting element 1029. As a result of the at least one guide element 1037, the at least one lower stripping tool 403 is preferably moved in and/or counter to the vertical direction V, in particular due to the movement of the at least one main rod 1034 and/or due to the movement of the at least one transmitting shaft 1033 and/or due to the movement of the at least one lower horizontal transmitting element 1029.

The at least one lower stripping tool 403 is preferably moved in a manner that is diametrically opposed to the at least one upper stripping tool 402, so that the two move in the vertical direction V toward one another and/or away from one another. As a result of closing the stripping mechanism 401, i.e., moving the upper stripping tool 402 and the lower stripping tool 403 toward one another, in particular offcut pieces 04 configured as scrap pieces 04 are removed from the respective, preferably at least one, sheet 02.

The at least one sheet processing machine 01, which is in particular configured as a die-cutting machine 01, comprises at least one central lubrication system. The at least one central lubrication system is preferably configured as a central lubricating system which is a device for supplying one and/or more lubricating points within the processing machine 01 with lubricant. The at least one lubrication system is preferably configured to lubricate components, preferably at least one component, more preferably at least two components, of the individual units 100; 200; 300; 400; 500; 600; 650; 700; 800; 900. Preferably, at least two units 100; 200; 300; 400; 500; 600; 650; 700; 800; 900 of the units 100; 200; 300; 400; 500; 600; 650; 700; 800; 900 are connected to the at least one central lubrication system. The at least one lubrication system is configured to conduct at least one lubricant from at least one source of lubricants and/or from at least one reservoir of lubricants to at least two units 200; 300; 400; 500 of the units 200; 300; 400; 500. The die-cutting machine 01 comprises at least the at least one unit 200, configured as an infeed unit 200, and the at least one unit 300, configured as a shaping unit 300, and the at least one unit 400, configured as a stripping unit 400, and the at least one unit 500, configured as a multiple-up separating unit 500.

Above and below, a lubricating agent and/or lubricant describes a substance that is configured to lubricate at least one movable component with respect to at least one further component of the processing machine 01. The lubricant is configured to reduce friction and/or wear and, in addition or as an alternative, is configured to at least partially cool the at least one movable component within a contact region between the lubricant and the relevant component. Preferably in addition, the at least one lubricant is preferably configured to be vibration-damping and/or is configured to at least partially protect the relevant component against corrosion. In addition or as an alternative, the at least one lubricant is configured to seal the at least one movable component of the processing machine 01, at least within the contact region. The at least one lubricant preferably comprises at least one lubricating oil or at least one lubricating grease. Lubricating oils are preferably liquid, in particular low-viscosity, lubricants. Lubricating greases are preferably at least semi-liquid lubricants having a higher viscosity than lubricating oils. In addition to at least one lubricating oil, lubricating greases preferably comprise at least one thickener and/or at least one additive. A lubricating grease preferably comprises at least 60% lubricating oil, preferably at least 70% lubricating oil, and, in addition to the at least one lubricating oil, at least 2.5% thickener, preferably at least 5% thickener, and/or, in addition to the at least one lubricating oil, at least 8% of at least one additive, preferably at least 12% of at least one additive. For example, the at least one lubricant comprises at least one mineral oil and/or at least one synthetic oil. For example, the at least one thickener comprise a lithium soap solution.

For example, the at least one lubrication system comprises at least one pump 1046. The at least one lubrication system preferably comprises exactly one pump 1046, alternatively at least two pumps 1046. The at least one pump 1046 is preferably connected to a first main line 1047. For example, the at least one reservoir of lubricant and/or the at least one source of lubricant comprise the at least one pump 1046. The at least one pump 1046 is preferably configured to pump lubricant from the at least one source of lubricant and/or from the at least one reservoir of lubricant to the respective unit 100; 200; 300; 400; 500; 600; 650; 700; 800; 900 and/or to at least one lubricating point within a respective unit 100; 200; 300; 400; 500; 600; 650; 700; 800; 900. The at least one pump 1046 is preferably arranged at the at least one source of lubricant and/or at the at least one reservoir of lubricant, for example in the transport direction T downstream from the delivery unit 600.

The lubrication system preferably comprises the at least one first main line 1047. The at least one first main line 1047 is preferably connected to the at least one source of lubricant and/or to the at least one reservoir of lubricant. The at least one first main line 1047 is preferably configured to conduct lubricant from the at least one reservoir of lubricant and/or from the at least one reservoir of lubricant in each case to at least one of the at least two units 200; 300; 400; 500, in particular to the at least one infeed unit 200 and/or the at least one shaping unit 300 and/or the at least one stripping unit 400 and/or the at least one multiple-up separating unit 500.

For example, the first main line 1047 is configured to conduct lubricant directly to the at least two units 200; 300; 400; 500. As an alternative, the first main line 1047 is connected to at least one second main line 1048, preferably to at least two second main lines 1048, for example via at least one distributor 1049. The at least one second main line 1048 is preferably arranged between the at least one first main line 1047 and the at least two units 200; 300; 400; 500, in particular the at least one infeed unit 200 and/or the at least one shaping unit 300 and/or the at least one stripping unit 400 and/or the at least one multiple-up separating unit 500. The at least one second main line 1048 is preferably configured to conduct lubricant to at least one of the units 200; 300; 400; 500, in particular to the at least one infeed unit 200 and/or the at least one shaping unit 300 and/or the at least one stripping unit 400 and/or the at least one multiple-up separating unit 500. More preferably, a second main line 1048 is in each case configured to conduct lubricant to a respective unit 200; 300; 400; 500, in particular to the at least one infeed unit 200 or the at least one shaping unit 300 or the at least one stripping unit 400 or the at least one multiple-up separating unit 500. Preferably, the at least one lubrication system comprises at least one main line 1048, which is in particular configured as the second main line 1048, for each unit 200; 300; 400; 500 connected to the lubrication system, in particular the at least one infeed unit 200 and/or the at least one shaping unit 300 and/or the at least one stripping unit 400 and/or to the at least one multiple-up separating unit 500. The at least one second main line 1048 is preferably configured to conduct lubricant directly to the at least two units 200; 300; 400; 500, preferably to at least one of the at least two units 200; 300; 400; 500.

The at least one lubrication system preferably comprises at least one distributor 1049, which is in particular configured as a first distributor 1049. The at least one first distributor 1049 is preferably connected to the at least one first main line 1047 and/or is arranged at the at least one first main line 1047. The at least one first distributor 1049 is preferably arranged between the at least one first main line 1047 and the at least one second main line 1048. The at least one first distributor 1049 preferably comprises at least one regulator by which lubricant is preferably metered and/or meterable. The at least one first distributor 1049 is preferably configured as a progressive distributor 1049. The at least one lubrication system preferably comprises the at least one distributor 1049 configured as the first distributor 1049, which is configured to distribute and/or meter lubricant to the at least two units 200; 300; 400; 500. The at least one first distributor 1049 is preferably configured to distribute and/or meter lubricant progressively to the at least two units 200; 300; 400; 500, in particular to the at least one infeed unit 200 and/or the at least one shaping unit 300 and/or the at least one stripping unit 400 and/or the at least one multiple-up separating unit 500. The at least one first distributor 1049 is preferably configured to distribute and/or meter lubricant continuously to the at least two units 200; 300; 400; 500. Preferably, the at least one first distributor 1049, which is in particular configured as a progressive distributor 1049, is configured to distribute and/or meter the at least one lubricant as needed to the respective units 200; 300; 400; 500.

Figure 25:
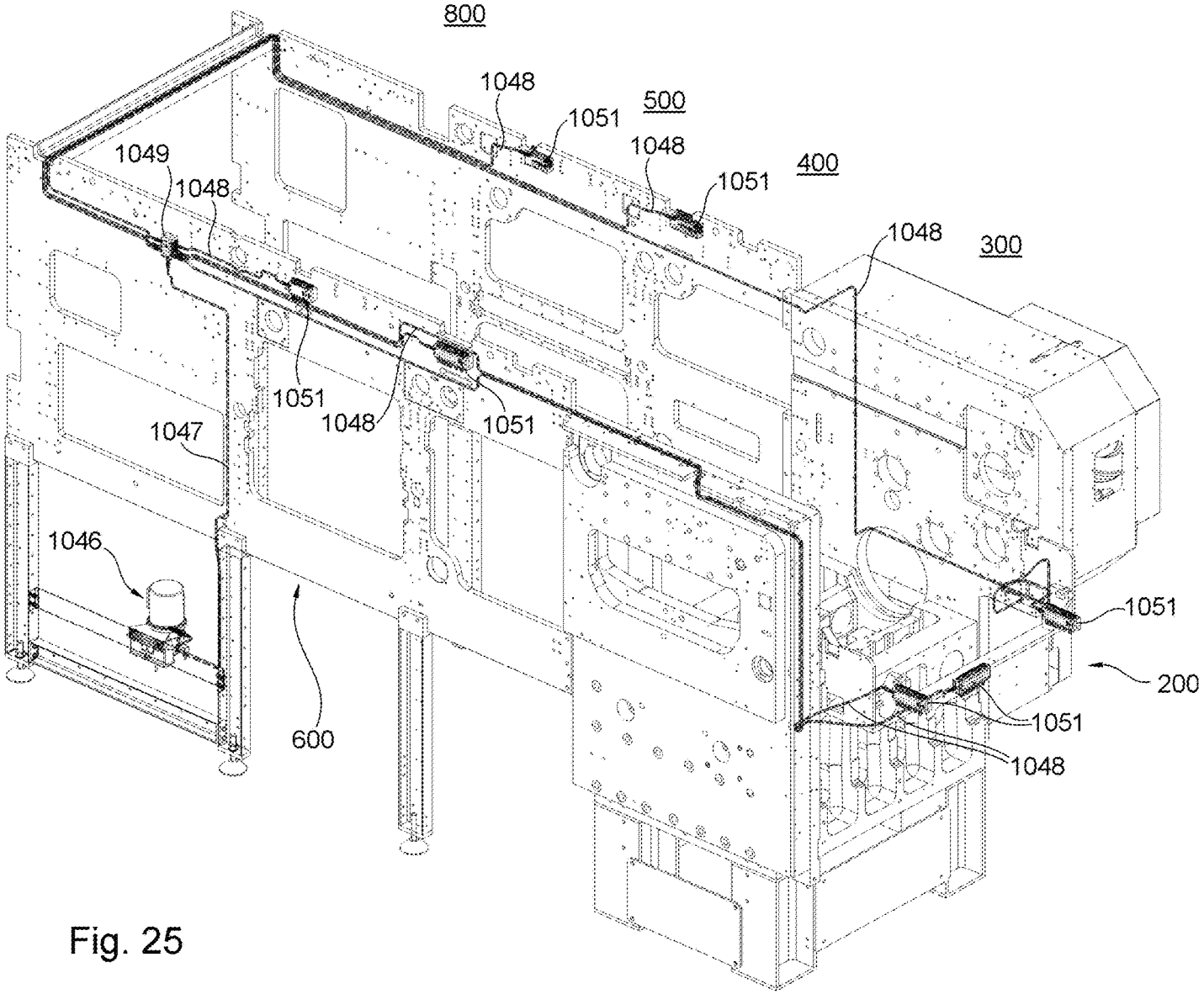
FIG. 25 a perspective illustration of a portion of a central lubricant system of the processing machine.

To illustrate a possible embodiment, FIG. 25 shows a portion of the central lubrication system. In particular, the at least one pump 1046, the at least one first main line 1047, the at least one first distributor 1049, for example multiple second main lines 1048 as well as, for example, multiple second distributors 1051, are shown in a portion of the die-cutting machine 01. The respective second main lines 1048 and the respective second distributors 1051 are to be arranged outside the transport path of sheets 02, in particular within the housing of the die-cutting machine 01, in particular in the region of the infeed unit 200. For the sake of clarity, a dotted illustration of the main lines 1047; 1048 as well as of the distributors 1049; 1051 has been dispensed with, in particular when these, such as in the region of the infeed unit 200, are actually at least partially hidden by further components or the housing of the die-cutting machine 01.

Within the respective unit 200; 300; 400; 500, in particular the at least one infeed unit 200 and/or the at least one shaping unit 300 and/or the at least one stripping unit 400 and/or the at least one multiple-up separating unit 500, the at least one lubrication system is preferably configured to conduct lubricant to the at least one lubricating point. In particular within a unit 200; 300; 400; 500, in particular the at least one infeed unit 200 and/or the at least one shaping unit 300 and/or the at least one stripping unit 400 and/or the at least one multiple-up separating unit 500, the at least one lubrication system preferably comprises at least one line, in particular at least two lines, which are preferably arranged downstream from the at least one main line 1047; 1048 within the lubrication system. Preferably, the at least one line, preferably the at least two lines are configured to conduct lubricant within the respective unit 200; 300; 400; 500, in particular the at least one infeed unit 200 and/or the at least one shaping unit 300 and/or the at least one stripping unit 400 and/or the at least one multiple-up separating unit 500, to the at least one lubricating point.

Above and below, a lubricating point describes a contact region of at least one movable component of the processing machine 01 with at least one further movable or immovable component of the processing machine 01. Preferably, at least one lubricant is provided in this contact region, so that the at least one movable component is preferably configured to move and/or be movable with low friction and/or low wear. For example, a gear mechanism 1004; 1007; 1019 comprises at least one lubricating point. The respective line is preferably configured to conduct lubricant to the at least one lubricating point, in particular within a unit 200; 300; 400; 500, in particular the at least one infeed unit 200 and/or the at least one shaping unit 300 and/or the at least one stripping unit 400 and/or the at least one multiple-up separating unit 500, to the at least one lubricating point. The at least one line within the respective unit 200; 300; 400; 500 is preferably in each case configured to conduct lubricant to exactly one lubricating point. The at least one line preferably comprises at least one nozzle at the at least one lubricating point, to which this line leads. The at least one central lubrication system is preferably configured to lubricate the at least one lubricating point with at least one lubricant. Lubricant is preferably delivered drop-wise to the lubricating point by the at least one nozzle.

The at least one lubrication system preferably comprises at least one second distributor 1051, preferably at least two second distributors 1051. The at least one lubrication system preferably comprises the at least one distributor 1051 configured as the second distributor 1051, which is configured to distribute and/or meter lubricant within the respective unit 200; 300; 400; 500. The at least one lubrication system preferably comprises at least one second distributor 1051, in particular at least two second distributors 1051, for each unit 100; 200; 300; 400; 500; 600; 650; 700; 800; 900 connected thereto. The at least one second distributor 1051 preferably comprises at least one regulator by which lubricant is preferably metered and/or meterable. The at least one lubrication system preferably comprises at least one second distributor 1051 on the drive side and at least one second distributor 1051 on the operator side of the processing machine 01. The respective unit 200; 300; 400; 500, in particular the at least one infeed unit 200 and/or the at least one shaping unit 300 and/or the at least one stripping unit 400 and/or the at least one multiple-up separating unit 500, in each case preferably comprises at least one second distributor 1051, preferably in each case at least one second distributor 1051 on the drive side and at least one second distributor 1051 on the operator side of the processing machine 01. The at least one second distributor 1051 is preferably configured as a progressive distributor 1051. The at least one second distributor 1051 is preferably arranged between the at least one main line 1047; 1048 and the at least two lines within a unit 200; 300; 400; 500, in particular the at least one infeed unit 200 and/or the at least one shaping unit 300 and/or the at least one stripping unit 400 and/or the at least one multiple-up separating unit 500. The at least one second distributor 1051 is preferably configured to distribute and/or meter lubricant progressively and/or continuously to the at least one lubricating point, preferably to at least two lubricating points, within the respective unit 200; 300; 400; 500, in particular the at least one infeed unit 200 and/or the at least one shaping unit 300 and/or the at least one stripping unit 400 and/or the at least one multiple-up separating unit 500. The at least one second distributor 1051 is preferably configured to distribute and/or meter lubricant as needed to the at least one lubricating point within the respective unit 200; 300; 400; 500.

Preferably in addition to the at least one infeed unit 200 and the at least one shaping unit 300 and the at least one stripping unit 400 and the at least one multiple-up separating unit 500, the die-cutting machine 01 comprises the at least one unit 100 configured as a feeder unit 100 and/or the at least one unit 600 configured as a delivery unit 600 and/or at least one joint unit 650, which comprises the at least one multiple-up separating unit 500 and the at least one delivery unit 600, and/or the at least one unit 700 configured as a sheet insert unit 700 and/or the at least one unit 800 configured as an offcut piece delivery unit 800 and/or at least one joint unit 900, which comprises the at least one sheet insert unit 700 and the at least one offcut piece delivery unit 800. The at least one lubrication system is preferably configured to conduct lubricant to at least one of the units 100; 600; 650; 700; 800; 900 configured as a feeder unit 100 and/or as a delivery unit 600 and/or as at least one joint unit 650; 900 and/or as a sheet insert unit 700 and as an offcut piece delivery unit 800, in addition to the at least two units 200; 300; 400; 500. In particular, the at least one lubrication system is configured to conduct lubricant to at least one lubricating point of the feeder unit 100 and/or of the delivery unit 600 and/or of the sheet insert unit 700 and/or of the offcut piece delivery unit 800 and/or of the at least one joint unit 650; 900.

The die-cutting machine 01 preferably comprises the at least one holding element 1202 of the at least one transport system 1200, which is preferably configured to guide and/or transport sheets 02 at least through the at least one shaping unit 300 and/or the at least one stripping unit 400 and/or the at least one multiple-up separating unit 500. The at least one lubrication system is preferably configured to conduct lubricant to the at least one guide device 1203 of the at least one holding element 1202 and/or to at least one clamping element of the at least one guide device 1203 of the at least one holding element 1202 and/or to at least one opening element of the at least one holding element 1202 and/or to at least one support element of the at least one holding element 1202 and/or to the at least one gear wheel of the at least one chain gripper drive shaft 1017, in addition to the at least two units 200; 300; 400; 500.

The at least one infeed unit 200 is preferably configured to transfer sheets 02 to the at least one shaping unit 300. The at least one lubrication system is preferably configured to conduct lubricant to the at least one straight guidance device and/or linear guidance device of the at least one transport means 204 of the at least one infeed system 202 of the at least one infeed unit 200 and/or is configured to lubricate the at least one straight guidance device and/or linear guidance device with lubricant. The at least one lubrication system is preferably configured to lubricate at least one bearing of the at least one gripper shaft 221 of the at least one infeed system 202.

The at least one shaping mechanism 301 of the shaping unit 300 preferably comprises at least one tensioning element. Preferably, the at least one lubrication system is configured to conduct lubricant to the at least one tensioning element of the at least one shaping mechanism 301 and/or is configured to lubricate the at least one tensioning element with lubricant. Preferably, lubricant, in particular lubricating oil, is supplied to the at least one main drive shaft 1006 and/or the at least one die-cutting drive shaft 1016, preferably independently of the at least one lubrication system. The at least one main drive shaft 1006 and/or the at least one die-cutting drive shaft 1016 are preferably arranged within an oil bath.

The at least one shaping unit 300 preferably comprises at least one register unit. Preferably in addition or as an alternative, the at least one stripping unit 400 comprises at least one register unit. Preferably in addition or as an alternative, the at least one infeed unit 200 comprises at least one register unit. The at least one register unit is preferably in each case configured to at least temporarily fix at least one gripper carriage 1201 in a position. The processing machine 01 preferably comprises at least one register unit in the transport direction T at the beginning of the at least one shaping unit 300 and/or at least one register unit in the transport direction T at the end of the at least one shaping unit 300 and/or at least one register unit in the transport direction T at the end of the at least one stripping unit 400. The at least one lubrication system is preferably configured to lubricate the at least one respective register unit, in particular each respective register unit, with lubricant and/or is configured to conduct lubricant to the at least one respective register unit.

The at least one lubrication system is preferably configured to conduct lubricant to the at least one movement converter 1031; 1032, in particular to the at least one movement converter 1031; 1032 of the at least one stripping unit 400 and/or of the at least one multiple-up separating unit 500. The at least one stripping unit 400 preferably comprises at least one component, in particular the at least one movement converter 1031; 1032, of the at least one drive system 1000 and/or at least one component of the drive system 1000 is arranged within the at least one stripping unit 400. The at least one multiple-up separating unit 500 preferably comprises at least one component, in particular the at least one movement converter 1031, of the at least one drive system 1000 and/or at least one component of the drive system 1000 is arranged within the at least one multiple-up stripping unit 500.

A connection of the at least one movement converter 1031; 1032 to the at least one transmitting shaft 1033 is preferably configured as a lubricating point. The at least one lubrication system is preferably configured to conduct lubricant to the at least one lubricating point between the at least one movement converter 1031; 1032 and the at least one transmitting shaft 1033.

The at least one transmitting element 1026; 1027; 1028; 1029 preferably comprises at least one movable connection to the at least one respective movement converter 1031; 1032 with which the relevant transmitting element 1026; 1027; 1028; 1029 is preferably in contact and/or to which it is connected. The at least one movable connection, in particular the movable connection of the at least one transmitting element 1026; 1027; 1028; 1029 to the respective movement converter 1031; 1032 that is in contact therewith and/or connected thereto, preferably has a closed design, which in each case comprises a permanently closed bearing. The at least one in particular permanently closed bearing is preferably configured to be permanently lubricated with lubricant, in particular independently of the at least one central lubrication system and/or without additional lubrication during operation of the processing machine 01.

Preferably, the at least one lubrication system is configured to conduct lubricant to at least one connection, which is preferably configured as a lubricating point, of the at least one transmitting shaft 1033 and of the at least one connecting rod 1034 assigned to the at least one respective transmitting shaft 1033. Preferably, the at least one stripping unit 400 and/or the at least one multiple-up separating unit 500 each comprise the at least one transmitting shaft 1033 and each comprise the at least one connecting rod 1034 assigned to the respective transmitting shaft 1033.

The at least one gear mechanism 1007, preferably the at least one drive gear 1007, is preferably arranged within the at least one housing 1014. The at least one lubrication system is preferably configured to only conduct lubricant to the at least one lubricating point within the respective unit 200; 300; 400; 500 outside the at least one housing 1014 of the at least one gear mechanism 1007, preferably the drive gear 1007. The at least one housing 1014 preferably includes lubricating oil and/or an oil bath. Lubricating points within the at least one housing 1014 are preferably configured to be lubricated with lubricant by a system that is different from the at least one lubrication system, in particular independently of the at least one central lubrication system.

While preferred embodiments of a sheet processing machine and of a method for driving at least one tool of such a sheet processing machine, all in accordance with the present invention, have been set forth fully and completely hereinabove, it will be apparent to one of skill in the art at various changes could be made thereto, without departing from the true spirit and scope of the present invention, which is accordingly to be limited only by the appended claims.

The invention claimed is:

1. A sheet processing machine (01), comprising at least one infeed unit (200) and at least one shaping unit (300) and at least one stripping unit (400) and at least one multiple-up separating unit (500), the sheet processing machine (01) comprising at least one drive (1001), the at least one drive (1001) being configured to drive at least one stripping tool (402; 403) of at least one stripping mechanism (401) of the at least one stripping unit (400) and at least one multiple-up separating tool (502) of at least one multiple-up separating mechanism (501) of the at least one multiple-up separating unit (500) using at least one drive gear mechanism (1007) and at least one downstream gear mechanism (1019), the at least one downstream gear mechanism (1019) being arranged downstream from the at least one drive gear mechanism (1007), the at least one downstream gear mechanism (1019) being coupled to the at least one stripping tool (402; 403) of the at least one stripping unit (400) and to the at least one multiple-up separating tool (502) of the at least one multiple-up separating unit (500), the at least one drive gear mechanism (1007) being configured having at least first and second spur gears, the at least one downstream gear mechanism (1019) being configured to convert at least one rotative movement into at least one reciprocating movement, the at least one downstream gear mechanism (1019) being configured as at least one disk cam mechanism (1019), the at least one drive gear mechanism and the at least one downstream gear mechanism (1019) being contained in a housing (1014).

2. The sheet processing machine according to claim 1, wherein the at least one downstream gear mechanism (1019) comprises at least one scanning lever (1024) and at least one cam disk (1023), and wherein the at least one scanning lever (1024) of the at least one downstream gear mechanism (1019) is configured to be one of at least reciprocatingly movable and to move reciprocatingly.

3. The sheet processing machine according to claim 1, one of wherein the at least one stripping mechanism (401) comprises at least one first stripping tool (402) configured as at least one upper stripping tool (402) and at least one second stripping tool (403) configured as at least one lower stripping tool (403), and wherein the at least one multiple-up separating mechanism (501) of the at least one multiple-up separating unit (500) comprises at least one first separating tool (502), which is arranged above, in a vertical direction (V), and which is configured as an upper multiple-up separating tool (502), and at least one second separating tool, which is arranged beneath the first separating tool and which is configured as a lower multiple-up separating tool.

4. The sheet processing machine according to claim 3, wherein the upper stripping tool (402) is coupled to the at least one transmitting element (1028) via at least one movement converter (1031).

5. The sheet processing machine according to claim 4, one of wherein the at least one movement converter (1031; 1032) is configured as one of at least one gear mechanism and as at least one joint (1031; 1032), and wherein the at least one movement converter (1031; 1032) is coupled via at least one transmitting shaft (1033) to the at least one stripping mechanism (401) and wherein the at least one movement converter (1031; 1032) is coupled via at least one transmitting shaft (1033) to the at least one multiple-up separating tool (502), and wherein at least one transmitting element (1026; 1027; 1028; 1029) is eccentrically arranged as the at least one movement converter (1031; 1032), and wherein the at least one transmitting element (1026; 1027; 1028; 1029) is arranged to be one of pivotable and to pivot about the respective assigned at least one movement converter (1031; 1032), and wherein the at least one movement converter (1031; 1032) is configured as one of an upper movement converter (1031) and as a lower movement converter (1032).

6. The sheet processing machine according to claim claim 3, wherein the sheet processing machine (01) comprises one of at least one vertical transmitting element (1026; 1027) and at least one horizontal transmitting element (1028; 1029), the at least one horizontal transmitting element (1028) being configured having at least one horizontal upper transmitting element, the at least one one horizontal transmitting element (1029) being configured having at least one horizontal lower transmitting element (1029), and wherein the at least one upper stripping tool (402) is coupled to the at least one horizontal upper transmitting element (1028) via at least one upper movement converter (1031).

7. The sheet processing machine according to claim 3, one of wherein the at least one first stripping tool (402), which is configured as the at least one upper stripping tool (402), wherein the at least one multiple-up separating tool unit (500), which is configured as the at least one upper multiple-up separating tool (502) and the at least one upper stripping tool (402) and the at least one upper multiple-up separating tool (502) are coupled to the at least one joint transmitting element (1026; 1028), and wherein the at least one upper stripping tool (402) and the at least one upper multiple-up separating tool (502) are coupled to the at least one drive (1001) via the at least one joint transmitting element (1028) configured as the upper transmitting element (1028), and wherein at least one of the transmitting elements (1026; 1027; 1028; 1029) coupled to the at least one downstream gear mechanism (1019) is configured as at least one upper transmitting element (1026; 1028), and the at least one upper transmitting element (1026; 1028) is coupled to the at least one upper stripping tool (402) and to the at least one upper multiple-up separating tool (502).

8. The sheet processing machine according to claim 1, one of wherein at least one transmitting element (1026; 1027; 1028; 1029) is arranged between the at least one downstream gear mechanism (1019) and the at least one stripping tool (402; 403) and wherein the at least one transmitting element (1026; 1027; 1028; 1029) is arranged between the at least one downstream gear mechanism (1019) and the at least one multiple-up separating tool (502).

9. The sheet processing machine according to claim 8, one of wherein the at least one transmitting element (1026; 1027; 1028; 1029) is configured to carry out at least one reciprocating movement, and wherein the at least one transmitting element (1026; 1027; 1028; 1029) is arranged on an operator side of the sheet processing machine (01) and on a drive side of the sheet processing machine (01), and wherein the drive side and the operator side of the sheet processing machine (01) are arranged parallel to a transport direction (T) of sheets (02) and opposite one another with respect to a transport path of sheets (02), and wherein the at least one transmitting element (1026; 1027; 1028; 1029) is configured as one of a beam and a rod.

10. The sheet processing machine according to claim 9, one of wherein the at least one stripping mechanism (401) is coupled to the at least one transmitting element (1028; 1029) via at least one movement converter (1031; 1032), and wherein the at least one multiple-up separating mechanism (501) is coupled to the at least one transmitting element (1026; 1028) via at least one movement converter (1031).

11. The sheet processing machine according to claim 1, wherein the at least one shaping unit (300) comprises at least one shaping tool (302; 303), wherein the at least one stripping unit (400) comprises the at least one stripping tool (402; 403), wherein the at least one multiple-up separating unit (500) comprises the at least one multiple-up separating tool (502), the infeed unit (200) comprises the at least one infeed drive shaft (1002), the sheet processing machine (01) comprises at least one transport system (1200), and the at least one drive (1001) is configured to drive at least two components, selected from the at least one shaping tool (302; 303) and the at least one stripping tool (402; 403) and the at least one multiple-up separating tool (502) and the at least one transport system (1200) and the at least one infeed drive shaft (1002) of the infeed unit (200).

12. The sheet processing machine (01) of claim 1 wherein the housing (1014) contains lubricating oil.

13. The sheet processing machine (01) of claim 1 further including a chain transport system (1200) having a chain gripper drive shaft (1017) and one of wherein a first spur gear (1009) of the at least one drive gear mechanism (1007) drives a crankshaft (1016) of the at least one shaping unit (300) and wherein a second spur gear (1013) of the at least one drive gear mechanism (1007) drives the chain gripper drive shaft (1017) of the chain transport system (1200).

14. A sheet processing machine (01), comprising at least one infeed unit (200) and at least one shaping unit (300) and at least one stripping unit (400), the sheet processing machine (01) comprising at least one drive (1001), the at least one stripping unit (400) comprising at least one stripping mechanism (401), the at least one stripping mechanism (401) comprising at least one first stripping tool (402) configured as an upper stripping tool (402) and at least one second stripping tool (403) configured as a lower stripping tool (403), wherein the at least one drive (1001) is configured to drive at least one of the upper stripping tool and the lower stripping tool ((402; 403) of the at least one stripping mechanism (401) of the at least one stripping unit (400) via at least one drive gear mechanism (1007), and at least one downstream gear mechanism (1019) arranged downstream from the at least one drive gear mechanism (1007) the at least one drive gear mechanism (1007) being configured having at least first and second spur gears, the at least one downstream gear mechanism (1019) being configured as at least one disk cam mechanism and being coupled to the at least one of the upper stripping tool and the lower stripping tool (402; 403) of the at least one stripping unit (400), the at least one downstream gear mechanism (1019) being configured to convert at least one rotative movement into at least one reciprocating movement, at least one transmitting element (1026; 1027; 1028; 1029) being arranged between the at least one downstream gear mechanism (1019) and the at least one of the upper stripping tool and the lower stripping tool (402; 403), and the at least one upper stripping tool (402) being coupled to the at least one transmitting element (1028) via at least one movement converter (1031), the at least one drive gear mechanism and the at least one downstream gear mechanism (1019) being contained in a housing (1014).

15. The sheet processing machine according to claim 14, further comprising at least one multiple-up separating unit (500), the at least one drive (1001) being configured to drive at least one multiple-up separating tool (502) of at least one multiple-up separating mechanism (501) of the at least one multiple-up separating unit (500) via the at least drive one gear mechanism (1007), and the at least one downstream gear mechanism (1019) which are coupled to the at least one multiple-up separating tool (502) of the at least one multiple-up separating unit (500).

16. A method for driving at least one tool (402; 403; 502) of a sheet processing machine (01), the sheet processing machine (01) including at least one infeed unit (200) and at least one shaping unit (300) and at least one stripping unit (400) and at least one multiple-up separating unit (500), the sheet processing machine having at least one drive system (1000) comprising at least one drive (1001), the at least one drive (1001) driving at least one tool (402; 403), configured as a stripping tool (402; 402), of at least one stripping mechanism (401) of the at least one stripping unit (400), and at least one tool (502) as a multiple-up separating tool (502), of at least one multiple-up separating mechanism (501) of the least one multiple-up separating unit (500) using at least one drive gear mechanism having at least first and second spur gears (1007) and at least one downstream gear mechanism (1019) and arranging the downstream gear mechanism (1019) downstream from the at least one gear mechanism (1007), configuring the at least one downstream gear mechanism (1019) to convert at least one rotative movement into at least one reciprocating movement, and configuring the at least one downstream gear mechanism (1019) as a disk cam mechanism (1019), and providing the at least one drive gear mechanism (1007) and the at least one downstream gear mechanism (1019) in a housing (1014).

17. The method according to claim 16, further including one of providing at least one of the at least one stripping tool (402; 403) of the at least one stripping unit (400) and the at least one multiple-up separating tool (502) of the at least one multiple-up separating unit (500) being movable one of in and counter to a vertical direction (V) using the at least one downstream gear mechanism (1019), and providing one of the at least one stripping tool (402; 403) and the at least one multiple-up separating tool (502) being movable in a vertical direction (V) by one of using a transmission and by converting at least one reciprocating movement to the at least one stripping tool (402; 403) and to the at least one multiple-up separating tool (502), and arranging the at least one drive gear mechanism (1007) and the at least one downstream gear mechanism (1019) on a drive side of the sheet processing machine (01) at the at least one shaping unit (300).

18. The method according to claim 16, further including one of providing at least one transmitting element (1026;

1027; 1028; 1029) arranged between one of the at least one downstream gear mechanism (1019) and the at least one stripping tool (402; 403) and arranging the at least one transmitting element (1026; 1027; 1028; 1029) between the at least one downstream gear mechanism (1019) and the at least multiple-up separating tool (502), configuring the at least one transmitting element (1026; 1027; 1028; 1029) as one of a beam and as a rod, and coupling the at least one transmitting element (1026; 1027; 1028; 1029) to the at least one stripping tool (402; 403) of the at least one stripping unit (400) and to the at least one multiple-up separating tool (502) of the at least one multiple-up separating unit (500), the at least one transmitting element (1026; 1027; 1028; 1029) being movable reciprocatingly, and coupling the at least one stripping tool (402; 403) to the at least one transmitting element (1028; 1029) via the at least one movement converter (1031; 1032), configuring the at least one multiple-up separating tool (502) being coupled to the at least one transmitting element (1028) via at least one movement converter (1031), and providing the at least one transmitting element (1026; 1027; 1028; 1029) coupled to the at least one downstream gear mechanism (1019) as at least one vertical transmitting element (1026; 1027) which is arranged to be one of moved and movable at least in the vertical direction (V), and arranging at least one transmitting element (1026; 1027; 1028; 1029) on one of an operator side of the sheet processing machine (01) and on a drive side of the sheet processing machine (01), and providing the drive side and the operator side arranged parallel to a transport direction (T) of sheets (02) and opposing one another with respect to a transport path of sheets (02).

19. The method according to claim 16, further including one of providing the at least one stripping mechanism (401) comprising at least one tool (402) configured as an upper stripping tool (402) and configuring at least one tool (403) configured as a lower stripping tool (403), the respective ones of the upper stripping tool and the lower stripping tool (402; 403) being configured to be one of movable in the vertical direction (V) and to move in the vertical direction (V), and configuring the at least one multiple-up separating tool (502) as an upper multiple-up separating tool (502).

20. The method according to claim 19, further including one of configuring the at least one stripping tool (402) as the upper stripping tool (402), configuring the at least one multiple-up separating tool (502) as the upper multiple-up separating tool (502), moving the at least one upper stripping tool (402) and the at least one upper multiple-up separating tool (502) by at least one joint transmitting element (1026; 1028), and configuring the sheet processing machine (01) having at least one transmitting element (1026; 1028) configured as an upper transmitting element (1026; 1028), and providing the respective at least one upper stripping tool (402) and the at least one upper multiple-up separating tool (502) being reciprocatingly moved by the at least one upper transmitting element (1026; 1028), and providing the at least one multiple-up separating mechanism (501) of the at least one multiple-up separating unit (500) comprising the at least one tool (502), being arranged above, in a vertical direction (V), and being configured as the upper multiple-up separating tool (502), and as at least one tool, which is arranged beneath the upper multiple-up separating tool (502) and being configured as a lower multiple-up separating tool.

* * * * *